US006161928A

United States Patent [19]

Morikawa et al.

[11] Patent Number: 6,161,928

[45] Date of Patent: Dec. 19, 2000

[54] IMAGE FORMING METHOD AND APPARATUS FOR RAPIDLY FIXING INK ON A RECORDING MEDIUM

[75] Inventors: Minoru Morikawa, Kawasaki; Yasuo Katano, Yokohama, both of Japan

[73] Assignee: Ricoh Company, Ltd., Tokyo, Japan

[21] Appl. No.: 09/505,164

[22] Filed: Feb. 16, 2000

Related U.S. Application Data

[62] Division of application No. 08/850,674, May 2, 1997.

[30] Foreign Application Priority Data

| | | | |
|---|---|---|---|
| May 2, 1996 | [JP] | Japan | 8-111539 |
| Sep. 10, 1996 | [JP] | Japan | 8-239511 |
| Jan. 31, 1997 | [JP] | Japan | 9-018994 |
| Jan. 31, 1997 | [JP] | Japan | 9-019453 |

[51] Int. Cl.[7] ..... B41M 7/00; B41J 2/45

[52] U.S. Cl. ..... 347/96; 347/101

[58] Field of Search ..... 347/96, 98, 100, 347/101, 102; 399/340; 430/97

[56] References Cited

U.S. PATENT DOCUMENTS

| | | |
|---|---|---|
| 5,175,568 | 12/1992 | Oyamaguchi et al. . |
| 5,177,506 | 1/1993 | Katano . |
| 5,200,762 | 4/1993 | Katano et al. . |
| 5,278,126 | 1/1994 | Katano et al. . |
| 5,335,001 | 8/1994 | Katano . |
| 5,369,421 | 11/1994 | Tomono et al. . |
| 5,436,642 | 7/1995 | Oyamaguchi et al. . |
| 5,471,234 | 11/1995 | Katano et al. . |

FOREIGN PATENT DOCUMENTS

| | | |
|---|---|---|
| 0 606 490 | 7/1994 | European Pat. Off. . |
| 583 570 | 8/1933 | Germany . |
| 902 855 | 1/1954 | Germany . |
| 93 05 552 | 6/1993 | Germany . |
| 54-49208 | 4/1979 | Japan . |
| 54-120005 | 9/1979 | Japan . |
| 58-84794 | 5/1983 | Japan . |
| 59-29197 | 2/1984 | Japan . |
| 59-45157 | 3/1984 | Japan . |
| 60-248397 | 12/1985 | Japan . |
| 64-9959 | 2/1989 | Japan . |
| 2-16053 | 1/1990 | Japan . |
| 2-80279 | 3/1990 | Japan . |
| 3-173646 | 7/1991 | Japan . |
| 3-178478 | 8/1991 | Japan . |
| 4-21493 | 1/1992 | Japan . |
| 5-269949 | 10/1993 | Japan . |
| 8-39947 | 2/1996 | Japan . |
| 167 823 | 6/1934 | Switzerland . |
| 468 233 | 7/1937 | United Kingdom . |
| 530 424 | 12/1940 | United Kingdom . |
| 2 141 669 | 1/1985 | United Kingdom . |
| 2 173 717 | 10/1986 | United Kingdom . |

*Primary Examiner*—Richard Moses
*Attorney, Agent, or Firm*—Oblon, Spivak, McClelland, Maier & Neustadt, P.C.

[57] ABSTRACT

There is provided an image forming apparatus which fixes ink in a short time without deteriorating clearness or transparency of the ink. An ink image is formed on a recording medium by the ink containing a resin and a solvent miscible with the resin. An ink curing liquid is applied to contact the ink image on the recording medium. The ink curing liquid is miscible with the solvent, and has a molecular weight greater than a molecular weight of the solvent. Alternatively, an ink curing solid is applied to contact the ink image on the recording medium. The ink curing solid has a swelling property with respect to the solvent contained in the ink.

24 Claims, 43 Drawing Sheets

10-POINT AVARAGE ROUGHNESS
LESS THAN 2 μm

IMAGE FORMING METHOD AND APPARATUS FOR RAPIDLY FIXING INK ON A RECORDING MEDIUM

This application is a Division of Ser. No. 08/850,674 filed May 2, 1997.

BACKGROUND OF THE INVENTION

1. Field of the Invention

The present invention generally relates to an image forming method and apparatus for a printing machine a printer and the like and, more particularly, to an image forming method and apparatus in which ink is fixed on a recording medium such as print paper during or after formation of the ink image.

2. Description of the Related Art

In an image forming apparatus such as a printing machine, ink is used to print an image on a recording medium such as recording paper or film. Generally, ink used for printing does not dry rapidly since such ink contains solvents having a high-boiling point. Thus, the ink cannot be fixed on a recording medium in a short time. A problem arises in that a so-called set-off occurs when the recording media is laid on top of another immediately after printing. Additionally, there is a problem in that when recording is performed on both surfaces of the recording medium, it takes a long time to print on both surfaces since printing on one surface cannot be performed until the ink printed on the other surface is completely cured or dried.

In order to solve the above-mentioned problems, there are conventional ink fixing methods as described below.

(1) Oxidative Polymerization Drying Method

A long time is needed to dry ink since vehicle molecules in drying oil and polymerized oil or resin varnish are slowly oxidative-polymerized in the presence of oxygen. Accordingly, if the recording papers stick to one another after being printed, the drying time is; further extended, resulting in occurrence of set-off or blocking. This may be a big problem in trying to achieve a high-speed printing operation. In order to eliminate this problem, a powder coating may be applied. However, there is a problem in that the powder is scattered around the image forming apparatus, resulting in an adverse effect to humans body.

(2) Photochemical Polymerization Drying Method

This method solidifies ink by using an ink that can be cured by an ultraviolet beam and irradiating an ultraviolet beam to an ink image after printing. There is a problem in practice in that an expensive ink and an expensive ultraviolet beam irradiating apparatus are required.

(3) Electron Beam Drying Method

This method solidifies ink by using an ink that can be cured by an electron beam and irradiating an electron beam to an ink image after printing. There is a problem in practice in that an expensive ink and an expensive electron beam irradiating apparatus are required.

(4) Heat Drying Method

In order to achieve rapid drying, a recording paper must be heated within a very short time after printing of the ink image. Thus, a high power heat source must be used which is expensive. Additionally, there is a problem in that so-called heat wrinkles occur in a recording paper due to evaporation of water contained in the recording paper.

In an ink fixing method disclosed in Japanese Laid-Open Patent Application No.2-16053, the drying time of the ink is shortened by transferring excessive ink on the recording paper to a transfer paper by laying the transfer paper on the recording paper. In this method, since a coloring agent is transferred from the recording paper to the transfer papers as well as the solvent, the transfer paper is required for each recording paper so as to prevent a reverse transfer of the coloring agent from the transfer paper to the recording paper. Thus, there is a problem of increased running cost. Additionally, the size of the printing apparatus is increased due to providing an additional space for accommodating a transfer paper roll. Further, since a part of the ink on the recording paper is transferred to the transfer paper, there is a possibility that concentration of the ink on the recording paper is reduced.

In an ink fixing method disclosed in Japanese Laid-Open Patent Application No.59-29197, a drying action of ink is promoted by applying, after printing, a liquid type dryer containing metallic salts of fatty acid as a primary component. In this method, there is a problem in that the drying time is extended when humidity is high or when the immersion water is emulsified in the ink or when printing is performed with an acid paper.

In an ink fixing method disclosed in Japanese Laid-Open Patent Application No.58-84794 (corresponding to Japanese Patent publication No.64-9959), ink is cured by extracting and removing a solvent (A) contained in a vehicle of the ink to dissolve a resin from the ink on a recording paper by using a solvent (B) which does not dissolve the resin and is not miscible with the solvent (A). When this method is use in practice, the recording medium (recording paper) is immersed in the solvent (B), or the solvent (B) is sprayed on the surface of the recording medium, or a roll carrying the solvent (B) is contacted to the recording medium. This is performed so as to supply a large amount of the solvent (B) on the surface of the recording medium. Accordingly, if a recording medium such as a recording paper which absorbs the solvent (B) is used, and if a solvent having a low-volatility is used for the solvent (B), a time period greater than that required for fixing the ink is needed to dry the recoding paper. On the other hand, if a solvent having a high-volatility is used foe the solvent (B), there is a problem with respect to environmental sanitation.

Additionally, this method uses a large amount of solvent, and requires a mechanism for applying the solvent (B) and a mechanism for collecting the applied solvent (B). Thus, construction of the printing apparatus becomes complex.

Further if water is used as the solvent (B), there is a problem in that the strength of the recording medium is decreased, the surface of the recording medium is deteriorated or the quality of the printed material itself is deteriorated.

Additionally, the solvent (B) may penetrate into the resin of the vehicle when the solvent (B) contacts the vehicle contained in the ink. In this case, the vehicle may become cloudy, and the resin layer of the cured ink may become brittle. Additionally, the image quality is deteriorated since clearness or transparency of the ink is reduced. Further, there is a problem in that a mechanical strength of the fixed ink film is decreased, and the ink film may peel off the recording paper due to friction.

In an ink fixing method disclosed in Japanese Laid-Open Patent Application No.54-49208, an oil base ink is used, and a drying action of the ink is promoted by contacting organic peroxide with the ink which has been transferred to the recording paper. In this method, since the ink is a special ink containing metallic salts of fatty acid, and the metallic salts of fatty acid gradually react with oxygen in the air, there is a problem in storing the ink for a long period of time.

Japanese Laid-Open Patent Application No.3-178478 discloses a recording apparatus. In the recording apparatus disclosed in this patent document, if an oil base ink is used, the ink cannot be fixed or dried and it takes a long time to dry the ink. Specially, if the recording papers are laid on one another after printing, this causes a set-off or blocking and the drying time is further extended. Thus, there is a problem in achieving a high-speed printing.

In an ink fixing method disclosed in Japanese Laid-Open Patent Application No.59-45157, a drying action of ink is promoted by applying porous fine powder onto a print surface so as to absorb solvent contained in the ink. However, a large amount of powder must be applied on the print surface so as to fix the ink. In this case, a large amount of powder is also fixed on the print surface. This causes deterioration of image quality. Additionally, there is an environmental sanitary problem in that the powder is scattered and float in the atmosphere.

Additionally, a surface of a recording medium may be protected after printing by a resin layer applied thereon. The resin layer may be also applied to provide a visual effect to the printed matter such as glossy surface, a mat surface or an embossed surface.

In a method for protecting a printed surface disclosed in Japanese Laid-Open Patent Application No.2-80279, a printed surface is protected by press coating a film after applying a liquid containing acrylic urethane type resin. In this method, a heat treatment process lasting about one hour is required to dry the liquid containing acrylic urethane type resin. This process is complex and an apparatus for performing this process is large. Additionally, there is a problem in that material cost is increased since a laminate film is needed. Further, this method is limited to a printed surface using a water base ink.

In a method for protecting a printed surface disclosed in Japanese Laid-Open Patent Application No.3-173646, water resistance and weather resistance are achieved for a printed surface of the print paper in an ink jet print apparatus. In this method, a first liquid containing a coloring agent and a second liquid are projected separately so as to transfer an ink mixture onto a print surface. However, since two different liquids are projected to form a single dot, a diameter of the dot is enlarged due to an offset of positions. This may deteriorate gradation of the image. Thus, positional accuracy is required for the two liquid drops. However, there is a problem in that image quality is affected by a thickness of the recording paper. Additionally, this method is limited for use with an ink jet printing method.

In a method for protecting a print surface disclosed in Japanese Laid-Open Patent Application No.4-21493, a glossy surface is provided to a desired area of a print surface by applying a film after applying varnish to the desired area and then peeled off the film. It takes about 15 hours at 40° C. to evaporate solvent contained in the varnish. Thus, this method requires a long time and a complex system.

In a method for protecting a print surface disclosed in Japanese Laid-Open Patent Application No.5-269949, a laminate film is applied to the print surface with heat and pressure so as to provide a glossy and protected print surface. The laminate film comprises a resin layer formed by a polypropylene resin containing petroleum resin and an adhesive layer containing more than 25% of polyolefine resin. In this method, since a pressure of about 35 kg/cm$^2$ with an elevated temperature of 100° C. is needed to adhere the laminate film to the print surface, a large-scale manufacturing facility is required. Additionally, there is a problem in that material cost of the laminate film is high.

In a method for protecting a print surface disclosed in Japanese Laid-Open Patent Application Nc.8-39947, a mat processed laminate layer is formed on the print surface of the print paper. In this method, a transfer type laminate film is used which comprises a base material applied with a laminate layer. The base material is formed by a layered product comprising a polyester film and a mat processes polyolefine resin layer. Accordingly, the laminate film includes two films other than the laminate layer, and also includes the adhesive layer to adhere the laminate film. Thus, the material cost of the laminate film is increased. Additionally, processing speed of the lamination of the lamination film onto the print surface is as slow as 1 m/min. which provides low-productivity, and an additional process for peeling off the film is needed. Further, since the laminate layer is solid, there is a problem in that there is a low degree of adhesion with respect to a coarse print surface.

In a method for protecting a print surface disclosed in Japanese Laid-Open Patent Application No.54-120005, an ultraviolet cure type coating agent is coated on a print surface printed with an oil base ink, and the coating agent is dried to provide a coating film on the print surface. The coating agent comprises a composite including a prepolymer and a photosensitizer to which composite a resin or a resin acid of 0.5 to 10.0% is added. The prepolymer may include a prepolymer having a radical cross-linking ethylene unsaturated double bond. The prepolymer may be added with a monomer having a radical cross-linking ethylene unsaturated double bond. In this method, since the ultraviolet cure type coating agent is used, running cost and facility cost for a curing process is increased. Additionally, use of this method is limited to a print surface printed by an oil base ink.

SUMMARY OF THE INVENTION

The present invention generally relates to an image forming apparatus and method in which the above-mentioned problems are eliminated.

A more specific object of the present invention is to provide an image forming apparatus and method in which fixation of ink can be performed in a short time.

Another object of the present invention is to provide an image forming apparatus and method in which fixation of ink can be performed in a short time without deteriorating clearness or transparency of the ink.

Another object of the present invention is to provide an image forming apparatus and method in which fixation of ink can be performed in a short time and with the fixed ink having sufficient strength of the fixed ink.

A further object of the present invention is to provide an image forming apparatus and method in which fixation of ink can be performed in a short time without decreasing concentration of the ink.

Yet another object of the present invention is to provide an image forming apparatus which can form a resin layer on a print surface in a short time so as to protect the print surface.

In order to achieve the above-mentioned object, there is provided according to one aspect of the present invention, an image forming method for fixing an ink image on a recording medium, comprising the steps of:

transferring ink to the recording medium so as to form the ink image on the recording medium, the ink containing a resin and a solvent miscible with the resin; and applying an ink curing liquid to contact the ink transferred to the recording medium, the ink curing liquid being miscible with the solvent, the ink curing liquid having a molecular weight greater than a molecular weight of the solvent.

According to the above-mentioned invention, the ink can be rapidly cured by the application of the ink curing liquid which has a molecular weight greater than a molecular weight of the solvent contained in the ink. Thus, set-off of the ink can be prevented when a high-speed printing operation is performed. Additionally, the ink image fixed by the method according to the present invention is clear and has a sufficient mechanical strength.

Additionally, there is provided according to another aspect of the present invention an image forming apparatus for fixing an ink image on a recording medium, comprising:

an ink transfer mechanism which transfers ink to the recording medium so as to form the ink image on the recording medium, the ink containing a resin and a solvent miscible with the resin; and an ink fixing mechanism which applies an ink curing liquid to contact the ink transferred to the recording medium, the ink curing liquid being miscible with the solvent, the ink curing liquid having a molecular weight greater than a molecular weight of the solvent.

According to the above-mentioned invention, the ink can be rapidly cured by the application of the ink curing liquid which has a molecular weight greater than a molecular weight of the solvent contained in the ink. Thus, set-off of the ink can be prevented when a high-speed printing operation is performed. Additionally, the ink image fixed by the method according to the present invention is clear and has a sufficient mechanical strength.

In one embodiment of the present invention, the ink curing liquid may be a flowable silicone resin.

The image forming apparatus according to the present invention may further comprise a cooling unit for cooling a contact area where the ink curing liquid contacts the ink transferred on the recording medium. The curing time of the ink is shortened by decreasing a temperature of the ink while the ink curing liquid is in contact with the ink.

The cooling unit may cool the contact area to a temperature below an upper critical solution temperature when a temperature of the contact area exceeds the upper critical solution temperature, the upper critical solution temperature determined by the resin and the solvent contained in the ink.

Alternatively, the image forming apparatus according to the present invention may further comprise a heating unit for heating a contact area where the ink curing liquid contacts the ink transferred on the recording medium. The curing time of ink is shortened by increasing a temperature of the ink while the ink curing liquid is in contact with the ink.

The heating unit may heat the contact area to a temperature above a lower critical solution temperature when a temperature of the contact area is below the lower critical solution temperature, the lower critical solution temperature determined by the resin and the solvent contained in the ink.

The image forming apparatus according to the present invention may further comprise:

a conveying mechanism conveying the recording medium having an unfixed ink image thereon to the ink fixing mechanism; and an ejecting mechanism ejecting the recording medium externally of the image forming apparatus when the unfixed ink image is fixed.

Additionally, in the image forming apparatus according to the present invention, a plurality of the ink fixing mechanisms may be provided on the recording medium.

Further, the image forming apparatus may further comprise a removing unit for removing the ink curing liquid adhering on the recording medium after the ink curing liquid is applied to contact the ink image on the recording medium.

Additionally, there is provided according to another aspect of the present invention an image forming method for fixing an ink image on a recording medium, comprising the steps of:

transferring ink to the recording medium so as to form the ink image on the recording medium, the ink containing a resin and a solvent miscible with the resin; and applying an ink curing solid to contact the ink transferred onto the recording medium, the ink curing solid having a swelling property with respect to the solvent contained in the ink.

According to the above-mentioned invention, the ink can be cured in a short time by the ink curing solid having a swelling property with respect to the solvent in the ink. Thus, a high-speed printing operation can be achieved without setoff of ink. This method provides a simple structure for printing and requires no special ink to reduce the curing time of the ink. Additionally, the ink image fixed by the method according to the present invention is clear and has a sufficient mechanical strength.

In the above-mentioned image forming method, the ink curing solid may lack permeability with respect to the ink.

Additionally, there is provided according to another aspect of the present invention an image forming apparatus for fixing an ink image on a recording medium, comprising:

an ink transferring mechanism which transfers ink to the recording medium so as to form the ink image on the recording medium, the ink containing a resin and a solvent miscible with the resin; and a fixing mechanism applying an ink curing solid to contact the ink transferred to the recording medium, the ink curing solid having a swelling property with respect to a solvent contained in the ink.

According to the above-mentioned invention, the ink can be cured in a short time by the ink curing solid having a swelling property with respect to the solvent in the ink. Thus, a high-speed printing operation can be achieved without setoff of ink. This method provides a simple structure for printing and requires no special ink to reduce the curing time of the ink. Additionally, the ink image fixed by the method according to the present invention is clear and has a sufficient mechanical strength.

In the above-mentioned image forming apparatus, the ink curing solid may lack permeability with respect to the ink.

In one embodiment according to the present invention, the image forming apparatus may further comprise a heating unit for heating the ink curing solid when the ink curing solid is applied to contact the ink transferred to the recording medium. The curing time of the ink can be reduced by increasing a temperature of the ink when the ink curing solid is in contact with the ink.

The heating unit may heat the ink curing solid to a temperature above a lower critical solution temperature determined by the resin and the solvent contained in the ink.

Alternatively, the image forming apparatus may further comprise a cooling unit for cooling the ink curing solid when the ink curing solid is applied to contact the ink transferred to the recording medium. The curing time of the ink can be reduced by decreasing a temperature of the ink when the ink curing solid is in contact with the ink.

The cooling unit may cool the ink curing solid to a temperature below an upper critical solution temperature determined by the resin and the solvent contained in the ink.

In one embodiment according to the present invention, the ink curing solid may be a silicone resin. Additionally, the ink curing solid may have a glossy surface. A plurality of ink curing solids may be provided in the fixing mechanism. Further, the ink curing solid may have a belt-like shape.

In one embodiment according to the present invention, the image forming apparatus may further comprise a heating unit for heating the ink curing solid in the absence of an ink fixing operation performed in the image forming apparatus.

Additionally, there is provided according to another aspect of the invention a resin layer forming apparatus for forming a resin layer on a printed surface of a recording medium, comprising:

an applying unit for applying a resin liquid to the printed surface of the recording medium, the resin liquid containing a solvent and a resin dissolved in the solvent; and a curing unit for curing the resin liquid, the curing unit including a curing solid which contacts the resin liquid applied on the printed surface, the curing solid having a swelling property with respect to the solvent contained in the resin liquid.

The resin liquid applied on the printed surface is considered to have a composition the same as that of a vehicle contained in ink. Thus, the method for curing ink according to the present invention can be applied to the method for curing the resin liquid.

In one embodiment of the resin layer forming apparatus, the curing solid may be a silicone resin. Additionally, the curing solid may have a glossy surface.

The resin layer forming apparatus according to the present invention may further comprise a forming unit for forming at least one of a matted and embossed surface on the resin layer.

Additionally, in the resin layer forming apparatus, the applying unit may apply the resin liquid to a selected part of the printed surface.

The applying unit may apply the resin liquid to the printed surface in a non-contact manner by using one of a spray and a jet nozzle.

The curing unit may vary a contact pressure between the curing solid and the print surface based on at least one of a degree of roughness of the printed surface, a degree of infiltration of the ink into the recording medium and a degree of dryness of the ink on the printed surface.

Additionally, there is provided according to another aspect of the present invention an image forming apparatus for forming a resin layer on a printed surface of a recording medium, comprising:

a print unit for printing an ink image on the recording medium so as to form the printed surface;

an applying unit for applying a resin liquid to the printed surface of the recording medium, the resin liquid containing a solvent and a resin dissolved in the solvent; and a curing unit for curing the resin liquid, the curing unit including a curing solid which contacts the resin liquid applied on the print surface, the curing solid having a swelling property with respect to the solvent contained in the resin liquid.

Further, there is provided according to another aspect of the present invention a resin layer forming apparatus for forming a resin layer on a printed surface of a recording medium, comprising:

an applying unit for applying a resin liquid on the printed surface of the recording medium, the resin liquid containing a solvent and a resin dissolved in the solvent; and a curing unit for curing the resin liquid, the curing unit applying a curing liquid to contact the resin liquid applied on the printed surface, the curing liquid being miscible with the solvent in which the resin is dissolved, the curing liquid having a molecular weight greater than a molecular weight of the solvent.

In the resin layer forming apparatus, the curing liquid may be a flowable silicone resin.

Additionally, the resin layer forming apparatus according to the present invention may further comprise a forming unit for forming at least one of a matted and embossed surface on the resin layer.

In the resin layer forming apparatus according to the present invention, the applying unit may apply the resin liquid to a selected part of the printed surface.

The applying unit may apply the resin liquid to the printed surface in a non-contact manner by using one of a spray and a jet nozzle.

Further, there is provided according to another aspect of the present invention an image forming apparatus for forming a resin layer on a printed surface of a recording medium, comprising:

a print unit for printing an ink image on the recording medium so as to form the printed surface;

an applying unit for applying a resin liquid to the printed surface of the recording medium, the resin liquid containing a solvent and a resin dissolved in the solvent; and a curing unit for curing the resin liquid, the curing unit applying a curing liquid to contact the resin liquid applied on the printed surface, the curing liquid being miscible with the solvent, the curing liquid having a molecular weight greater than a molecular weight of the solvent.

Other objects, features and advantages of the present invention will become more apparent from the following derailed description when read in conjunction with the accompanying drawings.

Figure 1:
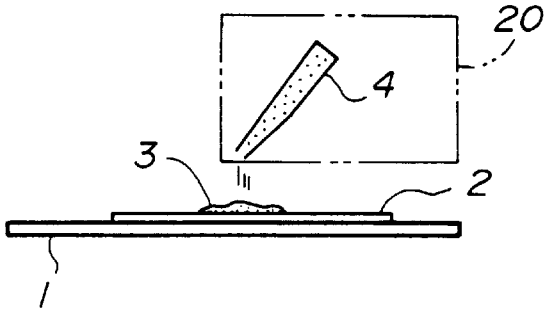
FIG. 1 is an illustration of an example in which an ink curing liquid is supplied by a dropping pipet.

DETAILED DESCRIPTION OF THE PREFERRED EMBODIMENTS (Description of First Embodiment)

FIGS. 1 to 7 are illustrations for explaining a first embodiment according to the present invention. In the figures, a reference numeral 1 indicates a substrate, or a recording medium or a single piece of paper such as a postcard; 2 indicates ink or an ink layer; 3 indicates a ink curing liquid; 4 indicates a dropping pipet, 10 indicates an ink transfer mechanism, 11 indicates a recording layer; 12 indicates a substrate; 13 indicates a plate; 14 indicates a blanket; 15 indicates a letterpress; 16 indicates a stencil; 20 indicates an ink fixing mechanism; 21 indicates a rubber roller; 22 indicates an ink curing liquid layer; 23 indicates an ink curing liquid impregnated porous member; 24 indicates an ink curing liquid storing vessel; 25 indicates a group of rollers; 26 indicates a grip; 27 indicates an ink curing liquid spray; and 28 indicates a pressing roller. In the present embodiment, fixation of ink is achieved by contacting or applying the ink curing liquid 3 to the ink transfer surface of the recording medium 1 such as a recording paper after an ink image is transferred onto the ink transfer surface.

Figure 2:
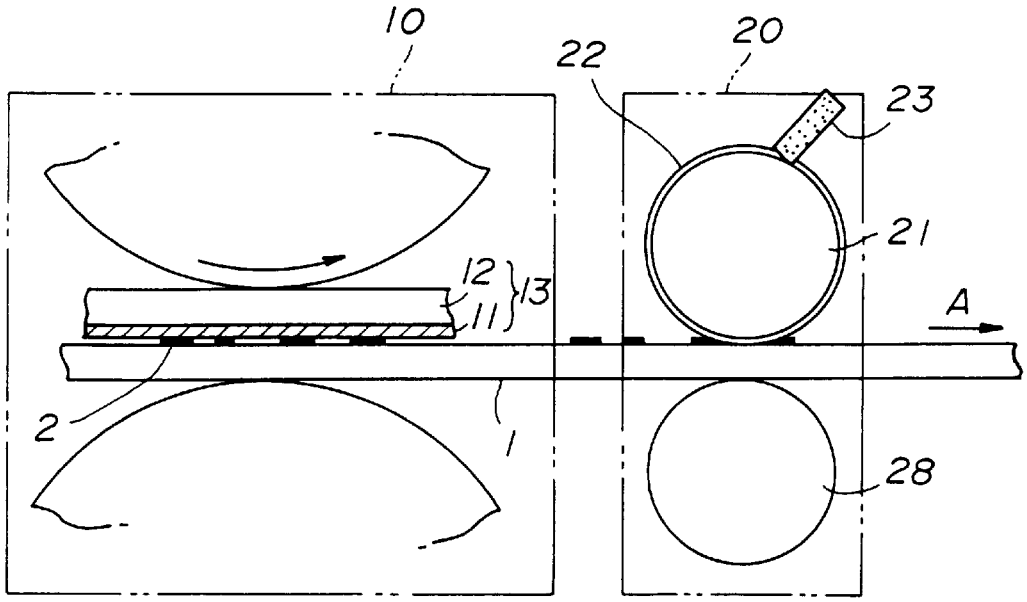
FIG. 2 is an illustration of an example in which the ink curing liquid is supplied by an ink curing liquid impregnated member.
Figure 3:
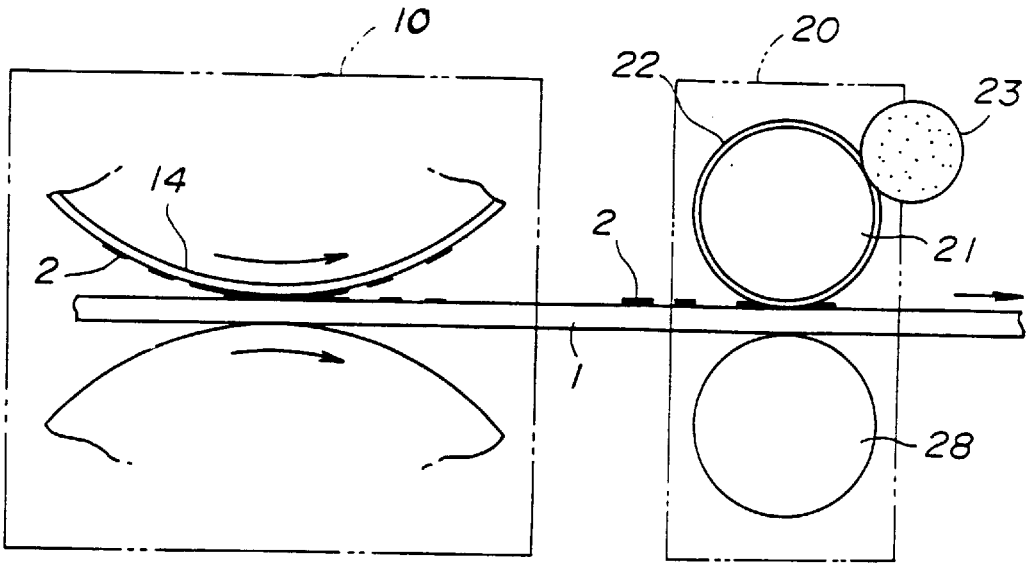
FIG. 3 is an illustration of an example in which the ink curing liquid is supplied by an ink curing liquid impregnated roller.
Figure 4:
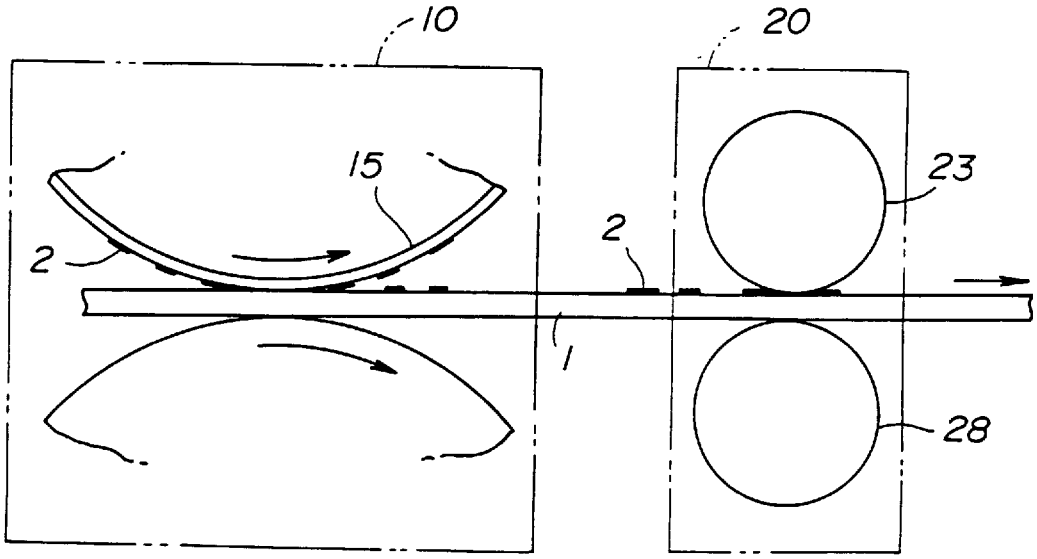
FIG. 4 is an illustration of an example in which the ink curing liquid is directly supplied by an ink curing liquid impregnated roller.
Figure 6:
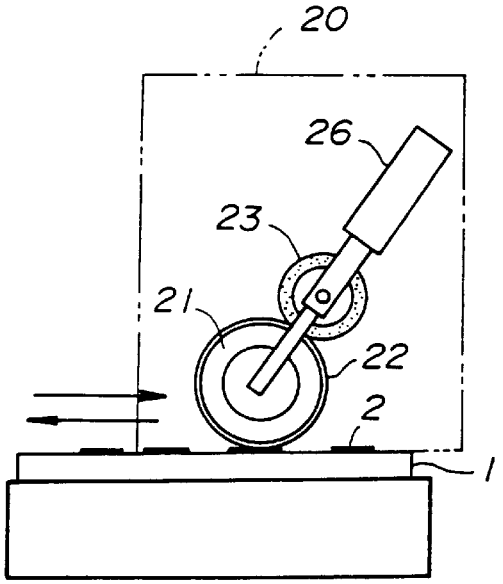
FIG. 6 is an illustration of an example in which ink is fixed by a manually operated roller.
Figure 7:
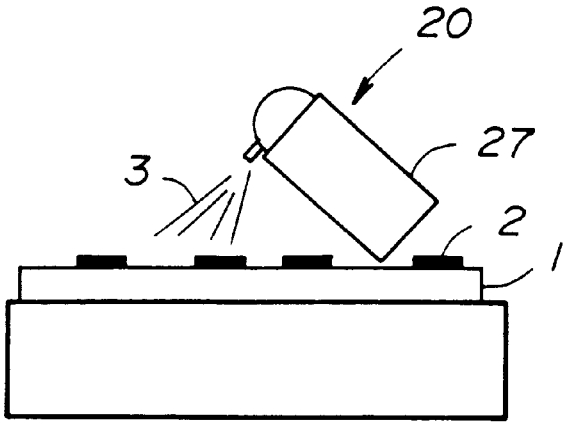
FIG. 7 is an illustration of an example in which ink is fixed by spraying an ink curing liquid.

FIG. 1 shows an example in which the thin ink layer 2 is formed on the substrate 1 and then the ink curing liquid 3 is dropped onto the ink layer 2 by the pipet 4 so that the ink curing liquid 3 contacts the ink layer 2. FIGS. 2 to 4 show examples using the rubber roller 21 as an ink fixing roller. In the example shown in FIG. 2, the ink curing liquid layer 22 is formed on a surface of the rubber roller 21 by contact with the porous member 23 which is impregnated with the curing liquid so that the ink curing liquid is directly applied contact a surface of the recording paper. In the ample shown in FIG. 3, the ink curing liquid layer 22 formed on a surface of the rubber roller 21 by the ink curing liquid impregnated member formed as a roller 23. In the example shown in FIG. 4, a roller formed by the ink curing liquid member 23 is used instead of the rubber roller 21. In the example shown in FIG. 5, the ink curing liquid stored in the ink curing liquid storing vessel 24 is supplied to the rubber roller 21 so as to form the ink curing liquid layer 22 on the rubber roller 21. FIGS. 6 and 7 show examples in which the ink 2 printed on the post card 1 is fixed by a manually operated mechanism. In the example shown in FIG. 6, the manually operated mechanism 20 is rolled on the post card 1 to supply the ink curing liquid impregnated in the roller 23 so that the ink 2 on the post card 1 is fixed by the ink curing liquid layer 22 formed on a surface of the rubber roller 21. The manually operated mechanism 20 is operated by holding the grip 26 and rolling the roller 21 while the roller 21 is pressed against the post card 1. In the example shown in FIG. 7, the ink curing liquid 3 is sprayed by the spray 27 device so that the ink 2 on the post card 1 is fixed.

Preferably, an oil base ink is used in this embodiment such as a commercially available typographic ink, an offset ink, a waterless offset ink or a stencil ink. Other inks such as ink containing an unsaturated fatty acid, which is needed for oxidative polymerization drying, or other conventional ink curing agents. An ink which does not contain such an ink curing agent may also be used. The vehicle of the ink 2 contains at least a resin and a solvent which dissolves the resin. As examples of the resin, a natural resin such as rosin, shellac or gilsonite and a natural resin derivative such as rosin ester, maleic resin or fumaric resin may be used. Additionally, as a synthetic resin, a phenol resin such as a rosin denaturated phenol, an alkyd resin (fatty acid denaturated polyester resin), a petroleum resin such as an aromatic or aliphatic hydrocarbon resin, an acrylic resin, a polyester resin, a polyamide resin, a cyclized rubber, a chlorinated rubber, a urea resin and a melamine resin, a ketone resin, a polyvinyl chloride, a vinyl chloride-polyvinyl acetate copolymer resin, an epoxy resin, a polyurethane resin an a nitrocellulose may be used.

A ratio of a weight of the resin to a weight of the vehicle is preferably 5%–90%. Viscosity of the ink can range from 5 cp to $10^6$ cp. However, considering a curing time of the ink, a high-viscosity ink is preferred.

In order to shorten the fixing time of the ink, when a resin and an ink solvent are mixed, it is preferred that the resin is swollen by absorbing the ink solvent, or the resin and the ink solvent are miscibly or compatibly dissolved substantially in a state where the resin is dispersed in the ink solvent rather than a state where the resin is completely dissolved in the ink solvent. The miscible or compatible state of the resin and the ink solvent varies by the combination of the resin and the ink solvent and their volumetric percentages. An appropriate composition of the ink may be determined by considering which printing method is to be used, the recording paper to be used, a necessary fixing time and other various conditions.

Additionally, with respect to the ink solvent, a liquid which is a component of the vehicle and which dissolves the resin in the vehicle is used. Generally, an oil or a petroleum solvent is used. However, the oil or the solvent is dependent on the type of ink to be used.

The inventors of the present invention found that separation of the resin in the vehicle from the ink solvent is remarkably promoted when the ink curing liquid contacts or is otherwise applied to the ink, and a fixing time of the ink is as short as from a few tens of milliseconds to five minutes.

Additionally, when the ink curing liquid is put in contact with a colored or transparent vehicle, the resin and the ink solvent in the vehicle are immediately separated from each other, and the resin is formed as a film. This phenomenon appears in a state where the resin is completely or almost completely dissolved in the ink solvent as well as in a state where the resin is swollen by the ink solvent or the resin and the ink solvent are dissolved with each other substantially in a state where the resin is dispersed in the ink solvent. Thus the present invention provides a completely different and novel ink fixing method as compared to a conventional ink fixing method.

It should be noted that as the ink curing liquid, a liquid is used which is miscible or compatible with the ink solvent and has a molecular weight sufficiently greater than a molecular weight of the ink solvent. The molecular weight of the ink curing liquid is preferably ten times or greater than that of the molecular weight of the ink solvent. For example, an oil such as mineral oil or engine oil or a grease may be used as the ink curing liquid. The miscibility or compatibility of the ink curing liquid with the resin is preferably zero or close to zero. However, if the time needed for separation of the resin from the ink solvent is sufficiently shorter than the time needed for dissolving the resin in the ink solvent, the ink curing liquid may be slightly miscible with the resin.

As a method for supplying the ink curing liquid, the ink curing liquid may directly contact a surface of the recording paper as shown in FIG. 1, or the ink curing liquid may directly contact the surface of the recording paper by using a sponge, rubber cloth or paper which is impregnated with the ink curing liquid as shown in FIG. 4. Additionally, the ink curing liquid may be supplied by multiple stage rollers a shown in FIG. 5. Further, the ink curing liquid may be supplied by forming a layer of the ink curing liquid on a roller by contacting a porous member impregnated with the ink curing liquid to the roller as shown in FIGS. 2, 3 and 6. Additionally, the ink curing liquid may be applied in a non-contact manner by using a spray or a jet nozzle as shown in FIG. 7.

The thickness of the layer of the ink curing liquid applied to the recording paper is preferably less than 500 $\mu$m, and more preferably less than 100 $\mu$m so as to facilitate removal of the ink curing liquid. In order to eliminate a mechanism for removing the ink curing liquid, the thickness should be less than 10 $\mu$m. If a recording medium such as a recording paper which absorbs the ink curing liquid is used, the recording paper absorbs the ink curing liquid as a layer having a thickness about 10 $\mu$m. Thus, in this case, the removal of the ink curing liquid is not needed after fixation of ink.

However, in order to shorten the ink fixing time, it is better to increase the thickness of the layer of the ink curing liquid. Thus, in practice, the thickness of the layer of ink curing liquid should be determined by considering the thickness of the ink on the recording paper, the types of ink used for printing, atmospheric conditions and a time required for fixing the ink. It should be noted that the recording paper includes a pulp paper, a synthetic paper as well as an OHP film and other materials used for printing.

(Description of Second Embodiment)

Figure 8:
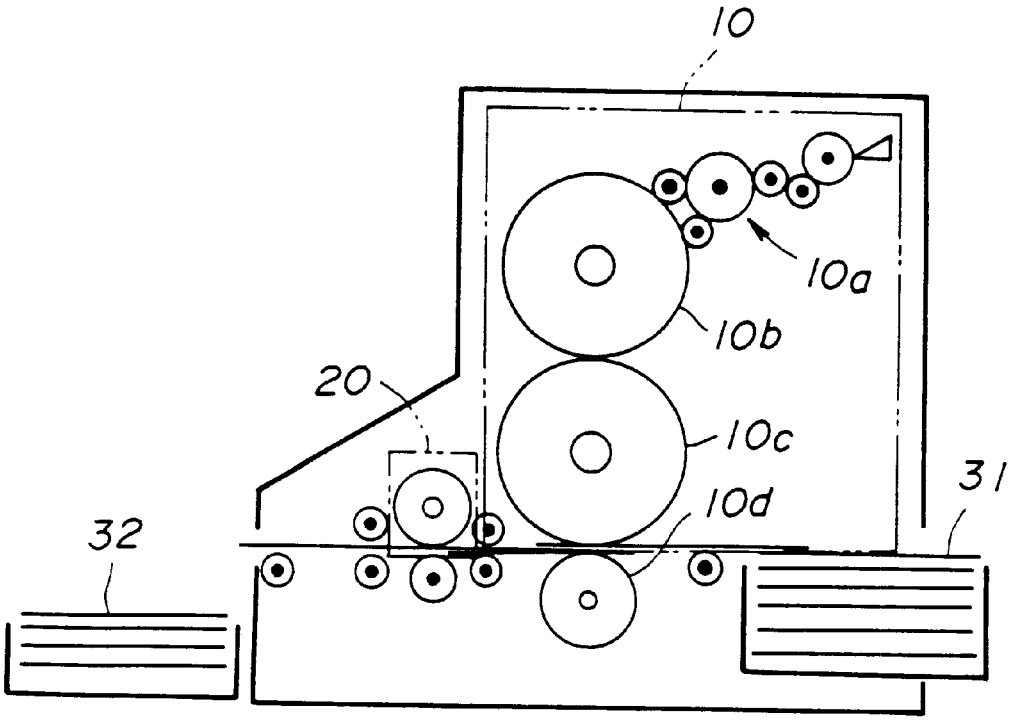
FIG. 8 is an illustration of an example related to an apparatus for forming an image by a single color.
Figure 9:
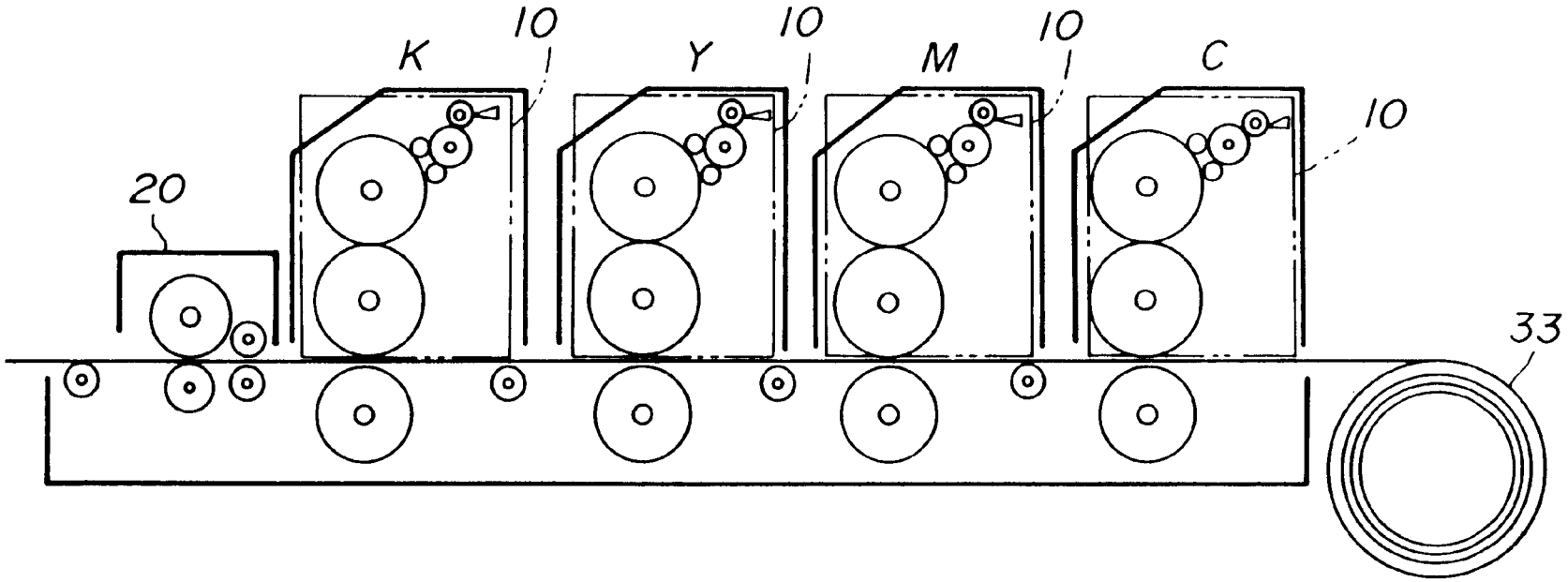
FIG. 9 is an example in which a rolled paper is used and color component image forming units are arranged straightly.
Figure 10:
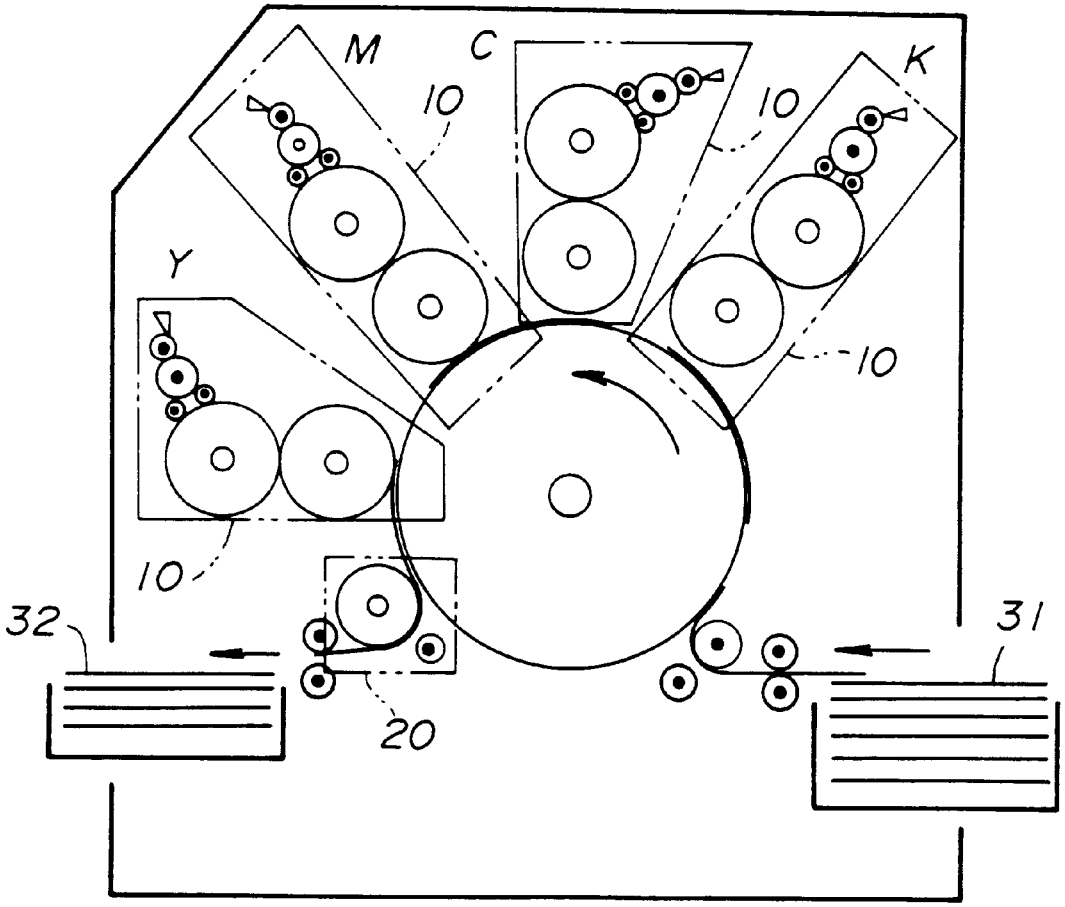
FIG. 10 is an example in which color component image forming units are arranged circumferentially around a drum.

FIGS. 8 to 10 are illustrations for explaining a second embodiment according to the present invention. The second embodiment is related to the image forming apparatus having the ink fixing mechanism 20 using the ink fixing method described with reference to the fist to seventh embodiments. In the figures, a reference numeral 10 indicates a transfer unit; 20 indicates an ink fixing unit; 31 indicates a recording paper; and 32 indicates a recording paper after fixing the print. In the transfer unit 10, 10*a* indicates inking rollers; 10*b* indicates a plate drum; 10*c* indicates a blanket drum; and 10*d* indicates a press roller. Shown in FIG. 8 is an example related to an apparatus for forming an image by a single color. Shown in FIG. 9 is an example in which a rolled paper 33 is used and color component image forming units (C, M, Y, K) are arranged in a line. FIG. 10 shows an example in which color component image forming units (K, C, M, Y) are arranged circumferentially around a drum. It should be noted that a method for forming an image can be a plate printing method such as a flat plate printing method, a letterpress printing method or a stencil printing method. A direct printing method may also be used. Additionally, a noncontact type printing method such as an ink jet method or an electrophotographic method and contact type printing method may also be used. Preferably, the ink to be used is an oil base ink.

Regarding the ink fixing method, an appropriate method should be selected by considering physical properties of the recording paper and ink to be used, thickness of the ink layer formed on the recording paper, the types of ink, environmental conditions and a required ink fixing time. A time period to convey the recording paper from the ink fixing unit to an ejecting unit must be longer than a time period needed for fixing the ink. Accordingly, the conveying path from the fixing unit to the ejecting unit is determined based on printing speed and the time period needed for fixing the ink. It should be noted that convey rollers, which are used in the conveying path from the fixing unit to the ejecting unit and which contact a printed surface, are preferably formed by a material onto which the ink does not adhere. For example, a roller provided with a silicone resin having a good mold releasability on the surface thereof is preferred.

(Description of Third Embodiment)

In this embodiment, the fixation of ink is performed by contacting or applying a flowable silicone resin as the ink curing liquid used in the first or second embodiment. Since the flowable silicone is odorless and less harmful to human body as compared to the ink curing liquid used in the first or second embodiment, it is superior with respect to environmental sanitary. Additionally, there is little adverse effect to the printed surface as it is colorless. Further, since a sliding characteristic against the printed surface is improved, a flaw due to scratching is hardly generated on the printed surface. Thus, the flowable silicone has many advantages.

With respect to the flowable silicon, a silicone oil or a silicone gum may be used. The silicone oil includes, other than a dimethyl silicone oil, methyl phenyl silicone oil and methyl hydrogen silicone oil, a denaturated silicone oil in which various organic bases are introduced into a part of a methyl base of a dimethyl silicon. For example, the denaturated silicone oil includes, for example, amino denaturated, alkyl denaturated, alcohol denaturated, epoxy denaturated, epoxy denaturated, epoxy-polyether denaturated, carboxyl denaturated or polyether denaturated species or other various denaturated species. The silicone gum is an extremely high-viscosity silicone oil, and includes a silicone oil which has both a liquid-like viscosity and a solid-like elasticity.

The structure and supply method is similar to that of the first and second embodiments as shown in FIGS. 1 to 10. With respect to the silicone gum, since the silicone gum hardly penetrate a porous member, the silicone gum may contact a surface of the recording paper in a flat form or manner and thereafter is peeled off as shown in FIG. 1, or the silicone gum is rolled on the recording paper by forming the silicone gum in a spherical shape or a rod-like shape, or the silicone gum is applied or placed in contact with the surface of the recording paper by providing the silicone gum on a periphery of a roller. The size and thickness of the silicone gum to be applied is not limited, but, the fixing time of ink tends to be reduced if a diameter or a thickness is more than 100 $\mu$m.

(Description of Fourth Embodiment)

Figure 11:
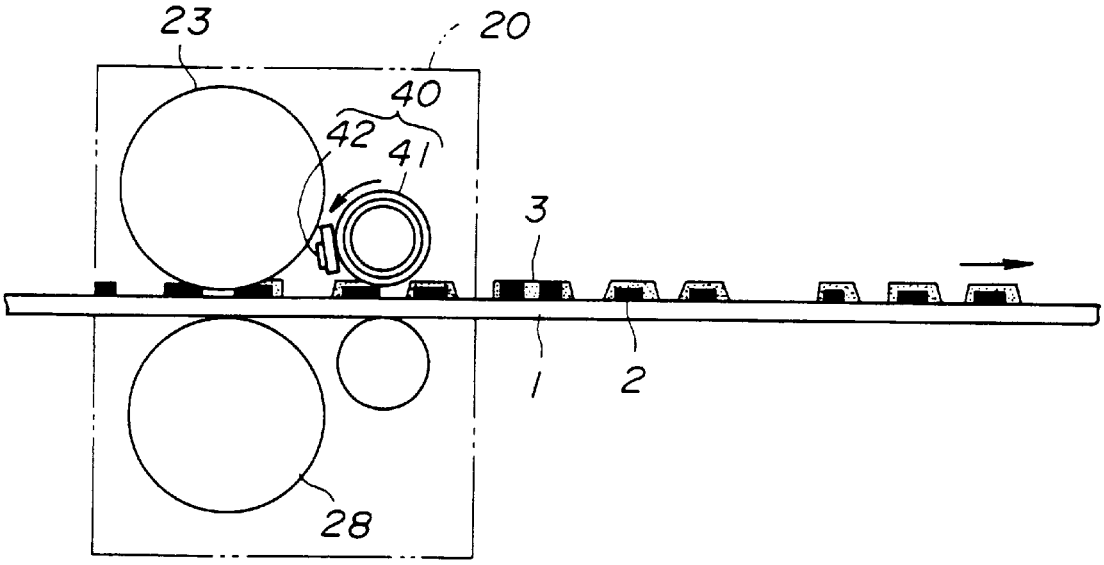
FIG. 11 is an illustration of a part of a fourth embodiment according to the present invention.

FIG. 11 is an illustration of a part of a fourth embodiment according to the present invention. In this embodiment, ink fixation is performed while the ink 2 transferred to the recording paper 2 or an area where the ink 2 contacts the ink curing liquid 3 is cooled by a cooling unit 40 before the ink curing liquid is applied or put in contact with the ink transferred surface of the recording paper, or during a process for contacting or applying the ink curing liquid, or after the ink liquid is contacted or applied. If the temperature is decreased when a resin and an ink solvent in a vehicle are dissolved, separation of the ink solvent from the resin is promoted. A temperature range where this phenomenon appears differs from combinations of a resin and an ink solvent. Thus, it is preferable to use ink comprising a combination of a resin and an ink solvent which requires relatively less energy for cooling and which are not separated from each other during storage or printing. Accordingly, a time period needed for fixing ink can be reduced by using such ink and cooling the ink on the recording medium in a fixing process or the area where the ink curing liquid contacts the ink as compared to a case where the ink curing liquid merely contacts or is applied to the ink. With respect to a method for cooling, a cooled air may be supplied. Additionally, a roller may be provided which has a surface provided with a silicone resin (an ink repellent member) which does not adhere to the ink, and which has the surface or an interior cooled by a Peltier element 42, a coolant or cooled air. Thus, a conventional cooling method can be used.

(Description of Fifth Embodiment)

Figure 12:
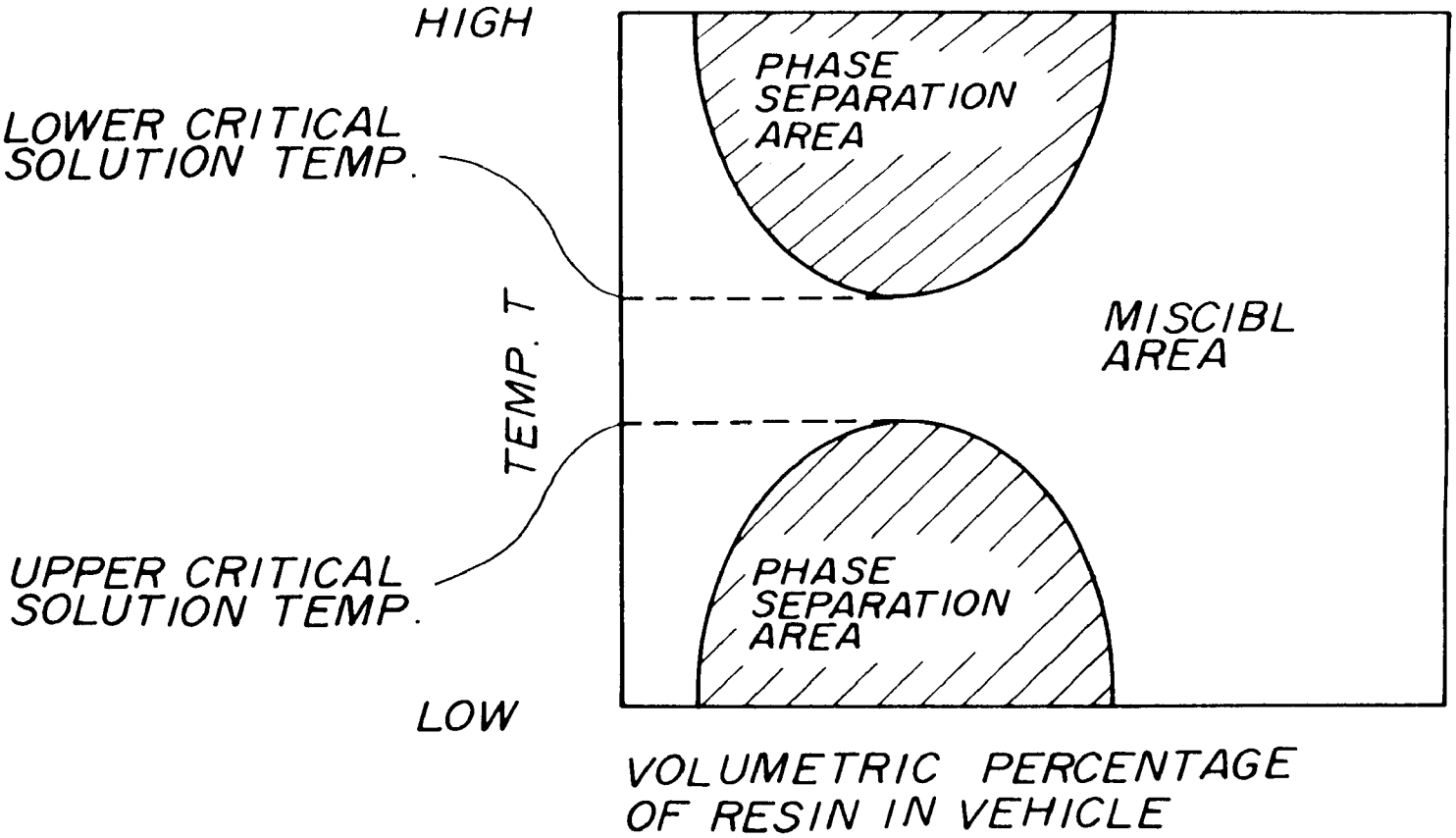
FIG. 12 is an illustration for explaining a fifth embodiment according to the present invention.

FIG. 12 is an illustration for explaining a fifth embodiment according to the present invention. This embodiment is related to the cooling method of the fourth embodiment. In this embodiment, fixation of ink is performed by decreasing the cooling temperature below an upper critical solution temperature which is determined by the resin and the ink solvent. There is a temperature at which the ink solvent is separated from the resin depending on a combination of a resin and an ink solvent as shown in FIG. 12. This temperature is referred to as an upper critical solution temperature. Accordingly, when ink having an appropriate upper critical solution temperature is used, a fixing time can be extremely reduced by cooling during the fixing process as compared to a case where the ink curing liquid is merely applied to contact the ink.

(Description of Sixth Embodiment)

Figure 13:
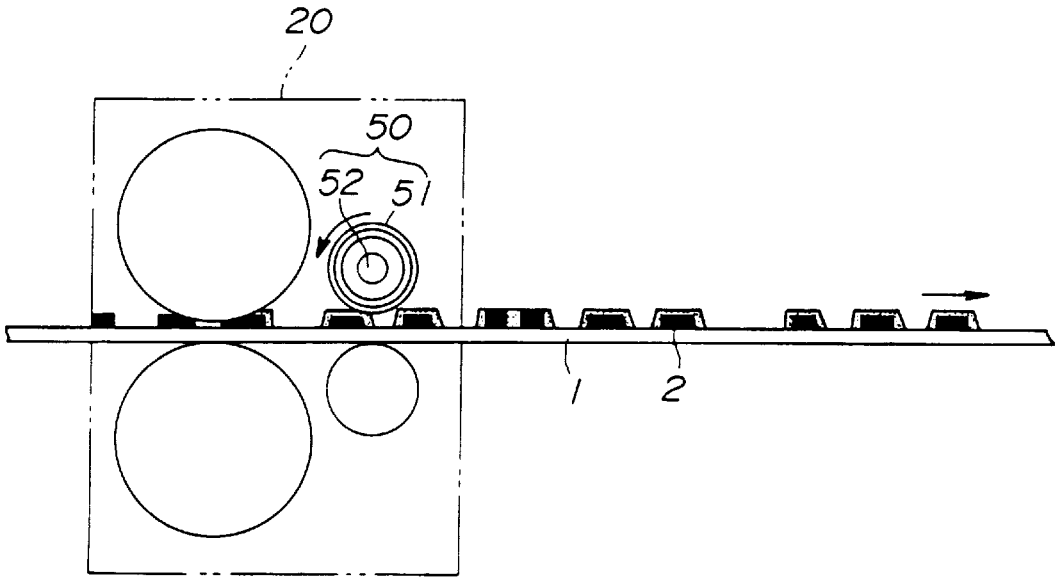
FIG. 13 is an illustration of a sixth embodiment of the present information in which an ink curing liquid is heated by being contacted by a heated roller.
Figure 14:
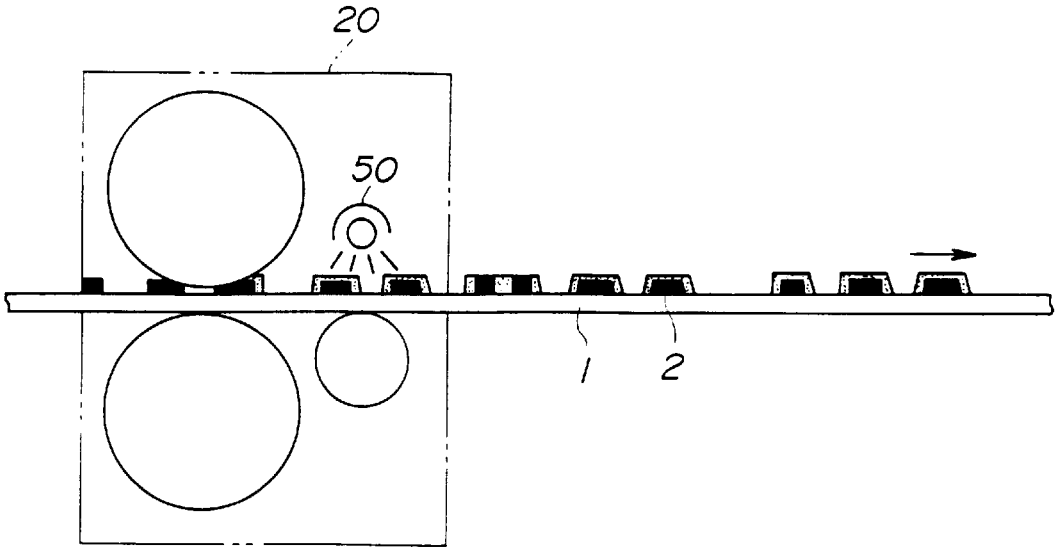
FIG. 14 is an illustration of a sixth embodiment in which the ink curing liquid is heated by a noncontact heating manner.

FIGS. 13 and 14 are illustrations for explaining a sixth embodiment according to the present invention. In this embodiment, ink fixation is performed while the ink 2 transferred to the recording paper 1 or an area where the ink 2 contacts the ink curing liquid 3 is heated by a heating unit 50 before the ink curing liquid is contacted or applied to the ink transferred surface of the recording paper, or during a process for contacting or applying the ink curing liquid, or after the ink curing liquid is contacted or applied. Shown in FIG. 13 is an example in which the ink curing liquid is heated by contact a roller which has a surface or an interior heated by a heater 52 and which is provided with an ink repellent member 51 thereon. Shown in FIG. 14 is an example in which a printed surface is heated in a noncontact heating manner by a heat source.

If the temperature is increased when a resin and an ink solvent in a vehicle are dissolved, separation of the ink solvent from the resin is promoted. A temperature range where this phenomenon appears differs in various combinations of a resin and an ink solvent. Thus, it is preferable to use ink comprising a combination of a resin and an ink solvent which requires relatively less energy for heating and which do not separate from each other during storage or printing.

Accordingly, a time period needed for fixing ink can be reduced by using such ink and heating the ink on the recording medium in a fixing process or the area where the ink curing liquid contacts the ink as compared to a case where the ink curing liquid merely contacts the ink. With respect to a method for heating, as shown in FIG. 13, a roller 50 may be provided which has a surface provided with a silicone resin 51 which does not adhere to the ink, and which has the surface or an interior heated by a heater or a lamp 42 emitting heat. Additionally, heat may be applied by providing heated air or heat to the printed surface by a heat source 50 shown in FIG. 14 in a noncontact manner. Thus, a conventional heating method can be used.

(Description of Seventh Embodiment)

This embodiment is related to the heating method of the sixth embodiment. In this embodiment, ink fixation is performed by increasing the heating temperature above a lower critical solution temperature which is determined by the resin and the ink solvent. There is a temperature at which the ink solvent is separated from the resin depending on various combinations of a resin and an ink solvent as shown in FIG. 12. This temperature is referred to as a lower critical solution temperature. Accordingly, when ink having an appropriate lower critical solution temperature is used, a fixing time can be extremely reduced by heating during the fixing process as compared to a case where the ink curing liquid merely contacts the ink.

(Description of Eighth Embodiment)

Figure 15:
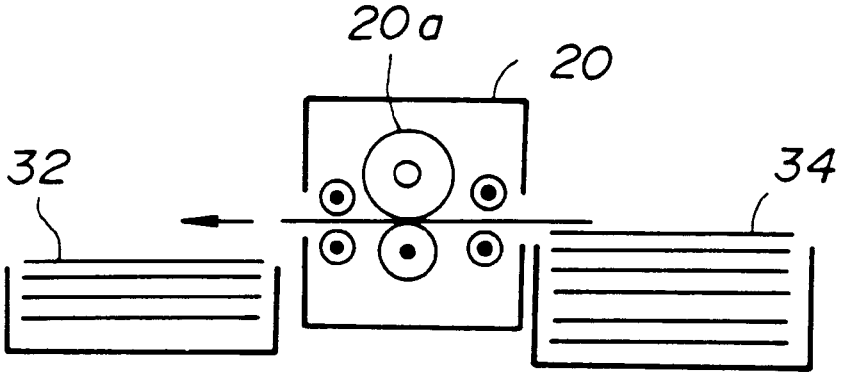
FIG. 15 is an illustration of an example in which a roller-like member is used for an ink curing liquid supplying unit.
Figure 16:
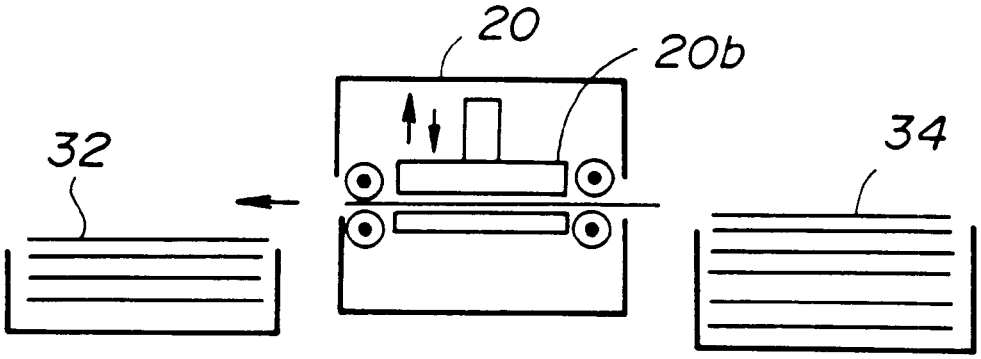
FIG. 16 is an illustration of an example in which a flat member is used for the ink curing liquid supplying unit.

FIGS. 15 and 16 are illustrations for explaining an eighth embodiment according to the present invention. This embodiment is related to an ink fixing unit using the ink fixing method of the first to seventh embodiments. In the figures, 34 indicates printed matter before fixation; and 32 indicates printed matter after fixation. Shown in FIG. 15 is an example in which a roller-like member 20*a* is used for an ink curing liquid supplying unit. Shown in FIG. 16 is an example in which a flat member 20*b* is used for the ink curing liquid supplying unit.

A description will be given below of an outline of the basic function of the ink fixing units mentioned above.

The printed matter 34 on which a non-fixed ink image is formed by an image forming unit is set to a non-fixed recording paper inserting portion of the ink fixing unit, and a start switch for fixation of ink is turned on. Then, the recording paper is conveyed to the fixing section in which the ink on the recording paper is fixed by an appropriate method used in the embodiments 1 to 7. Thereafter, the fixed recording paper is ejected to an ejecting unit.

It should be noted that a method for forming an image can be an offset printing method such as a flat plate printing method, a letterpress printing method or a stencil printing method. A direct printing method may also be used. Additionally, a noncontact type printing method such as an ink jet method or an electrophotographic method and contact type printing method may also be used. Preferably, the ink to be used is an oil base ink.

Regarding the ink fixing method, an appropriate method should be selected from among the methods of the first through the seventh embodiments by considering physical properties of the recording paper and ink to be used, thickness of the ink layer formed on the recording paper, the number of types of ink, environmental conditions and a required ink fixing time.

A time period for conveying the recording paper from the ink fixing unit to the ejecting unit must be longer than a time period needed for fixing the ink. Accordingly, the conveying path from the fixing unit to the ejecting unit is determined based on printing speed and the time period needed for fixing the ink. It should be noted that conveying rollers, which are used in the conveying path from the fixing unit to the ejecting unit and which contact a printed surface, are preferably formed by a material to which the ink does not adhere. For example, a roller provided with a silicone resin having a good mold releasability on the surface thereof is preferred.

(Description of Ninth Embodiment)

Figure 17:
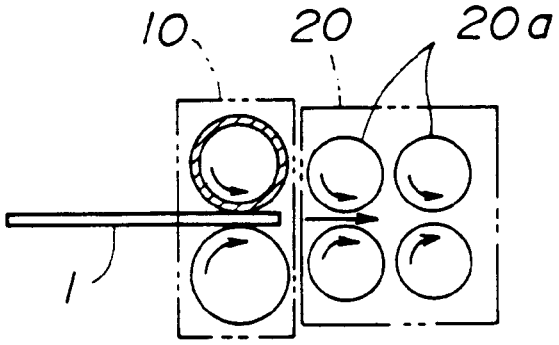
FIG. 17 is an illustration of an example of an image forming unit having a plurality of ink fixing rollers to perform a plurality of fixing operations after a single color printing is performed by a transfer unit.
Figure 18:
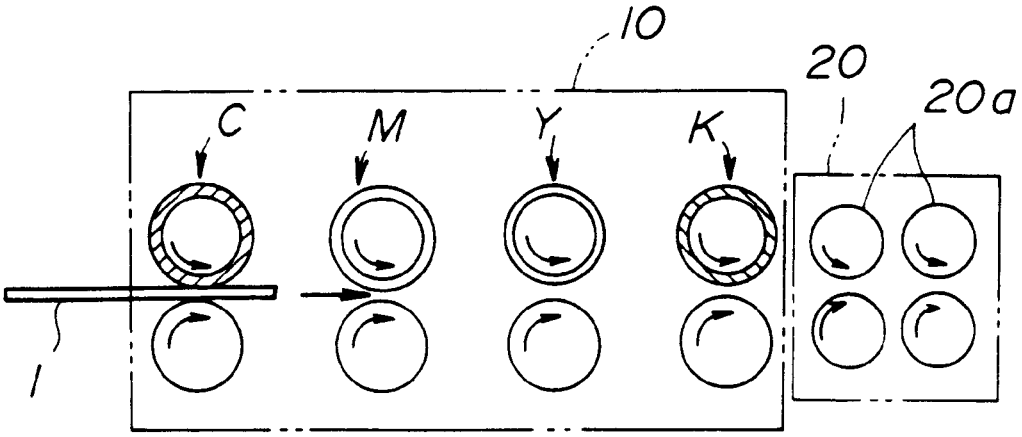
FIG. 18 is an illustration of an example the image forming unit in which a plurality of fixing operations are performed after multi-color printing is performed.
Figure 19:
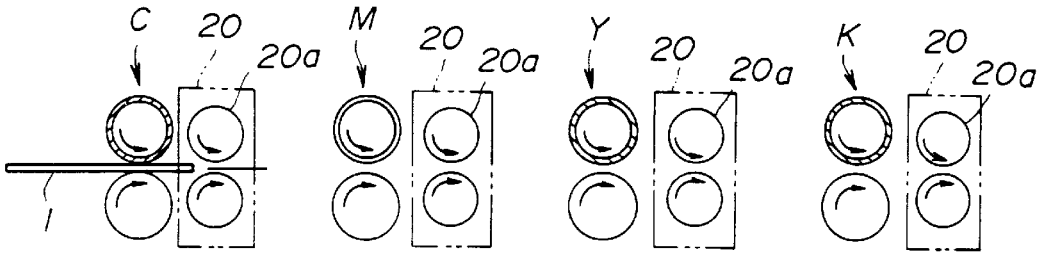
FIG. 19 is an illustration of an example of the image forming unit in which an ink fixing operation is performed for each color component printing.
Figure 20:
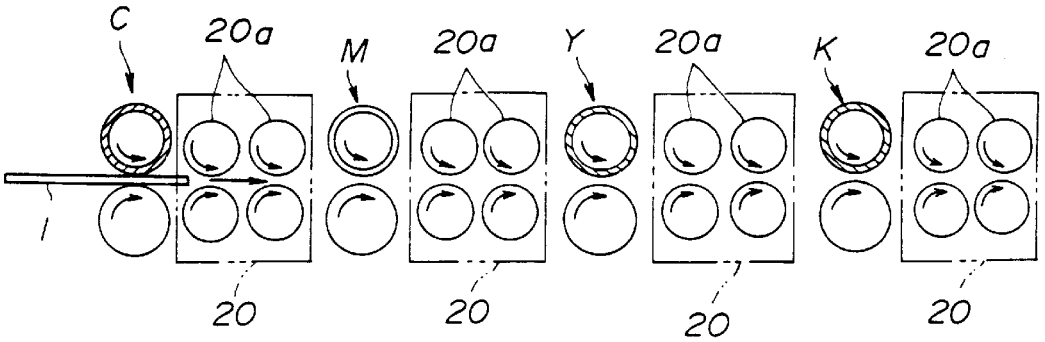
FIG. 20 is an illustration of an example of the image forming unit in which a plurality of ink fixing operations are performed for each color component printing when a multi-color printing is performed.
Figure 21:
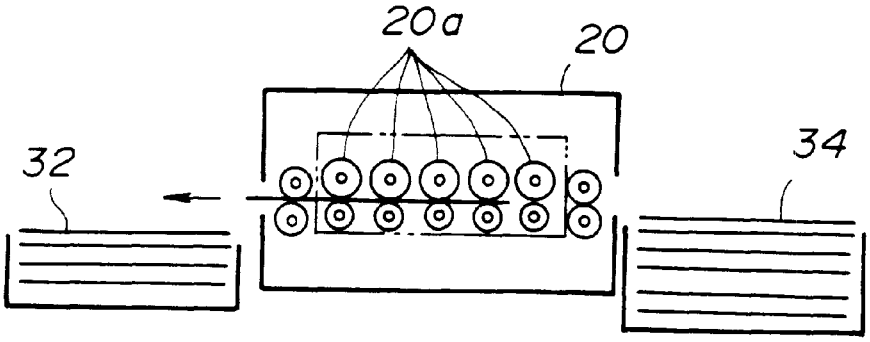
FIG. 21 is an example of the ink fixing unit in which a plurality of ink fixing operations are performed.

FIGS. 17 to 21 are illustrations for explaining a ninth embodiment according to the present invention. In this embodiment, ink fixation is performed by contacting or applying the ink curing liquid to the surface of the recording paper a plurality of times in the image forming unit or the ink fixing units used in the second to eighth embodiments. Shown in FIG. 17 is an example of the image forming unit having a plurality of ink fixing rollers 20*a* to perform a plurality of fixing operations after a single color printing is performed by the transfer unit 10. Shown in FIG. 18 is an example of the image forming unit in which a plurality of fixing operations are performed after multi-color printing is performed. Shown in FIG. 19 is an example of the image forming unit in which an ink fixing operation is performed for each printed color component, and thus a plurality of fixing operations are performed as a whole. Shown in FIG. 20 is an example of the image forming unit in which a plurality of ink fixing operations are performed for each printed color component when a multi-color printing is performed. Shown in FIG. 21 is an example of the ink fixing unit in which a plurality of ink fixing operations are performed.

The ink fixing method used for each of the plurality of ink fixing units can be the same as that used in the second to eighth embodiments, but may differ from unit to unit. The number of fixing units should be determined by considering physical properties of the recoding paper and ink to be used, thickness of the ink layer on the recording paper, environmental conditions and a required ink fixing time.

With respect to the ink fixing method, in a case of a single color printing unit as shown in FIG. 17, the ink fixing operation is performed a plurality of times after printing on the recording paper. In a case of a multi-color printing unit as shown in FIG. 18, the ink fixing operation may be performed a plurality of times after all color components are printed. Additionally, as shown in FIGS. 19 and 20, the ink fixing operation may be performed for printing each color component. Further, although not shown in the figures, the ink fixing operation may be performed for printing each color with a plurality of fixing operations performed after printing of all color component are completed.

Although an ink fixing time is reduced as the number of the ink fixing units is increased, size of the unit is also increased. Thus, it is better to determine the number of the ink fixing units based on the required ink fixing time and a required configuration of the apparatus.

(Description of Tenth Embodiment)

Figure 22:
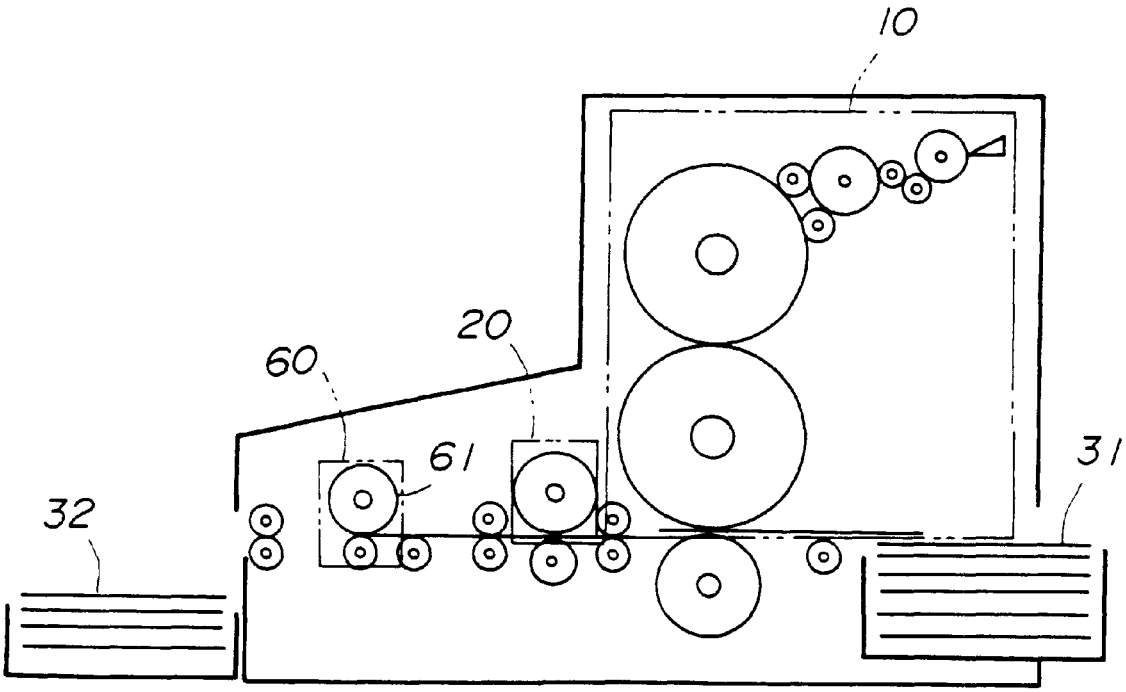
FIG. 22 is an illustration of an example in which a porous roller is used as means for removing the ink curing liquid from a recording paper.
Figure 23:
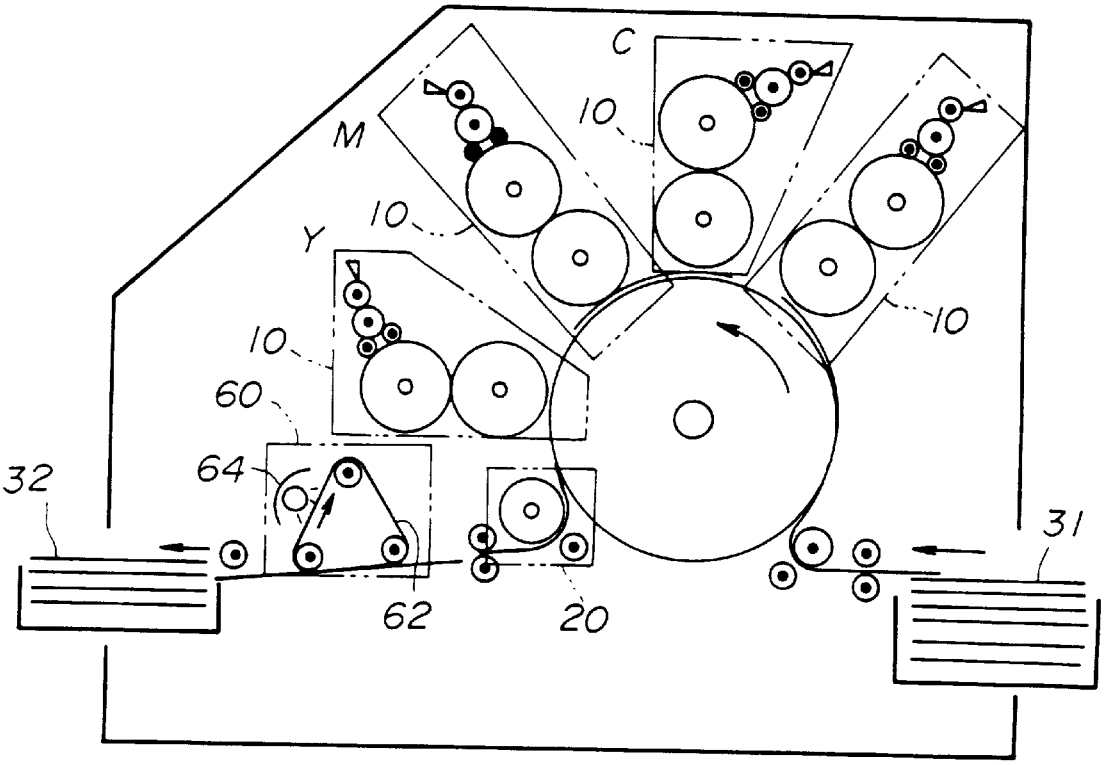
FIG. 23 is an illustration of an example in which an absorbing endless member is used.
Figure 24:
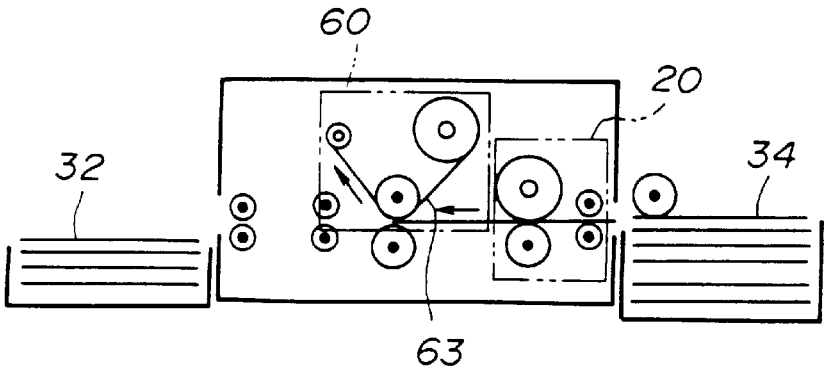
FIG. 24 is an example in which an absorbing sheet member is used.

FIGS. 22 to 24 are illustrations for explaining a tenth embodiment according to the present invention. In this embodiment, the ink curing liquid supplied during the ink fixing process on the recording paper or the ink curing liquid adhering on the recording paper and the ink solvent separated from the resin in the vehicle is removed by an ink curing liquid removing unit 60 after the fixation of ink. Shown in FIG. 22 is an example in which a porous roller 61 is used as means for removing the ink curing liquid from the recording paper. Shown in FIG. 23 is an example in which an absorbing endless member 62 is used. Shown in FIG. 24 is an example in which an absorbing sheet member 63 is used.

With respect to the method of removing the ink curing liquid, a conventional method such as an absorption method, an evaporation method, a scratch method or a blow off method can be used. For example, a porous material such as a sponge, a rubber, a cloth or a paper can be used as a member for the absorption method. Additionally, the absorbing member may be a roller or a thin and flat material such as a cloth. If a roller-shape is used, the entire roller may be porous, or a metal roller provided with a porous layer formed thereon may be used. If the thin, flat shape is used, the entire member may be made of a porous material and a liquid absorbing layer may be formed on a surface of a film.

With respect to the member which has absorbed the ink curing liquid, the ink curing liquid in the member can be removed by evaporating by heat provided by the heating unit 64 as shown in FIG. 23 or a squeezing operation. Thus, an exchange cycle of the consumable part can be extended by repeating use.

A description will now be given of several tests according to the above mentioned embodiments.

The following Table 1 shows examples of the ink which were used in tests according to the above-mentioned embodiment. It should be noted that a registered trade mark referred to in this specification is provided with a suffix "R".

TABLE 1

| | |
|---|---|
| | 1) Waterless Offset Ink |
| 1-1) | Aqualess Super ® KB, black, blue, red, yellow M (Toyo Ink Mfg Co., Ltd.) |
| 1-2) | Aqualess V ® K2, black, blue, red, yellow M (Toyo Ink Mfg Co., Ltd.) |
| 1-3) | Aqualess Super ® FC, black, blue, red, yellow Y XU (Toyo Ink Mfg Co., Ltd.) |
| 1-4) | New ALPO ® G, black, blue, red, yellow, M (T & K Toka Co., Ltd) |
| 1-5) | Waterless S PL, black S (The Inktec Inc.) |
| 1-6) | Waterless S GT, black N (The Inktec Inc.) |
| | 2) Offset Ink |
| 2-1) | F Gloss 85, black (Dainippon Ink & Chemicals Inc.) |
| 2-2) | Master Black (Nikken Chemical Laboratories) |
| | 3) Typographic Ink |
| 3-1) | Typographic Ink Graf-G, black (Dainippon Ink & Chemicals Inc.) |
| | 4) Screen Ink |
| 4-1) | Print Gocco ® Ink (Riso Ink (cyan)) (Riso Kagaku Corp.) |
| 4-2) | Print Gocco ® Ink (Riso HM Ink (black)) (Riso Kagaku Corp.) |
| | 5) Other Oil Ink |
| 5-1) | Rosin modified phenol resin + #0-Solvent(H) + Tridecanol + Carbon black |
| 5-2) | Rosin modified phenol resin + #AF7-Solvent + Carbon black |
| 5-3) | Rosin modified phenol resin + #AF5-Solvent + Carbon black |
| 5-4) | Rosin modified phenol resin + Dialen 168 ® + Carbon black |
| 5-5) | Rosin modified phenol resin + Alkyl Benzen 253 + Carbon black |

The following Table 2 shows examples of the vehicle which were used in tests according to the above-menitoned embodiments.

TABLE 2

| No | Resin | Solvent | Ratio |
|---|---|---|---|
| 1) | Rosin modified phenol resin + (KG1829, Arakawa Chemical Industries Ltd.) | #0-Solvent(H) | 2/3 |

TABLE 2-continued

| No | Resin | Solvent | Ratio |
|---|---|---|---|
| 2) | Rosin modified phenol resin + (KG1829, Arakawa Chemical Industries Ltd.) | #AF7-Solvent | 2/3 |
| 3) | Rosin modified phenol resin + (KG1829, Arakawa Chemical Industries Ltd.) | #AF5-Solvent | 1/1, 2/3, 3/7 |
| 4) | Rosin modified phenol resin + (KG1829, Arakawa Chemical Industries Ltd.) | Dialen 168 ® | 2/3 |
| 5) | Rosin modified phenol resin + (KG1829, Arakawa Chemical Industries Ltd.) | Alkyl Benzen 253 | 2/3 |
| 6) | Rosin ester resin + (KE100 Arakawa Chemical Industries Ltd.) | #0-Solvent(H) | 1/1 |
| 7) | Rosin ester resin + (KE100 Arakawa Chemical Industries Ltd.) | Dialen 168 ® | 1/1 |
| 8) | Rosin ester resin + (KE100 Arakawa Chemical Industries Ltd.) | Alkyl Benzen 253 | 1/1 |
| 9) | Petroleum resin + (C5-type resin, Quintone ® A100, Nippon Zeon Co., Ltd.) | #0-Solvent(H) | 1/1 |
| 1O) | Petroleum resin + (C5-type resin, Quintone ® A100, Nippon Zeon Co., Ltd.) | Dialen 168 ® | 1/1 |
| 11) | Petroleum resin + (C5-type resin, Quintone ® A100, Nippon Zeon Co., Ltd.) | Alkyl Benzen 253 | 1/1 |
| 12) | DCPD resin + (C5-type resin, Quintone ® A1345, Nippon Zeon Co., Ltd.) | #0-Solvent(H) | 1/1 |
| 13) | DCPD resin + (C5-type resin, Quintone ® A1345, Nippon Zeon Co., Ltd.) | #AF5-Solvent | 1/1 |
| 14) | DCPD resin + (C5-type resin, Quintone ®, A1345, Nippon Zeon Co., Ltd.) | Dialen 168 ® | 1/1 |
| 15) | DCPD resin + (C5-type resin, Quintone ® A1345, Nippon Zeon Co., Ltd.) | Alkyl Benzen 253 | 1/1 |

The following Table 3 shows examples of the recording paper which were used in tests according to the above-mentioned embodiments.

TABLE 3

| |
|---|
| 1) Plain paper (Type 6200, Ricoh Corp.) |
| 2) Wood free paper |
| 3) Coat paper |
| 4) Art paper |
| 5) Synthetic paper (Peach Coat ®, Nisshinbo Industry Inc.) |
| 6) OHP sheet (Type PPC-DX, Ricoh Corp.) |
| 7) PET film |
| 8) Glass board |
| 9) Metal foil (Ni, SUS, Al, Cu) |

Test No.1

Printing Plate Structure:

recording layer: Perfluoro-alkylaclyrate polymer LS317, emulsion copolymerization type, (Asahi Glass Co., Ltd.), thickness: 1 $\mu$m recording member substrate: Non-grazed PET film, size: 350×220 mm, thickness: 25 $\mu$m Ink:

(1) Waterless Offset Ink 1-1) Aqualess Super$^R$ KB, black, blue, red, yellow M (Toyo Ink Mfg Co., Ltd.)

1-2) Aqualess V$^R$ K2, black, blue, red, yellow M (Toyo Ink Mfg Co., Ltd.)

1-3) Aqualess Super$^R$ FC, black, blue, red, yellow Y XU (Toyo Ink Mfg Co., Ltd.)

1-4) New ALPO$^R$ G, black, blue, red, yellow, M (T&K Toka Co., Ltd)

1-5) Waterless S PL, black S (The Inktec Inc.)

1-6) Waterless S GT, black N (The Inktec Inc.)

(2) Ink Vehicle 2-1) Polymer (Rosin modified phenol resin)+Solvent (Dialen 168$^R$:#0-Solvent(H)=4:1)

2-2) Polymer (Rosin modified phenol resin)+Solvent (#AF7-Solvent:Dialen 168$^R$=1:4)

Recording Paper:

1) Plain paper (Type 6200, Ricoh Corp.)

2) Synthetic paper (Peach Coat$^R$, Nisshinbo Industry Inc.)

3) OHP sheet (Type PPC-DX, Ricoh Corp.)

4) PET film

Flowable Silicon and Means for Supplying the Silicon:

1) Silicon Oil (KE-1031-A, Shin-Etsu Chemical Co., Ltd.)+Sponge (Rubycell$^R$, Toyo Polymer Co., Ltd.).+ Rubber Roller (60°)

2) Silicon Gel (mixture of SE1891K A and B, Dow Corning Toray Silicone Co., Ltd.)+Sponge+Rubber Roller 3) Silicon Gum (Dow Corning Toray Silicone Co., Ltd.)+ Sponge+Rubber Roller Results:

In the above-mentioned condition, ink fixing operations were performed by using the arrangement in FIG. 2. Any ink and vehicles were cured within about 15 seconds when any one of the flowable silicons were used. No setoff or blocking occurred when the printed recording papers were laid one on another. Thus, a good fixation of ink was performed.

It should be noted that the printing plate used in this test had a surface characteristic in which a receding contact angle is decreased when the printing plate is contacted with a contact member such as a liquid or a solid generating a liquid under a heated condition, and the receding contact angle is increased when there is no contact with a contact member such as a liquid or a solid generating a liquid under a heated condition.

Test No.2

Ink:

(1) Waterless Offset Ink 1-1) Aqualess Super$^R$ KB, black, blue, red, yellow M (Toyo Ink Mfg Co., Ltd.)

1-2) Aqualess V$^R$ K2, black, blue, red, yellow M (Toyo Ink Mfg Co., Ltd.)

1-3) Aqualess Super$^R$ FC, black, blue, red, yellow Y XU (Toyo Ink Mfg Co., Ltd.)

1-4) New ALPO$^R$ G, black, blue, red, yellow, M (T&K Toka Co., Ltd)

1-5) Waterless S PL, black S (The Inktec Inc.)

1-6) Waterless S GT, black N (The Inktec Inc.)

(2) Offset Ink 2-1) F Gloss 85, black (Dainippon Ink & Chemicals Inc.)

2-2) Mater black (Nikken Chemical Laboratories)

(3) Ink Vehicle 3-1) Polymer (Rosin modified phenol resin)+Solvent (Dialen 168$^R$:#0-Solvent(H)=4:1)

3-2) Polymer (Rosin modified phenol resin)+Solvent (#AF7-Solvent:Dialen 168$^R$=1:4)

Recording Paper:

1) Plain paper (Type 6200, Ricoh Corp.)

2) Synthetic paper (Peach Coat$^R$, Nisshinbo Industry Inc.)

3) OHP sheet (Type PPC-DX, Ricoh Corp.)

4) PET film

Flowable Silicon and Means for Supplying the Silicon:

1) Silicon Oil (SE200, Dow Corning Toray Silicone Co., Ltd.)+Sponge Roller (Rubycell$^R$, Toyo Polymer Co., Ltd.)+Rubber Roller (60°)

2) Silicon Gel (mixture of SE1891K A and B, Dow Corning Toray Silicone Co., Ltd.)+Sponge+Rubber Roller (60°)

3) Silicon Gum (Dow Corning Toray Silicone Co., Ltd.)+Sponge+Rubber Roller (60°)

Results:

In the above-mentioned condition, ink fixing operations were performed by using the arrangement of the printing unit and the fixing rollers in the offset printing apparatus as shown in FIG. 3. The above-listed ink was directly applied to the recording paper. Any ink other than the offset ink was cured within about 5 seconds when any one of flowable silicons were used. The offset ink was cured within 1 minute. No setoff or blocking occurred when the printed recording papers were laid one on another. Thus, a good fixation of ink was performed.

Test No.3

Ink:

Typographic Ink 3-1) Typographic Ink Graf-G, black (Dainippon Ink & Chemicals Inc.)

Recording Paper:

1) Plain paper (Type 6200, Ricoh Corp.)

2) Synthetic paper (Peach Coat$^R$, Nisshinbo Industry Inc.)

3) OHP sheet (Type PPC-DX, Ricoh Corp.)

4) PET film

Flowable Silicon and Means for Supplying the Silicon:

1) Silicon Oil (SE200, Dow Corning Toray Silicone Co., Ltd.)+Sponge Roller (Rubycell$^R$, Toyo Polymer Co., Ltd.)

2) Silicon Gel (mixture of SE1891K A and B, Dow Corning Toray Silicone Co., Ltd.)+Sponge +Rubber Roller 3) Silicon Gum (Dow Corning Toray Silicone Co., Ltd.)+Sponge+Rubber Roller Results:

In the above-mentioned condition, ink fixing operations were performed by using the arrangement of the printing unit and the fixing rollers in the typographic printing apparatus as shown in FIG. 4. The above-listed ink was directly applied to the recording paper. The ink was cured within 1 minute when any one of the flowable silicons were used. No setoff or blocking occurred when the printed recording papers were laid one on another. Thus, a good fixation of ink was performed.

Test No.4

Ink Vehicle:

1) Polymer (Rosin modified phenol resin)+Solvent (Dialen 168$^R$:#0-Solvent(H)=4:1)

2) Polymer (Rosin modified phenol resin)+Solvent (#AF7-Solvent:Dialen 168$^R$=1:4)

Recording Paper:

1) Plain paper (Type 6200, Ricoh Corp.)

2) Synthetic paper (Peach Coat$^R$, Nisshinbo Industry Inc.)

3) OHP sheet (Type PPC-DX, Ricoh Corp.)

4) PET film

Flowable Silicon and Means for Supplying the Silicon:

1) Silicon Oil (KE-1031-A, Shin-Etsu Chemical Co., Ltd.)+Rubber Roller (60 degrees)

Figure 5:
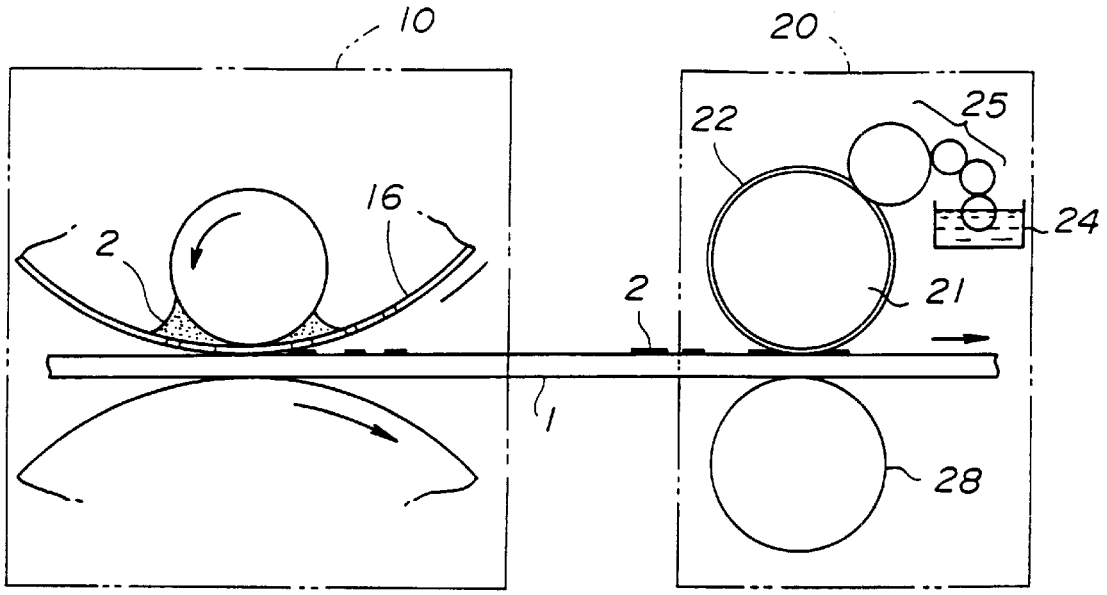
FIG. 5 is an illustration of an example in which a ink curing liquid is stored in and supplied from a vessel.

2) Silicon Gel (mixture of SE1891K A and B, Dow Corning Toray Silicone Co., Ltd.)+Rubber Roller 3) Silicon Gum (Dow Corning Toray Silicone Co., Ltd.)+Rubber Roller Results:

In the above-mentioned condition, ink fixing operations were performed by using the arrangement of the printing unit and the fixing rollers in the stencil printing apparatus as shown in FIG. 5. Ink containing the above-listed vehicles as a component was directly applied to the recording paper. The ink containing the above-listed vehicle was cured within about 5 seconds when any one of the flowable silicons were used. No setoff or blocking occurred when recording papers were laid one on another. Thus, a good fixation of ink was performed.

Test No.5

Ink:

4-1) Print Gocco$^R$ Ink (Riso Ink (cyan)) (Riso Kagaku Corp.)

4-2) Print Gocco$^R$ Ink (Riso HM Ink (black)) (Riso Kagaku Corp.)

Recording Paper:

Postcard

Flowable Silicon and Means for Supplying the Silicon:

1) Silicon Oil (KE-1031-A, Shin-Etsu Chemical Co., Ltd.)+Sponge Roller (Rubycell$^R$, Toyo Polymer Co., Ltd.)+Rubber Roller (60°)

2) Silicon Gel (mixture of SE1891K A and B, Dow Corning Toray Silicone Co., Ltd.)+Sponge Roller+Rubber Roller 3) Silicon Gum (Dow Corning Toray Silicone Co., Ltd.)+Sponge Roller+Rubber Roller Results:

In the above-mentioned condition, ink fixing operations were performed by using the Print Gocco$^R$ and the roller as shown in FIG. 6. The above-listed ink was directly applied to the recording paper. The ink was cured within about 1 minute when any one of the flowable silicons were used. No setoff occurred when the printed postcards were laid one on another. Thus, a good fixation of ink was performed.

Test No.6

Ink:

4-1) Print Gocco$^R$ Ink (Riso Ink (cyan)) (Riso Kagaku Corp.)

4-2) Print Gocco$^R$ Ink (Riso HM Ink (black)) (Riso Kagaku Corp.)

Recording Paper:

Postcard

Flowable Silicon and Means for Supplying the Silicon:

1) Silicon Oil (KE-1031-A, Shin-Etsu Chemical Co., Ltd.)+Spray

Results:

In the above-mentioned condition, ink fixing operations were performed by using the Print Gocco$^R$ and the roller as shown in FIG. 7. The above-listed ink was directly applied to the recording paper. The ink was cured within about 2 minutes when any one of the flowable silicons were used. No setoff occurred when the printed postcards were laid one on another. Thus, a good fixation of ink was performed.

Test No.7

Ink Curing Liquid:

TABLE 4

| Ink Curing Liquid | |
|---|---|
| No | Name |
| 1 | Machine Oil |
| 2 | Grease |
| 3 | Engine Oil |

Porous Member for Supplying Ink and Rubber Roller:

1) Sponge: Rubycell$^R$ (Toyo Polymer Co., Ltd.)

2) Rubber Roller:

Nitryl Rubber (hardness 60°)

Fluoro Rubber (hardness 80°)

Silicon rubber (hardness 40°)

Results:

1) A thin layer of the ink (No.1 to No.5) listed in the above Table 1 was formed on the recording paper listed in the above Table 3 as shown in FIG. 1. The thin layer of the ink was maintained for a few seconds to about 3 minutes while the thin layer of the ink was contacted to one of the ink curing liquids listed in the above Table 4. The ink was cured as indicated in the following Table 5, and a good fixation of ink was achieved which provides a good concentration, clearness and a mechanical strength to the cured ink.

TABLE 5

Ink Fixation Test Result 1

| | Ink Curing Liquid | | |
|---|---|---|---|
| Type of Ink | Machine Oil | Grease | Engine Oil |
| 1-1 | B | B | B |
| 1-2 | B | B | B |
| 1-3 | B | B | B |
| 1-4 | B | B | B |
| 1-5 | B | B | B |
| 1-6 | B | B | B |
| 2-1 | B | B | B |
| 2-2 | C-B | C-B | C-B |
| 3-1 | B | B | B |
| 4-1 | B | B | B |
| 4-2 | B | B | B |
| 5-1 | B | B | B |
| 5-2 | B | B | B |
| 5-3 | B | B | B |
| 5-4 | B | B | B |
| 5-5 | B | B | B |

It should be noted that, in the above-mentioned test result and test results provided in the following description, a letter "A" indicates that the ink remains on a recording paper after the printed surface of the recording paper is rubbed by a nonwoven fabric cloth with a strong force ten times; a letter "B" indicates that the ink on a recording paper is completely removed after the printed surface of the recording paper is rubbed by a nonwoven fabric cloth with a strong force ten times; a letter "C" indicates that the ink on a recording paper is completely removed after the printed surface of the recording paper is rubbed by a nonwoven fabric cloth with a relatively strong force ten times; and a letter "D" indicates that the ink on a recording paper is completely removed after the printed surface of the recording paper is rubbed by a nonwoven fabric cloth with a weak force ten times;

It should be noted that a good ink fixation was achieved when a thickness of the ink curing liquid is 3–8 $\mu$m. In this condition, an operator's hand was not stained with the ink curing liquid when contacting the printed surface even when a process for moving the ink curing liquid remaining on the printed surface was not performed.

In addition to the above-mentioned test, a test using the arrangement shown in FIGS. 2, 3, 6 and 7 with ink No.1, 2 or 5, a test using the arrangement shown in FIGS. 4, 6 and 7 with ink No.3 or 5, and a test using the arrangement shown in FIGS. 5, 6 and 7 with the ink No.4 or 5 was performed. The results were similar to that shown in the above-mentioned test result, that is, the ink was cured, and a good vehicle fixation was, achieved which provides a good concentration, clearness and a mechanical strength to the cured vehicle.

2) A thin layer of the vehicle listed in the above Table 2 was formed on the recording paper listed in the above Table 3 as shown in FIG. 1. The thin layer of the vehicle was maintained for a few seconds to about 3 minutes while the thin layer of the vehicle was in contact with one of the ink curing liquids listed in the above Table 4. The vehicle was cured as indicated in the following Table 6, and a good fixation of the vehicle was achieved which provides a good concentration, clearness and mechanical strength to the cured vehicle.

Additionally, tests were performed on the vehicles shown in the Table 2 by using the arrangement shown in FIGS. 2–7. The vehicles were cured as indicated in the following Table 6, and a good fixation of the vehicle was achieved which provided a good concentration, clearness and a mechanical strength to the cured vehicle.

TABLE 6

Vehicle Fixation Test Result 1

| | Ink Curing Liquid | | |
|---|---|---|---|
| Type of Vehicle | Machine Oil | Grease | Engine Oil |
| 1 | B | B | B |
| 2 | B | B | B |
| 3 | B | B | B |
| 4 | B | B | B |
| 5 | B | B | B |
| 6 | B | B | B |
| 7 | B | B | B |
| 8 | B | B | B |
| 9 | B | B | B |
| 10 | B | B | B |
| 11 | B | B | B |
| 12 | B | B | B |
| 13 | B | B | B |
| 14 | B | B | B |
| 15 | B | B | B |

Test No.8

Ink Curing Liquid:

TABLE 7

Silicon Oil

| No | Type | Cat. No. | Mfg |
|---|---|---|---|
| 1 | Dimethyl Silicon Gum | BY16-140 | DT |
| 2 | Dimethyl Silicon Oil | KF-96-CS100 to KF-96-CS1000000 | S |
| 3 | Methyl Phenyl Silicon Oil | SH710 | DT |
| 4 | Methyl Hydrogen Silicon Oil | SH1107 | DT |
| 5 | Amino Denaturated | SF8417 | DT |
| 6 | Polyether Denaturated | SF8427 | DT |
| 7 | Polyether Denaturated | SF8428 | DT |
| 8 | Polyether Denaturated | SH3746 | DT |
| 9 | Polyether Denaturated | SH3749 | DT |
| 10 | Polyether Denaturated | SH8400 | DT |
| 11 | Alkyl Denaturated | SH203 | DT |
| 12 | Alkyl Denaturated | SH230 | DT |
| 13 | Carboxyl Denaturated | SF8418 | DT |
| 14 | Epoxy Denaturated | SF8411 | DT |
| 15 | Epoxy Denaturated | BY16-839 | DT |
| 16 | Epoxy-polyether Denaturated | SF8421 | DT |

In the above Table 7, a letter "DT" represents "Dow Corning Toray Silicone Co., Ltd.", and a letter "S" represents "Shin-Etsu Chemical Co., Ltd.".

Results:

1) A thin layer of the ink (No.1 to No.5) listed in the above Table 1 was formed on the recording paper listed in the above Table 3 as shown in FIG. 1. The thin layer of the ink was maintained for a few seconds to about 3 minutes while the thin layer of the ink was contacted by one of the ink curing liquids listed in the above Table 7. The ink was cured as indicated in the following Table 8, and a good ink fixation was achieved which provided a good concentration, clearness and mechanical strength to the cured ink. Additionally, there was no color change recognized in the image due to the flowable silicon. Further, a flaw was hardly formed when the printed surface is scratched by hand, and a mechanical strength of the printed surface was improved.

TABLE 8

Ink Fixation Test Result 2

| Silicon Ink | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 1-1 | A | A | B | A | A | B | A | B | B | B | A | B | A | B | A | B |
| 1-2 | A | A | B | A | A | B | A | B | B | B | A | B | A | B | A | B |
| 1-3 | A | A | B | A | A | B | A | B | B | B | A | B | A | B | A | B |
| 1-4 | A | A | B | A | A | B | A | B | B | B | A | B | A | B | A | B |
| 1-5 | A | A | B | A | A | B | A | B | B | B | A | B | A | B | A | B |
| 1-6 | A | A | B | A | A | B | A | B | B | B | A | B | A | B | A | B |
| 2-1 | A | A | B | A | A | B | A | B | B | B | A | B | A | B | A | B |
| 2-2 | A | A | B | A | A | B | A | B | B | B | A | B | A | B | A | B |
| 3-1 | A | A | B | A | A | B | A | B | B | B | A | B | A | B | A | B |
| 4-1 | A | A | B | A | A | B | A | B | B | B | A | B | A | B | A | B |
| 4-2 | A | A | B | A | A | B | A | B | B | B | A | B | A | B | A | B |
| 5-1 | A | A | B | A | A | B | A | B | B | B | A | B | A | B | A | B |
| 5-2 | A | A | B | A | A | B | A | B | B | B | A | B | A | B | A | B |
| 5-3 | A | A | B | A | A | B | A | B | B | B | A | B | A | B | A | B |
| 5-4 | A | A | B | A | A | B | A | B | B | B | A | B | A | B | A | B |
| 5-5 | A | A | B | A | A | B | A | B | B | B | A | B | A | B | A | B |

In addition to the above-mentioned test, a test using the arrangement shown in FIGS. 2, 3, 6 and 7 with ink No.1, 2 or 5, a test using the arrangement shown in FIGS. 4, 6 and 7 with ink No.3 or 5, and a test using the arrangement shown in FIGS. 5, 6 and 7 with the ink No.4 or 5 were performed. The results were similar to that indicated in the above Table 8, that is, the ink was cured, and a good ink fixation was achieved which provided a good concentration, clearness and mechanical strength to the cured ink.

2) A thin layer of the vehicle listed in the above Table 2 was formed on the recording paper listed in the above Table 3 as shown in FIG. 1. The thin layer of the vehicle was maintained for 15 seconds to about 2 minutes while the thin layer of the vehicle was contacted by the dimethyl silicone oil listed in Table 7. The vehicle was cured as indicated in the following Tables 9 and 10, and a good fixation of the vehicle was achieved which provides a good concentration, clearness and mechanical strength to the cured vehicle.

TABLE 9

Vehicle Fixation Test Result 2-1

| Vehicle No. | degree of cure 15 sec. |
|---|---|
| 1 | A |
| 2 | B |
| 3 | C-B |
| 4 | A |
| 5 | C |

Ink Curing Liquid: Dimethyl Silicon Oil (KF-96-300CS, Shin-Etsu Chemical Co., Ltd.)

A thickness of the layer of the vehicle was about 10 $\mu$m.

TABLE 10

Vehicle Fixation Test Result 2-2
Ink Curing Liquid: Dimethyl Silicon Oil
(KF-96-300CS, Shin-Etsu Chemical Co., Ltd.)

| Vehicle No. | degree of cure 15 sec. | 3 min. |
|---|---|---|
| 6 | C | A |
| 7 | C | A |

TABLE 10-continued

Vehicle Fixation Test Result 2-2
Ink Curing Liquid: Dimethyl Silicon Oil
(KF-96-300CS, Shin-Etsu Chemical Co., Ltd.)

| Vehicle No. | degree of cure 15 sec. | 3 min. |
|---|---|---|
| 8 | C | A |
| 9 | B | A |
| 10 | B | A |
| 11 | C | A |
| 12 | A | A |
| 13 | B | A |
| 14 | A | A |
| 15 | C | A |

A thickness of the layer of the vehicle was about 5 $\mu$m.

Additionally, similar tests were performed on the vehicles listed in Table 2 by using the arrangement shown in FIGS. 2 to 7. The vehicles were also cured as indicated in Tables 9 and 10, and a good vehicle fixation was achieved which provided clearness and mechanical strength to the cured vehicle.

2) A thin layer of the vehicle (No.1 to No.15) listed in the above Table 2 was formed on the recording paper listed in the above Table 3 as shown in FIG. 1. The thin layer of the vehicle was maintained for a few seconds to about 3 minutes and cooled at 5° C. while the thin layer of the vehicle was contacted by one of the ink curing liquids listed in the Tables 4 and 7. The curing speed of the vehicle was improved, and a good fixation of the vehicle was achieved which provided clearness and mechanical strength to the cured vehicle.

Test No.9

A thin layer of the ink (No.5) listed in the above Table 1 was formed on the recording paper listed in the above Table 3 as shown in FIG. 1. The thin layer of the ink was cooled at about 5° C. by means of a refrigerator and maintained for about 5 seconds while the thin layer of the ink was contacted to a silicone gum. The curing speed of the ink was increased, and a good fixation of ink was achieved which provided a good concentration, clearness and mechanical strength to the cured ink.

Additionally, similar tests were performed with the structure shown in FIG. 11. The ink was cured in the same manner, and a good ink fixation was achieved which provided a good concentration, clearness and mechanical strength to the cured ink.

Test No.10

1) A thin layer of the ink (No.5) listed in the above Table 1 was formed on the recording paper listed in the above Table 3 as shown in FIG. 1. The thin layer of the ink was heated by means of a hot plate for about 15 seconds while the thin layer of the ink was contacted to a dimethyl silicone oil. The curing speed of the ink was increased as indicated in Table 11, and a good fixation of ink was achieved which provides a good concentration, clearness and a mechanical strength to the cured ink.

TABLE 11

Ink Fixation Test Result at Increased Temperature
Ink: No.5-1 listed in Table 1
Ink Curing Liquid: Dimethyl Silicon Oil
(KF-96-300CS, Shin-Etsu Chemical Co., Ltd.)

| temperature | degree of cure |
|---|---|
| room temp. | B |
| 40° C. | B-A |
| 50° C. | A |
| 60° C. | A |

Additionally, similar tests were performed with the structures shown in FIGS. 13 and 14. The ink was cured in the same manner, and a good ink fixation was achieved which provided a good concentration, clearness and mechanical strength to the cured ink.

2) A thin layer of the vehicle (No.1 to No.15) was formed on the recording paper listed in the above Table 3 as shown in FIG. 1. The thin layer of the vehicle was heated by means of a hot plate for about 15 seconds while the thin layer of the vehicle was contacted to a dimethyl silicone oil. The curing speed of the vehicle was increased as indicated in Table 11, and a good vehicle fixation was achieved which provided a good clearness and mechanical strength to the cured vehicle.

Additionally, similar tests were performed with the structures shown in FIGS. 13 and 14. The vehicle was cured in the same manner, and a good vehicle fixation was achieved which provided good clearness and mechanical strength to the cured vehicle.

Test No.11

An offset printing arrangement was constructed by using image forming units shown in FIGS. 8 to 10 and ink No.1, No.2 or No.5. An ink image was formed on the recording papers listed in Table 3. The ink curing liquids or the silicone oils were applied to contact the ink image by the method shown in FIG. 3. The ink on the printed surface was cured, and a good fixation of the ink was achieved which provided a good concentration, clearness and mechanical strength to the cured ink.

Similar tests were performed on the vehicles listed in Table 2. The vehicles were similarly cured, and a good fixation of the vehicles was achieved which provided clearness and mechanical strength to the cured vehicle.

Test No.12

An ink image was formed on the recording paper listed in the Table 3 by using the ink No.1 to No.5. Thereafter, the ink curing liquids listed in the Table 4 or the silicone oils were applied to contacted the printed surface by using the ink fixing units shown in FIGS. 15 and 16. As a result, the ink on the printed surface was cured, and a good ink fixation was achieved which provides a good concentration, clearness and mechanical strength to the cured ink.

Similar tests were performed on an image formed by the vehicles listed in Table 2 which image was formed on the recording papers listed in Table 3. The vehicles were cured similarly, and a good fixation of the vehicles was achieved which provided clearness and mechanical strength to the cured vehicle.

Test No.13

1) An offset printing arrangement was constructed by using image forming units shown in FIGS. 17 and 18 and ink No.1, No.2 or No.5. An ink image was formed on the recording papers listed in the Table 3. The ink curing liquids listed in the Table 4 or the silicone oils were applied to contact the ink image by providing two ink fixing units using the method shown in FIG. 3. The contact of the ink curing liquids or the silicone oils was performed twice by providing two units using the method shown in FIG. 3. The ink on the printed surface was cured in a shorter time, and a good ink fixation was achieved which provided a good concentration, clearness and mechanical strength to the cured ink.

Similar tests were performed on the vehicles listed in the Table 2. The vehicles were cured in a shorter time, and a good vehicle fixation was achieved which provided clearness and a mechanical strength to the cured vehicle.

2) An offset printing arrangement was constructed by using the image forming unit shown in FIG. 19 and ink No.1, No.2 or No.5. An ink image was formed on the recording papers listed in the Table 3. The silicone oil was applied to contact the ink image by providing a single unit using the method shown in FIG. 5 after forming each color component image. The ink on the printed surface was cured in a shorter time, and a good fixation of the ink was achieved which provided a good concentration, clearness and mechanical strength to the cured ink.

Similar tests were performed on the vehicles listed in the Table 2. The vehicles were cured in a shorter time, and a good vehicle fixation was achieved which provided clearness and mechanical strength to the cured vehicle.

3) An offset printing arrangement was constructed by using the image forming unit shown in FIG. 20 and the ink No.1, No.2 or No.5. An ink image was formed on the recording papers listed in the Table 3. The ink curing liquids listed in the Table 4 were applied to contact the ink image by providing two units using the method shown in FIG. 5 after forming each color component image. The ink on the printed surface was cured in a shorter time, and a good fixation of the ink was achieved which provided a good concentration, clearness and mechanical strength to the cured ink.

Similar tests were performed on the vehicles listed in the Table 2. The vehicles were cured in a shorter time, and a good fixation of the vehicles was achieved which provided clearness and mechanical strength to the cured vehicle.

4) An ink image was formed on the recording paper listed in the Table 3 by using ink No.1 to No.5. Thereafter, the ink curing liquids listed in Table 4 or the silicone oils were applied to contact the printed surface by providing five ink fixing units using the method shown in FIG. 2 as shown in FIG. 21. As a result, the ink on the printed surface was cured, and a good fixation of the ink was achieved which provided a good concentration, clearness and mechanical strength to the cured ink.

Similar tests were performed on an image formed by the vehicles listed in the Table 3 which image was formed on the recording papers listed in the Table 3. The vehicles were cured similarly, and a good fixation of the vehicles was achieved which provides clearness and a mechanical strength to the cured vehicle.

Test No.14

Structural Parts:

1) a porous member for removing ink curing liquid shown in FIG. 22: Rubycell$^R$, Toyo Polymer CO., Ltd
2) a member for removing ink curing liquid shown in FIG. 23: Pictrico$^R$
3) a member for removing ink curing liquid shown in FIG. 24: cotton cloth or paper Results:

1) An offset printing arrangement was constructed by using image forming units shown in FIGS. 8–10 and ink No.1, No.2 or No.5. An ink image was formed on the recording papers listed in the Table 3. The ink curing liquids or silicone oils were applied to contact the ink image to cure the ink. Thereafter, the ink curing liquids were removed by the arrangement shown in FIG. 22. As the result, it was recognized that no ink curing liquid adhered to an operator's hand when the printed surface was touched, and pollution of the surrounding atmosphere is prevented.

2) An offset printing arrangement was constructed by using image forming units shown in FIGS. 8–10 and ink No.1, No.2 or No.5. An ink image was formed on the recording papers listed in the Table 3. The ink curing liquids or silicone oils were applied to contact the ink image to cure the ink. Thereafter, the ink curing liquids were removed by the arrangement shown in FIG. 23. As a result, it was recognized that no ink curing liquid adhered to an operator's hand when the printed surface was touched, and pollution of the surrounding atmosphere is prevented.

Additionally, it was also recognized that the absorbed ink curing liquid was evaporated by heating an ink absorbing film, and the ink absorbing film can be used repeatedly.

3) An image was formed on the recording papers listed in Table 3 by using ink No.1 to No.5. The printed surface of the recording paper was put in contact with the ink curing liquids listed in Table 4 or the silicone oils by using the fixing unit shown in FIG. 24 so as to cure the ink curing liquids. Thereafter, the ink curing liquids on the printed surface were removed. As the result, it was recognized that no ink curing liquid adhered to an operator's hand when the printed surface was touched, and pollution of the surrounding atmosphere is prevented.

In the above-mentioned embodiments, a liquid is used for rapidly curing the resin in the ink or vehicle contained in the ink. On the other hand, the embodiments described below use a solid to be contacted to an ink image so as to rapidly cure the ink or vehicle in the ink.

(Description of Eleventh Embodiment)

Figure 25:
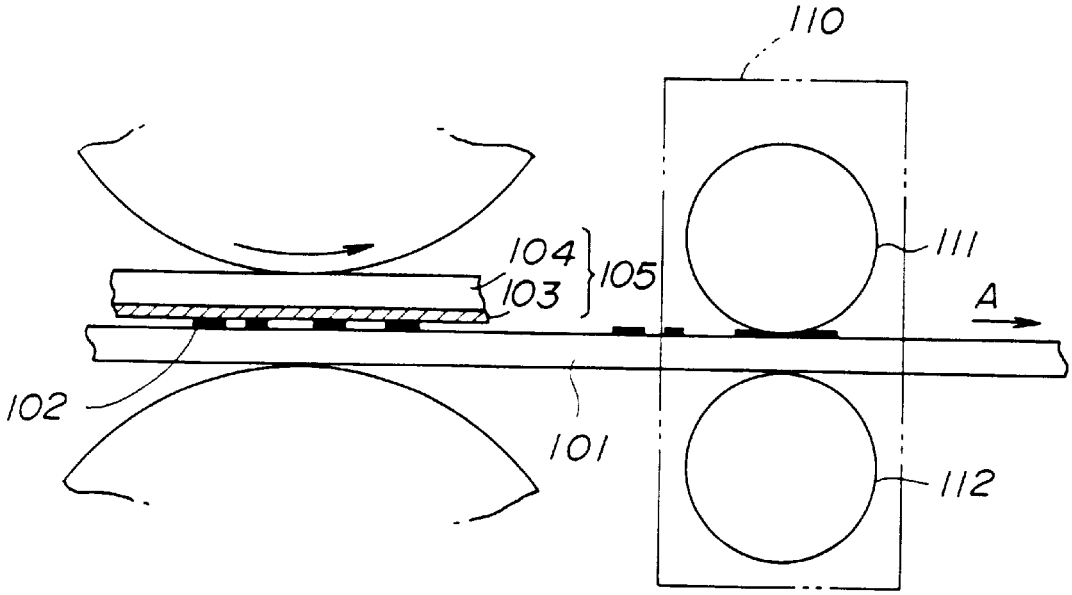
FIG. 25 is an illustration of an example of a flat plate printing.
Figure 26:
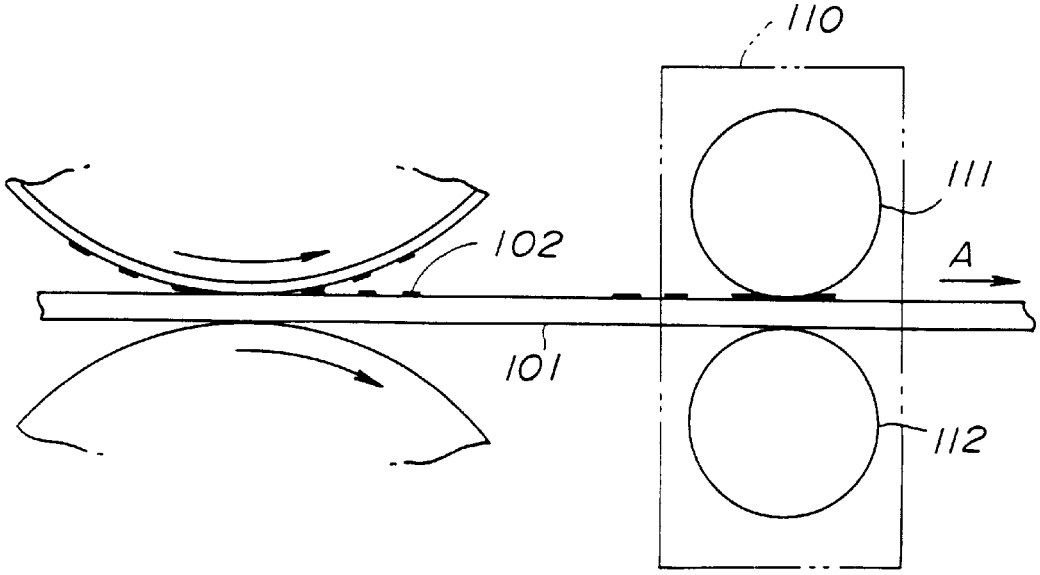
FIG. 26 is an illustration of an example of a flat plate printing (offset printing)
Figure 27:
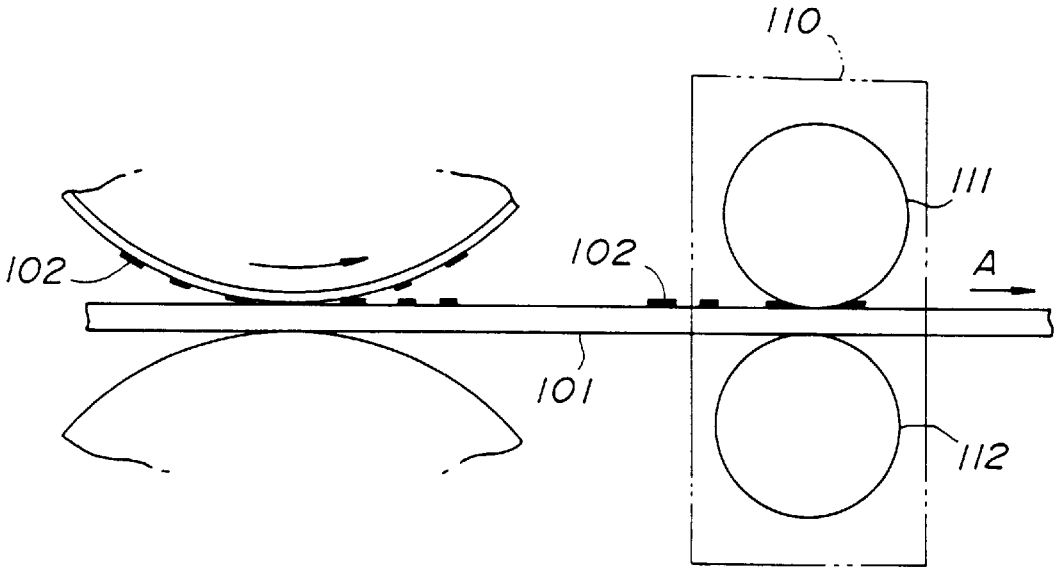
FIG. 27 is an illustration of an example of a letterpress printing.
Figure 28:
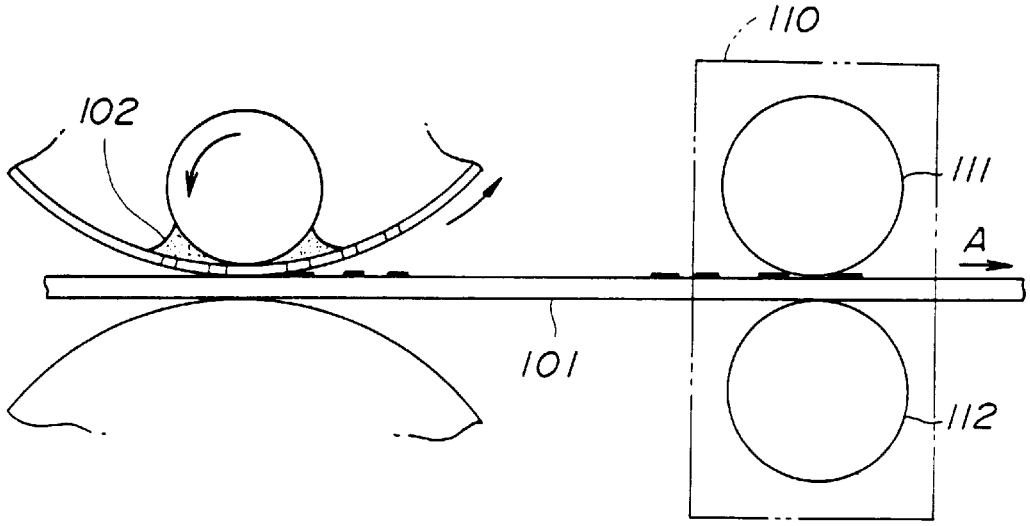
FIG. 28 is an illustration of an example of a stencil printing.
Figure 29:
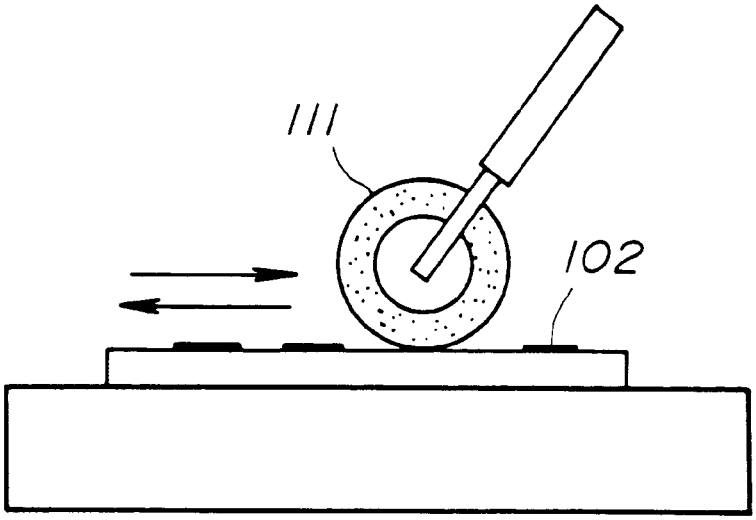
FIG. 29 is an illustration of an example of a simplified printing.

FIGS. 25 to 29 are illustrations for explaining an eleventh embodiment according to the present invention. In the figures, a reference numeral 101 indicates a recording medium; 102 indicates ink; 103 indicates a recording layer; 104 indicates a substrate; 105 indicates a printing plate; 110 indicates an ink fixing unit; 111 indicates a contacting solid member and 112 indicates a press roller. FIG. 25 illustrates an example of flat plate printing (direct printing). FIG. 26 illustrates an example of flat plate printing (offset printing). FIG. 27 illustrates an example of letterpress printing. FIG. 28 illustrates an example of stencil printing. FIG. 29 illustrates an example of a simplified printing. In the examples of these figures, the recording medium 1 is conveyed in a direction indicated by an arrow A.

In the present embodiment, the ink 2 is fixed by contacting or applying the solid member 111 to the ink 2 after the ink 2 is transferred to the recording medium 1, the solid member having a swelling property with respect to a solvent contained in the ink. The ink 2 used in this embodiment contains a resin and a solvent miscible with the resin. As for the resin, a rosin denaturated phenol resin, a rosin denaturated ester resin, a petroleum resin, an DCPD resin or an alkyd resin is suitable. As for the solvent miscible with the resin, either a polar solvent or a nonpolar solvent can be used such as aliphatic hydrocarbon, aromatic hydrocarbon, ketone or alcohol. Preferably, the solvent is a fixed solvent having a boiling point of 100° C. or more. As an example of the ink, there is oily ink such as commercially available offset ink, typographic ink, waterless offset ink and stencil ink. Additionally, the solvent may either contain or not contain a drying oil (nonsaturated fatty acid) needed for oxidative polymerization drying and other curing agents.

With respect to the solid member having a swelling property, the swelling property means that when a solvent is dropped onto the solid member, the area of the solid member contacted by the solvent exhibits a volumetric expansion within about 1 minute. As for a solid member having this characteristic, either an organic material or a nonorganic material may be used which is preferably a resin member. As for the resin contained in the solvent, a polymer, a polymer blend or a polymer alloy, or a crosslinking material or a vulcanized material thereof is suitable. Specifically, silicone resin (polymer or rubber), butyl rubber, chloroprane rubber, natural rubber, semi-natural rubber, or olefin elastomers may be suitable.

The inventors found that an ink layer is immediately cured after the solid member made of the above-mentioned materials is put in contact with the ink layer on a recording medium. Additionally, it was found that the ink did not adhere to the contacting solid member after the ink was cured and the contacting solid member was separated from the ink layer. There was no change in the concentration of the ink on the recording medium. Further, it was found that when a solid member which did not have the swelling property but having permeability with respect to a solvent was put in contact with the ink layer, the ink did not or substantially did not cured for a long contact time such as about 3 minutes. Additionally, when the contacting solid member was separated from the ink after the ink was cured to a certain degree, the ink adhered on the surface of the contacting solid member and the concentration of the ink on the recording medium was decreased. Further, in the case of a solid member having no swelling property and permeability with respect to the solvent, it was found that the ink was not cured for a long contacting time as long as about 10 minutes. The present embodiment utilizes the above-mentioned phenomena.

The above-mentioned ink curing phenomenon can be explained as follows.

The inventors found that the an amount of solvent contained in the ink decreases in the time between before and after the ink is cured. Accordingly, it can be assumed that the cure of the ink is achieved by the decrease in the amount of solvent contained in the ink due to diffusion of the solvent in the solid member which is caused by the contact of the solid member with the ink. Thus, it is assumed that the ink is substantially not diffused in a solid member which does not have either a swelling property or permeability with respect to the ink, and it is easily understandable that the ink is not cured by contact with such a solid member.

On the other hand, the diffusion of the solvent occurs in a solid member having either a swelling property or permeability with respect to the solvent when the solid member is in contact with the ink. However, the degree of cure provided by either type of solid member is different from each other. The inventors considered the difference as follows.

In many cases, a member having no swelling property but having permeability with respect to a solvent is, typically, a porous member. Thus, when such a solid member is in contact with the ink, it is assumed that the ink as a whole penetrates into the contacting solid member. On the other hand, many solid members having a swelling property have molecular chains with a dense mesh. Thus, it is assumed that the ink as a whole substantially does not diffuse into the contacting solid member, but only the solvent contained in the ink diffuses into the contacting solid member.

Additionally, the swelling property of a solid member with respect to a solvent can be optimized by a solubility parameter (SP value). If a solvent of the ink is known, an efficient cure of the ink can be achieved be selecting a solid member having an SP value which is approximately the SP value of the solvent.

(Description of Twelfth Embodiment)

This embodiment corresponds to the eleventh embodiment in which the ink is cured by contacting a solid member to the surface of the recording medium after the ink is transferred onto the recording medium, the contacting solid member having a swelling property with respect to the solvent contained in the ink but lacking permeability with respect to the ink as a whole. The solid member having a swelling property with respect to the solvent contained in the ink cures the ink. However, if the surface of the solid member is porous or rough which permits the ink as a whole to permeate or infiltrate into the solid member, a small portion of the ink moves to the solid member. This may reduce the concentration of the ink on the recording medium. Accordingly, it is preferable that at least a surface or a portion near the surface of the contacting solid member lacks permeability with respect to the ink.

(Description of thirteenth embodiment)

Figure 30:
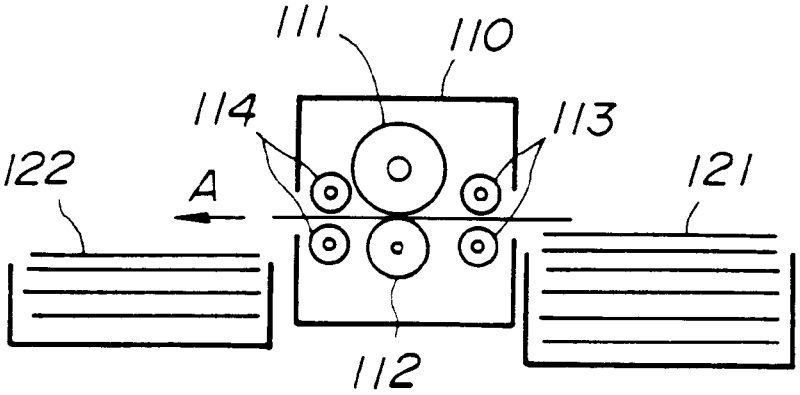
FIG. 30 is an illustration of an example of an exclusive fixing apparatus performing a fixing operation after printing.

This embodiment is related to a recording apparatus using the method of the eleventh embodiment. The principle of the curing method according to this embodiment is the same as that of the eleventh embodiment. FIG. 30 is an illustration of an example of an exclusive fixing apparatus performing a fixing operation after printing. In the figure, 110 indicates the fixing apparatus which operates similar to the fixing unit 110 shown in FIGS. 25 to 28; 121 indicates printed matter before it is fixed; 122 indicates the printed matter after it is fixed; and 113 and 114 indicate guide rollers. The rollers 113 are provided before the contacting solid member 111, and the rollers 114 are provided after the contacting solid member 111. The guide rollers 113 contact only edge portions of the printed matter 121 to guide the printed matter 121 since the ink on the printed matter 121 may adhere to the guide rollers 113 if the guide rollers 13 contact the surface of the printed matter 121. Additionally, it is better to form the guide roller 114 from material which is the same as that of the solid member 111 so as to improve reliability of the fixation.

Preferably, the contacting solid member 111 has a roller-like shape as it has a simple configuration. However, some kinds of solid members require a relatively long time for curing the ink. In this case, the ink may adhere to the contacting solid member 111 when the contacting solid member 111 is separated from the ink layer before the ink is completely cured. In order to eliminate such a problem, it is preferable to use a contacting solid member 111' and a printed matter supporting member 112' shown in FIG. 31 so that the contacting solid member 111' contacts the entire surface of the recording medium (the printed matter) and the contacting solid member 111 is separated after the ink is completely cured.

Figure 31:
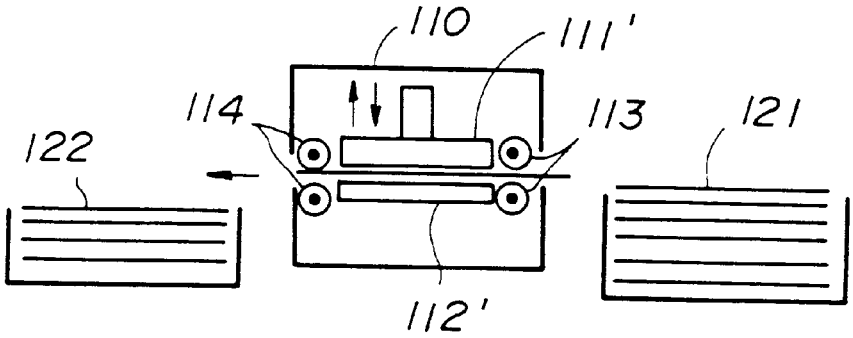
FIG. 31 is an illustration of another example of the exclusive fixing apparatus performing a fixing operation after printing.
Figure 32:
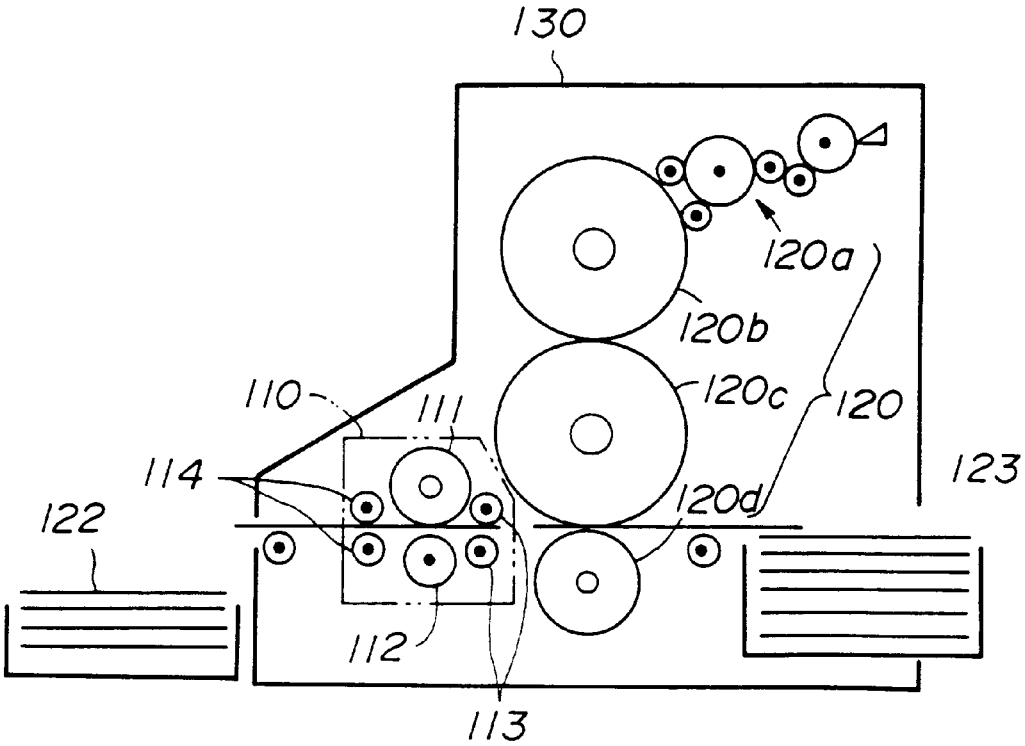
FIG. 32 is an illustration of an example of a recording apparatus in which a fixing unit is incorporated into a recording apparatus.

FIG. 32 is an illustration of an example of a recording apparatus in which the fixing unit 110 is incorporated into a recording apparatus 130. In the figure, a reference numeral 120 indicates a printing unit; 122 indicates the printed matter after it is fixed; and 123 indicates a recording paper. The printing unit 120 comprises inking rollers 120*a*, a printing drum 120*b*, a blanket drum 120*c* and a pressing roller 120*d*. The recording paper 123 is printed by the printing unit 120, and thereafter fixed by the fixing unit 110. Although the fixing apparatus having a structure shown in FIG. 30 is used in the example shown in FIG. 32 as the fixing unit 110, the fixing unit shown in FIG. 31 may instead be used.

Figure 33:
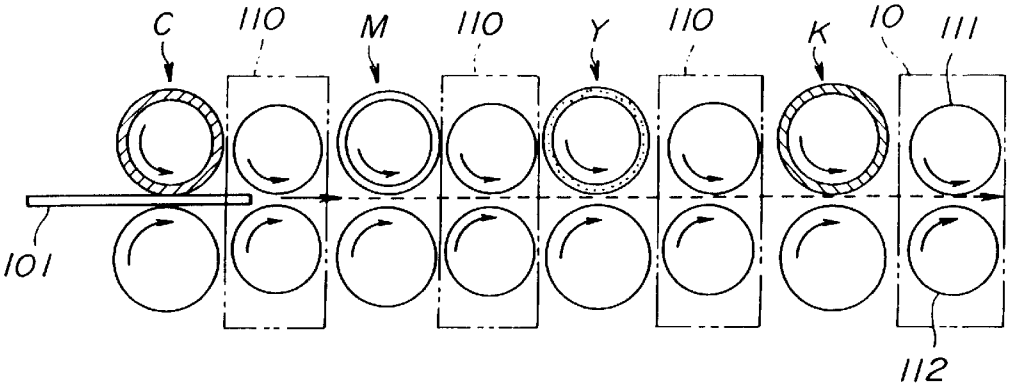
FIG. 33 is an illustration of a recording apparatus in which fixation of ink is performed by providing an ink fixing unit at each position between ink transfer units C (cyan), M (magenta), Y (yellow) and K (black)
Figure 34:
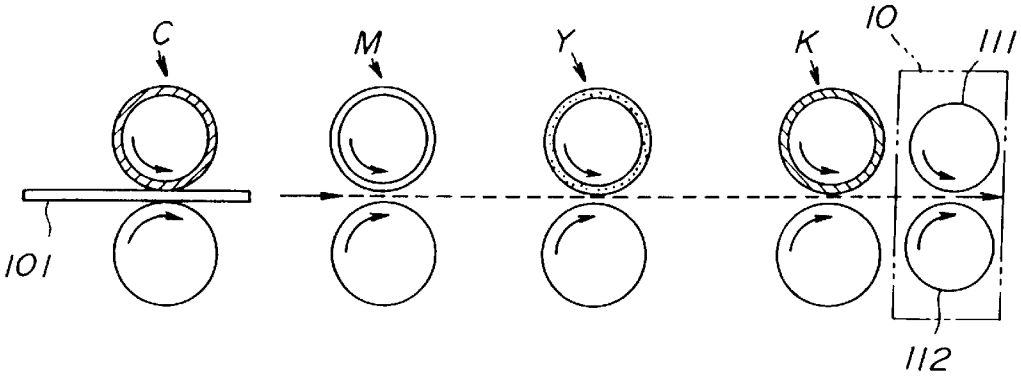
FIG. 34 is an illustration of a recording apparatus in which a fixing unit is provided after the last color component ink is printed.

In an example shown in FIG. 33, fixation of ink is performed by providing the ink fixing unit 10 at each position between ink transfer units C (cyan), M (magenta), Y (yellow) and K (black). In this structure, since a color component ink image can be transferred onto the recording paper after the ink previously transferred on the recording paper is cured to a certain level. Thus, the preceding ink is not transferred to the printing plate or the blanket in the subsequent color ink printing process, resulting in a high speed multi-color printing. Additionally, the ink fixing efficiency is increased since the ink is fixed for each color component ink. However, if the color component ink is not substantially mixed, the fixing unit 110 may be provided after the last color component ink is printed as shown in FIG. 34.

Figure 35:
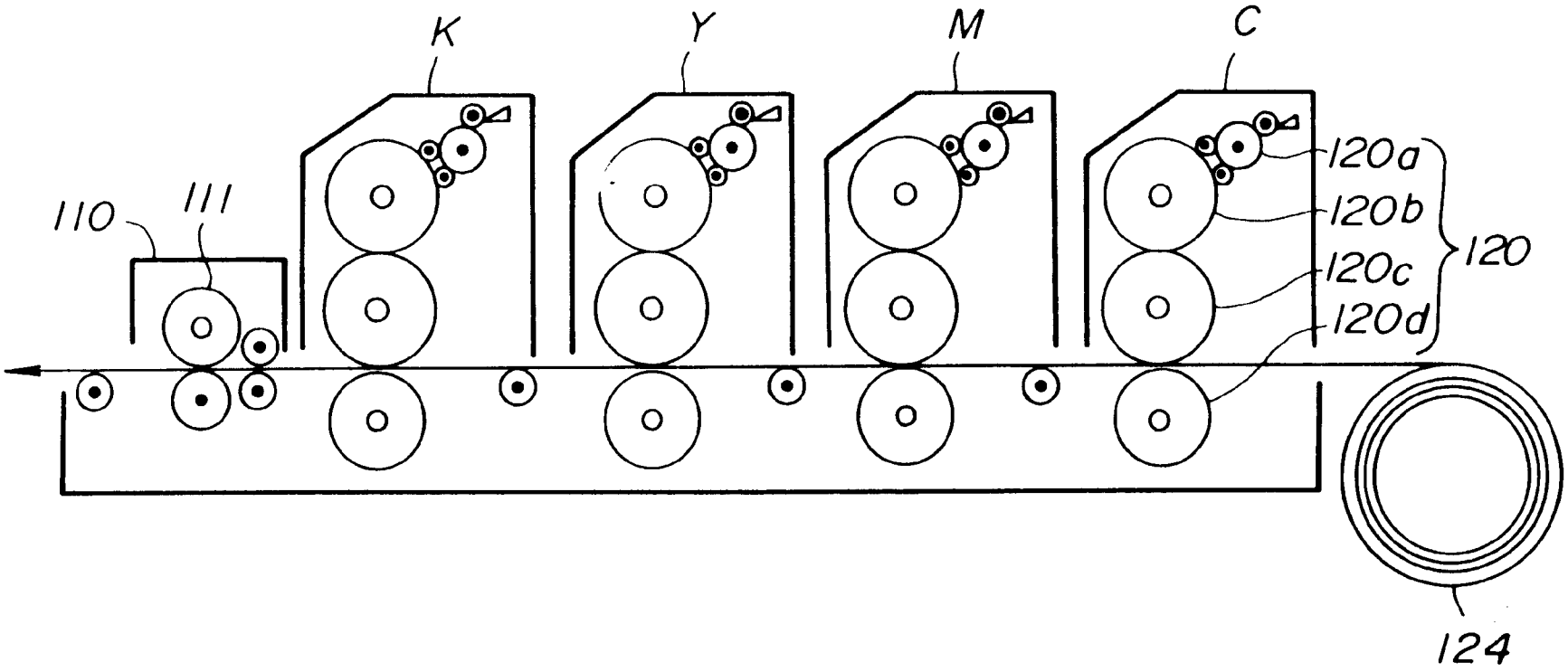
FIG. 35 is an illustration of an example in which a fixing apparatus according to a thirteenth embodiment is applied to a multi-color printing using a rolled paper.
Figure 36:
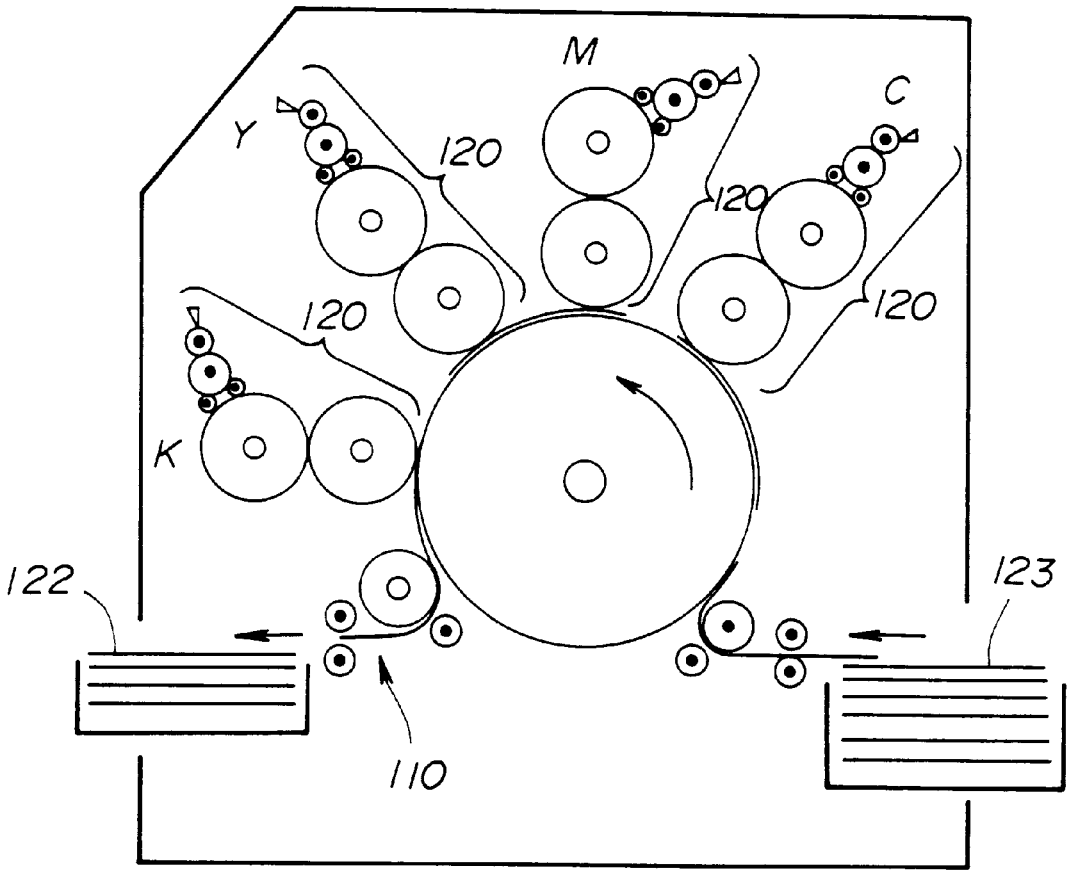
FIG. 36 is an illustration of an example in which a fixing apparatus according to a thirteenth embodiment is applied to a multi-color printing using stacked papers.

FIGS. 35 and 36 are examples to which the fixing apparatus according to the present embodiment is applied to multi-color printing. In the example shown in FIG. 35, multi-color printing is performed by using a paper roll 124 as in a rotary press. In the example shown in FIG. 36, multi-color printing is performed by using stacked recording papers 123. In either example shown in FIG. 35 or 36, the ink is fixed by the solid member 111 being applied to contact the ink after the multi-color printing is completed.

It should be noted that, in the examples shown in FIGS. 35 and 36, reliability of the fixation can be increased by preforming a fixing operation for printing of each color component rather than performing a single fixing operation at the end of the printing. Additionally, the present embodiment can be applied not only to an offset printing apparatus but also other types of printing apparatus using ink containing a resin and a solvent dissolving the resin such as typographic printing, stencil printing or gravure printing.

(Description of Fourteenth Embodiment)

This embodiment corresponds to the recording apparatus according to the thirteenth embodiment in which the ink on the recoding medium is fixed by contacting a solid member to the surface of the recording medium, the solid member having a swelling property with respect to the solvent contained in the ink and having no permeability with respect to the ink as a whole. As mentioned above, a solid member having a swelling property with respect to the solvent contained in the ink cures the ink. However, if the surface of the solid member is porous or rough which permits the ink as a whole to permeate or infiltrate into the solid member, a small portion of the ink moves to the solid member. This may reduce the concentration of the ink on the recording medium. Accordingly, it is preferable that at least the surface or a portion near the surface of the contacting solid member is impermeable with respect to the ink.

(Description of Fifteenth Embodiment)

Figure 37:
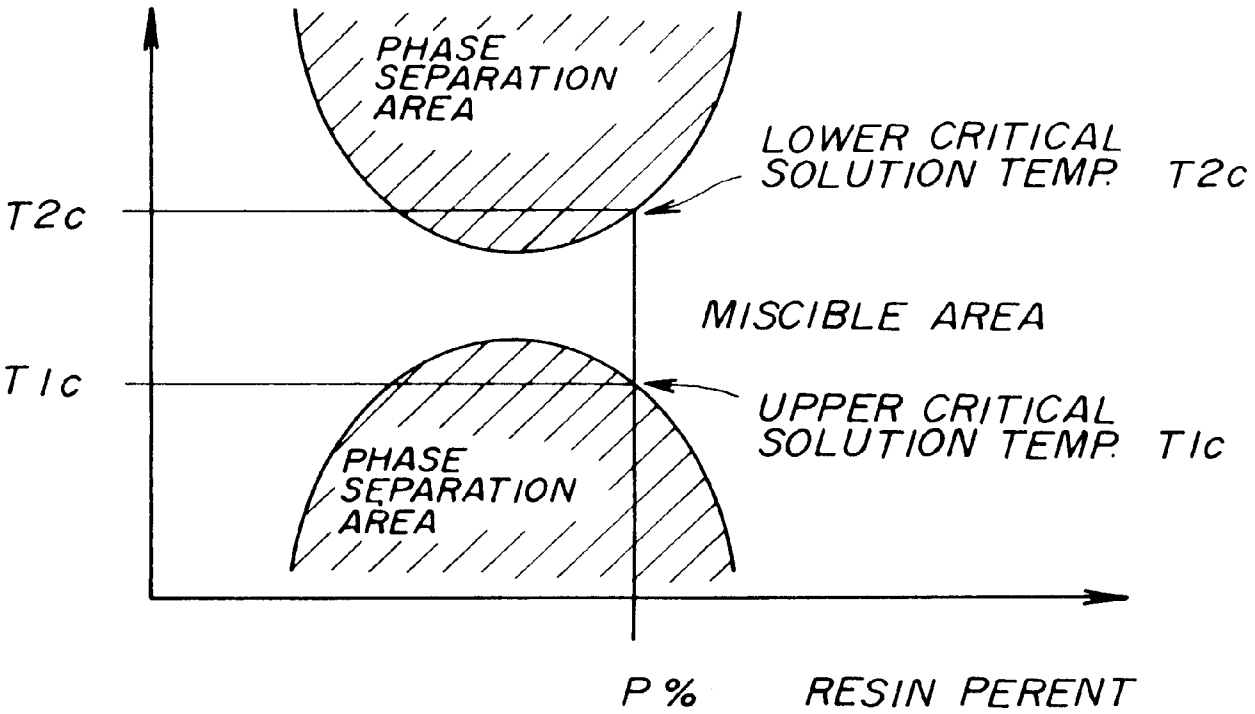
FIG. 37 is a graph showing a correlation of miscibility between a resin and a solvent dissolving the resin.

This embodiment corresponds to the thirteenth embodiment or the fourteenth embodiment in which the ink on the recording medium is cured in the thirteenth or fourteenth embodiment by heating the recording medium before or during the contact period when solid member contacts the recording medium. Generally, the correlation of the miscibility between a resin and a solvent dissolving the resin is represented as shown in a graph presented in FIG. 37. That is, even if the resin and the solvent are dissolved with each other, the resin and the solvent are separated from each other at a temperature above a lower critical solution temperature or a temperature below an upper critical solution temperature. For example, if a ratio of resin is set to P% as shown in FIG. 37 and if the resin liquid which is a mixture of the resin and the solvent is heated at a temperature above the lower critical solution temperature T2c or cooled at a temperature below the upper critical solution temperature, the resin liquid is separated to the resin and the solvent.

The inventor found that the curing time of the ink can be further reduced by combining the above-mentioned property and the curing operation of the ink using the solid member. The heating method has an advantage over the cooling method in that the heating method can use an inexpensive apparatus as compared to the cooling method. Thus, in the present embodiment, the curing action of the ink on the recording medium is promoted by heating the ink before or while the solid member is in contact with the ink. It is most effective to increase the heating temperature above the lower critical solution temperature T2c. However, this requires a large amount of electric power for heating. The inventors found that the combination of heating and the contact of the solid member allows a reduction of ink curing time by heating the ink but not heating up to the lower critical solution temperature. The reason for this is considered that the uniformity of miscibility of the resin and the solvent tends to be lost by heating, and further the solvent diffuses into the solid member which promotes curing of the ink. As for the possibility that evaporation of the solvent due to heating promotes the curing action of the ink, the temperature used in experiments performed by the inventors is considerably lower than the temperature at which the solvent contained in the ink is evaporated, and the heating at a relatively low temperature promotes curing action. Thus, it is considered that the contribution of evaporation of the solvent to the curing of the ink is less than the combination of using the solid member and a lower temperature heat source.

(Description of Sixteenth Embodiment)

This embodiment corresponds to the recording apparatus according to the fifteenth embodiment in which the ink on the recording medium is cured by heating the recording medium at a temperature above the lower critical solution temperature T2c which is determined by the combination of a resin and a solvent before or while the solid member is in contact with the ink. As mentioned above, this increases power consumption. However, the ink is cured in a very short time, and a remarkable effect is obtained.

(Description of Seventeenth Embodiment)

This embodiment corresponds to the recording apparatus according to the thirteenth embodiment or fourteenth embodiment in which the ink on the recording medium is cured by cooling the recording medium before or while the solid member is in contact with the ink. In the method for promoting curing of ink by heating as mentioned above, temperature inside the apparatus is increased when means for fixing ink is incorporated into a recoding apparatus. Thus, there is a possibility that an occurrence of background stain due to an increase in the viscosity of the ink while printing. Accordingly, in this embodiment, cure of the ink on the recording medium is promoted by cooling the ink before or while the solid member is in contact with the ink. It is most effective to decrease the cooling temperature below the upper critical solution temperature T1c. However, this requires a large amount of electric power for cooling. The inventors found that the combination of cooling and the contact of the solid member allows a reduction of ink curing time by cooling the ink but not cooling below the upper critical solution temperature. The reason for this is considered that the uniformity of miscibility of the resin and the solvent tends to be lost by cooling, and further the solvent diffuses into the solid member which promotes cure of the ink.

(Description of Eighteenth Embodiment)

This embodiment corresponds to the recording apparatus according to the seventeenth embodiment in which the ink on the recording medium is cured by cooling the recording medium at a temperature below the upper critical solution temperature T1c which is determined by the combination of a resin and a solvent before or while the solid member is in contact with the ink. As mentioned above, this increases power consumption. However, the ink is cured in a very shcrt time, and a remarkable effect is obtained.

(Description of Nineteenth Embodiment)

This embodiment corresponds to the recording apparatus according to one of the thirteenth to eighteenth embodiments in which the solid member is made of a silicone resin. The inventor investigated various solid members having a swelling property, and found that a silicone resin has a particular superiority. The silicone resin provides a shorter curing time among various contacting solid members. Additionally, the silicone resin does not allow adherence of the ink on the surface thereof when a solid member made of the silicone resin is separated when the ink has not completely cured yet, whereas other solid member materials allow adherence of a small amount of ink on the surface thereof when they are separated from the ink layer when the ink has not completely cured yet. That is, it can be said that the silicone resin provides the highest reliability when a method for fixing ink is performed without reducing the concentration of the ink. It is assumed that a low surface energy of the silicone resin and formation of an extremely thin silicone oil layer on the silicone resin as indicated by WBFL theory contribute to the lack of adherence of the ink onto the silicone resin, when the silicone resin is separated from the ink when the ink has not completely cured. There are some other materials having a low surface energy such as fluororesin. However, the fluororesin does not provide a good effect since the fluororesin lacks the swelling property with respect to a solvent contained in ink. Accordingly, the silicone resin has a unique property in that no ink adheres thereto and it has a swelling property with respect to a solvent contained in ink. Thus, reliability of fixation of ink is remarkably increased by using the silicone resin.

The silicone resin to be used may be any one of a crosslinking material and a vulcanized material such as a chain polymer having a siloxene structure as a unit, a branching polymer or heat vulcanized silicone rubber. Additionally, any one of dimethyl, methyl vinyl and methyl vinyl phenyl denaturated silicone resins may be used. The silicone resin may be in the form of a rigid member, an elastic member such as rubber or a semi-solid such a gel. Additionally, an elastic member containing a silicone resin also provides superior results. Further, when a crosslinking type silicone resin is used, the one which has a low crosslinking density is more preferable since it is superior in swelling property with respect to solvent.

(Description of Twentieth Embodiment)

This embodiment corresponds to the recording apparatus according to one of the thirteenth to nineteenth embodiments in which the surface of the solid member is formed as a glossy surface. If the surface of the solid member is rough, the ink penetrates into the a recess of the surface when contacted by the solid member. Thus, the concentration of the ink may be decreased since a small amount of the ink on the recording medium is caught by the soil member. In order to eliminated this problem, the surface of the solid member is preferably a glossy surface. The glossy surface herein refers to a surface having a 10-point average roughness of 2 $\mu$m or less.

(Description of Twenty-first Embodiment)

Figure 38:
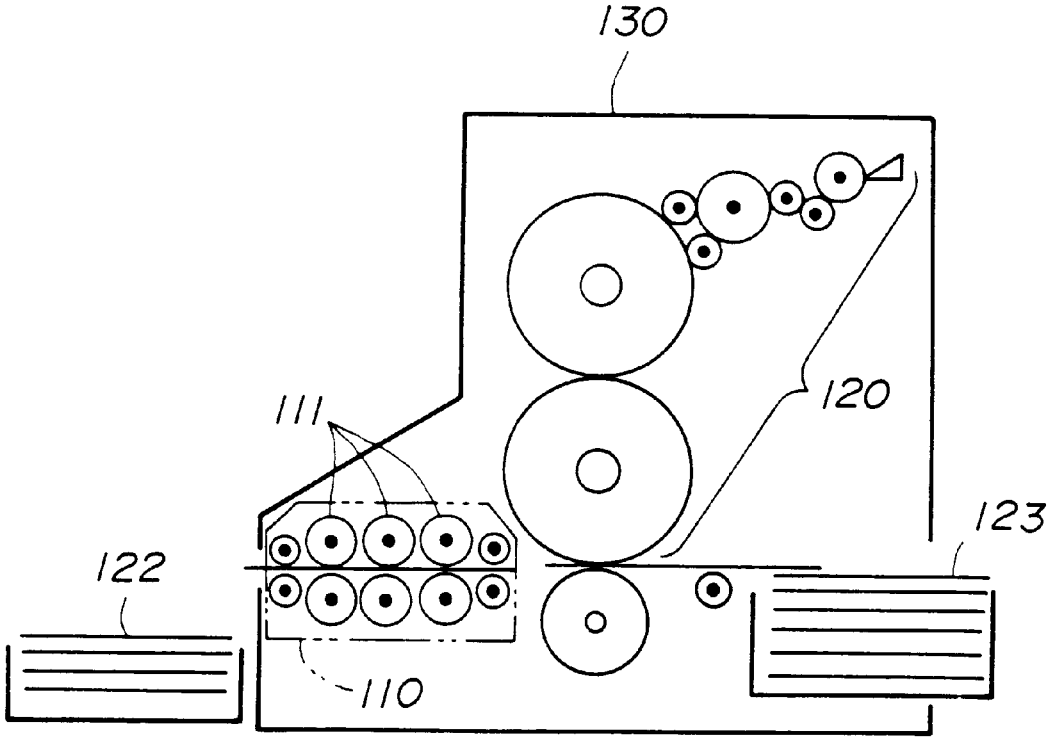
FIG. 38 is an illustration of a recording apparatus in which a plurality of solid member contacting means are provided.

This embodiment corresponds to the ink fixing unit or recording apparatus according to one of the thirteenth to twentieth embodiments in which a plurality of solid member contacting means are provided. An example is shown in FIG. 38. In FIG. 38, parts that are the same as the parts shown in FIG. 32 are given the same reference numerals. In the example shown in FIG. 38, the fixing unit 110 comprises a plurality of contacting solid members 111. When a single solid member is used which does not provide cure of the ink unless a certain long time elapses, a moving speed of the printed matter relative to the contacting solid member after printing must be reduced so as to perform a sufficient fixation of ink. Thus, as shown in FIG. 38, the time period for contacting can be extended by providing a plurality of contacting solid members 111. This structure is not limited to this example, and is applied to the exclusive ink fixing apparatus shown in FIG. 30. Additionally, the present embodiment is not limited to offset printing, and can be applied to other recording apparatuses using ink containing a resin and a solvent missible with the resin, such as typographic printing, stencil printing or a gravuer printing machine.

(Description of Twenty-second Embodiment)

Figure 39:
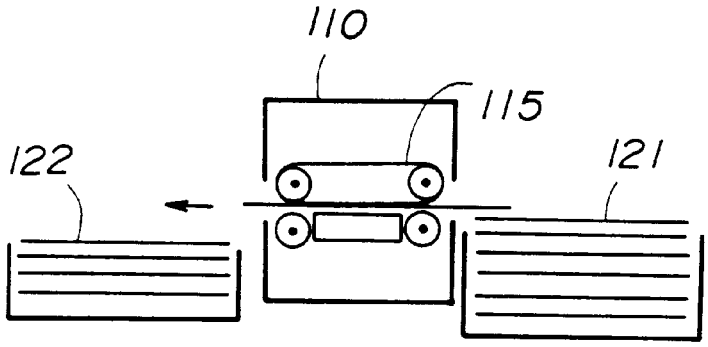
FIG. 39 is an illustration of a recording apparatus in which the solid member is in the form of a belt.

This embodiment corresponds to the ink fixing unit or recording apparatus according to one of the thirteenth to twentieth embodiments in which the solid member is in the form of a belt. An example is shown in FIG. 39. In FIG. 39, a reference numeral 115 indicates a belt-like solid member, and other parts that function the same as the parts shown in FIG. 31 are given the same reference numerals. As mentioned above, when a single solid member is used which does not provide cure of ink unless a certain time has elapsed, a moving speed of the printed matter relative to the contacting solid member after printing must be reduced so as to perform a sufficient fixation of ink. Thus, as shown in FIG. 39, the time period for contacting can be equivalently extended by increasing the contacting area by forming the contacting solid member as a belt-like solid member 115 so that the fixing speed is not reduced. This structure is not limited to this example, and can be applied to a case in which the fixing unit is incorporated into a recording apparatus. Additionally, the present embodiment is not limited to offset printing, and can be applied to other recording apparatuses using ink containing a resin and a solvent missible with the resin, such as typographic printing, stencil printing or a gravure printing machine.

(Description of Twenty-third Embodiment)

This embodiment corresponds to the recording apparatus according to one of the thirteenth to twentieth embodiments in which the solid member is heated continuously or for a necessary time after the solid member contacts the ink. As mentioned above, the solid member swells due to diffusion of the solvent into the solid member. When a thickness of the solid member is large, the solvent sufficiently diffuses in the solid member. However, if the solid member is thin, the solvent is collected within the solid member, resulting in a decrease in the diffusion capability. Thus, in this embodiment, the solvent collected in the solid member is removed by heating the solid member continuously or for a necessary time. Generally, the solvent contained in ink is the fixed solvent. However, the solvent slowly evaporates even at room temperature, and considerable amount of solvent is removed from the solid member after it is left for only one day. Accordingly, the heating temperature is not always above the boiling point of the solvent. That is, the solvent diffused in the solid member is evaporated at a temperature higher than the room temperature.

Figure 40:
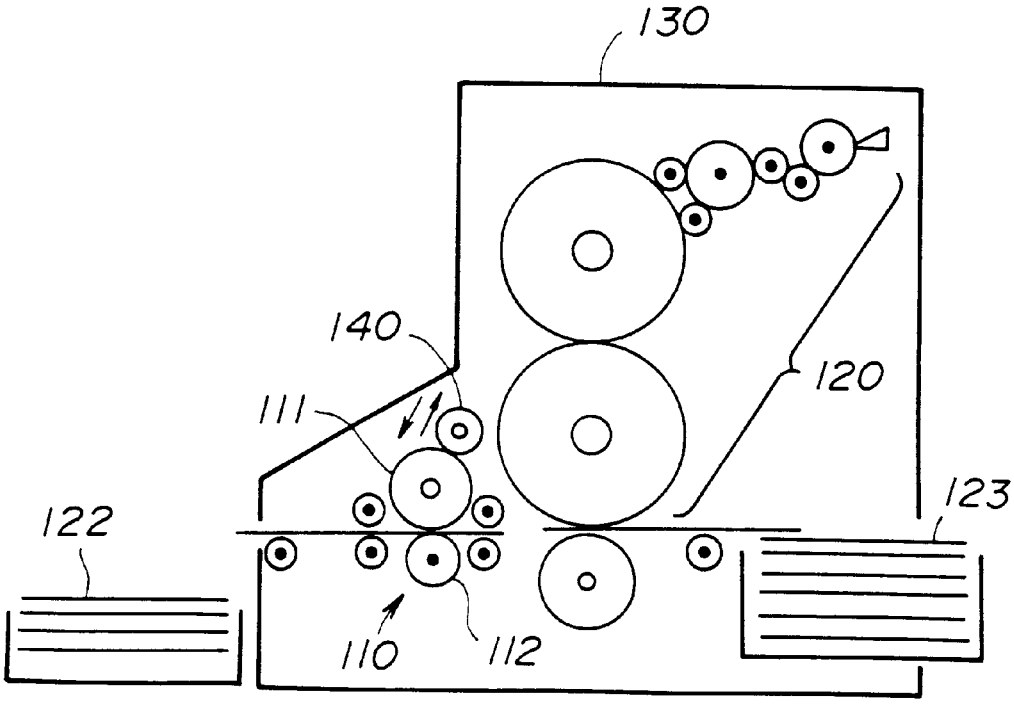
FIG. 40 is an illustration of an example of a recording apparatus in which a heating device is incorporated.

FIG. 40 shows an example of a recording apparatus in which a heating device is incorporated. In FIG. 40, a reference numeral 140 indicates a heat source which comprises a heating roller having a mechanism which is detachably attached to the contacting solid member 111. In this example, the solvent is removed by contacting the heating roller to the solid member in response to an amount of solvent collected in the solid member.

Figure 41:
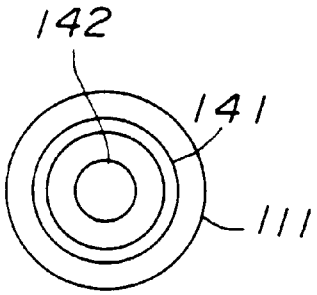
FIG. 41 is an illustration of another example of a heating structure for the solid member.

FIG. 41 is an illustration for another example of the heating structure for the solid member. In this example, a heater 142 is provided in a hollow supporting member (roller) 141. The contacting solid member 111 is formed on the supporting member 141. Since the solid member 111 is heated from inside by providing the heat source inside the contacting solid member 111, there is an advantage that the size of the apparatus can be reduced.

Figure 42:
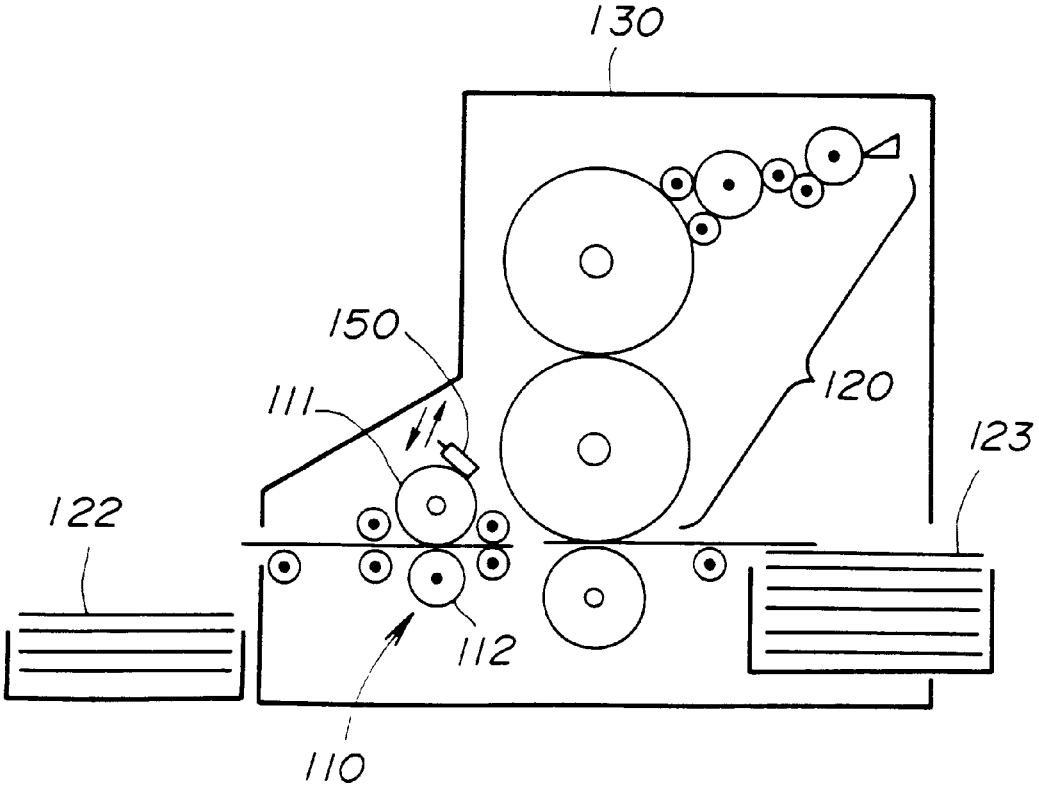
FIG. 42 is an illustration of an example of a recording apparatus in which a cooling device is provided.

Additionally, as an example of the seventeenth embodiment, FIG. 42 shows an example of the recording apparatus in which a cooling device is incorporated. In FIG. 42, a reference numeral 150 indicates a cooling source which comprises a Peltier element. There is a structure by which the Peltier element 150 can be contact the solid member 111. Various conventional cooling means may be used such as a structure in which a roller cooled by a coolant or cooled air contacts the solid member.

Test No.15

Printing Plate Structure recording layer: Perfluoro-alkylaclyrate polymer LS317, emulsion copolymerization type, (Asahi Glass Co., Ltd.), thickness: 1 $\mu$m recording member substrate: Non-grazed PET film, size: 350×220 mm, thickness: 25 $\mu$m Ink (1) Waterless Offset Ink 1-1) Aqualess Super$^R$ KB, black, blue, red, yellow M (Toyo Ink Mfg Co., Ltd.)

1-2) Aqualess V$^R$ K2, black, blue, red, yellow M (Toyo Ink Mfg Co., Ltd.)

1-3) Aqualess Super$^R$ FC, black, blue, red, yellow Y XU (Toyo Ink Mfg Co., Ltd.)

1-4) New ALPO$^R$ G, black, blue, red, yellow, M (T&K Toka Co., Ltd)

1-5) Waterless S PL, black S (The Inktec Inc.)

1-6) Waterless S GT, black N (The Inktec Inc.)

(2) Ink Vehicle 2-1) Polymer (Rosin modified phenol resin)+Solvent (Dialen 168$^R$:#0-Solvent(H)=4:1)

2-2) Polymer (Rosin modified phenol resin)+Solvent (#AF7-Solvent:Dialen 168$^R$=1:4)

Recording Paper

1) Plain paper (Type 6200, Ricoh Corp.)

2) Synthetic paper (Peach Coat$^R$, Nisshinbo Industry Inc.)

Contacting Member A

1) Vinyl chloride Roller (ϕ30 mm, hardness 30 degrees)

2) Chloroprene rubber Roller (ϕ40 mm, hardness 20 degrees)

Results

In accordance with the above-mentioned conditions, ink fixing operations were performed by using the arrangement shown in FIG. 25. All of the inks and vehicles were cured within about 1 minute when one of the two kinds of contacting member was used. No setoff or blocking occurred when the printed recording papers were laid one on another. Thus, a good fixatLon of ink was performed.

It should be noted that the printing plate used in this test had a surface characteristic in which a receding contact angle is decreased when the printing plate is placed in contact with a contact member such as a liquid or a solid generating a liquid under a heated condition, and the receding contact angle is increased when there is no contact with a contact member such as a liquid or a solid generating a liquid under a heated condition.

Test No.16

Ink (1) Waterless Offset Ink 1-1) Aqualess Super$^R$ KB, black, blue, red, yellow N (Toyo Ink Mfg Co., Ltd.)

1-2) Aqualess V$^R$ K2, black, blue, red, yellow M (Toyo Ink Mfg Co., Ltd.)

1-3) Aqualess Super$^R$ FC, black, blue, red, yellow Y XU (Toyo Ink Mfg Co., Ltd.)

1-4) New ALPO$^R$ G, black, blue, red, yellow, M (T&K Toka Co., Ltd)

1-5) Waterless S PL, black S (The Inktec Inc.)

1-6) Waterless S GT, black N (The Inktec Inc.)

(2) Offset Ink 2-1) F Gloss 85, black (Dainippon Ink & Chemicals Inc.)

2-2) Mater black (Nikken Chemical Laboratories)

(3) Ink Vehicle 3-1) Polymer (Rosin modified phenol resin)+Solvent (Dialen 168$^R$:#0-Solvent(H)=4:1)

3-2) Polymer (Rosin modified phenol resin)+Solvent (#AF7-Solvent:Dialen 168$^R$=1:4)

Recording Paper

1) Plain paper (Type 6200, Ricoh Corp.)

2) Synthetic paper (Peach Coat$^R$, Nisshinbo Industry Inc.)

Contacting Member A

1) Vinyl chloride Roller (ϕ40 mm, hardness 50 degrees)

2) Chloroprene rubber Roller (ϕ40 mm, hardness 40 degrees)

Results

In the above-mentioned condition, ink fixing operations were performed by using the arrangement of the printing unit and the fixing rollers in the offset printing apparatus as shown in FIG. 26. The above-listed ink was directly applied to the recording paper. All of the inks and vehicle were cured within about 5 minutes when either one of the two kinds of contacting member was used. The offset ink was cured within 1 minute. No setoff or blocking occurred when the printed recording papers were laid one on another. Thus, a good fixation of ink or vehicle was performed.

Test No.17

Ink

Typographic Ink 3-1) Typographic Ink Graf-G, black (Dainippon Ink & Chemicals Inc.)

Recording Paper

1) Plain paper (Type 6200, Ricoh Corp.)

2) Synthetic paper (Peach Coat$^R$, Nisshinbo Industry Inc.)

Contacting Member A

1) Vinyl chloride Roller (ϕ40 mm, hardness 50 degrees)

2) Chloroprene rubber Roller (ϕ40 mm, hardness 40 degrees)

Results

In the above-mentioned condition, ink fixing operations were performed by using the arrangement of the printing unit and the fixing rollers in the typographic printing apparatus as shown in FIG. 27. The above-listed ink was directly applied to the recording paper. The ink was cured within 5 minutes when one of the two kinds of contacting members was used. No setoff or blocking occurred when the printed recording papers were laid one on another. Thus, a good fixation of ink was performed.

Test No.18

Ink Vehicle

1) Polymer (Rosin modified phenol resin)+Solvent (Dialen 168$^R$:#0-Solvent(H)=4:1)

2) Polymer (Rosin modified phenol resin)+Solvent (#AF7-Solvent:Dialen 168$^R$=1:4)

Recording Paper

1) Plain paper (Type 6200, Ricoh Corp.)

2) Synthetic paper (Peach Coat$^R$, Nisshinbo Industry Inc.)

Contacting Member A

1) Vinyl chloride Roller (ϕ30 mm, hardness 30 degrees)

2) Chloroprene rubber Roller (ϕ40 mm, hardness 20 degrees)

Results

In the above-mentioned condition, ink fixing operations were performed by using the arrangement of the printing unit and the fixing rollers in the stencil printing apparatus as shown in FIG. 28. Ink containing the above-listed vehicles as a component was directly applied to the recording paper. The ink containing the above-listed vehicle was cured within about 5 minutes when either one of the two kinds of contacting members was used. No setoff or blocking occurred when recording papers were laid one on another. Thus, a good fixation of ink was performed.

Test No.19

Ink 4-1) Print Gocco$^R$ Ink (Riso Ink (cyan)) (Riso Kagaku Corp.)

4-2) Print Gocco$^R$ Ink (Riso HM Ink (black)) (Riso Kagaku Corp.)

Recording Paper

Postcard

Contacting Member A

1) Vinyl chloride Roller (ϕ40 mm, hardness 50 degrees)

2) Chloroprene rubber Roller (ϕ40 mm, hardness 40 degrees)

Results

In accordance with the above-mentioned conditions, ink fixing operations were performed by using the Print Gocco$^R$ and the roller as shown in FIG. 29. The above-listed ink was directly applied to the recording paper. The ink was cured within about 5 minutes. No setoff occurred when the printed postcards were laid one on another. Thus, a good fixation of ink was performed.

Test No.20

Printing Plate Structure recording layer: Perfluoro-alkylaclyrate polymer LS317, emulsion copolymerization type, (Asahi Glass Co., Ltd.), thickness: 1 $\mu$m recording member substrate: Non-grazed PET film, size: 350×220 mm, thickness: 25 $\mu$m Ink (1) Waterless Offset Ink 1-1) Aqualess Super$^R$ KB, black, blue, red, yellow M (Toyo Ink Mfg Co., Ltd.)

1-2) Aqualess V$^R$ K2, black, blue, red, yellow M (Toyo Ink Mfg Co., Ltd.)

1-3) Aqualess Super$^R$ FC, black, blue, red, yellow Y XU (Toyo Ink Mfg Co., Ltd.)

1-4) New ALPO$^R$ G, black, blue, red, yellow, M (T&K Toka Co., Ltd)

1-5) Waterless S PL, black S (The Inktec Inc.)

1-6) Waterless S GT, black N (The Inktec Inc.)

(2) Ink Vehicle 2-1) Polymer (Rosin modified phenol resin)+Solvent (Dialen 168$^R$:#0-Solvent(H)4:1)

2-2) Polymer (Rosin modified phenol resin)+Solvent (#AF7-Solvent:Dialen 168$^R$=1:4)

Recording Paper

1) Plain paper (Type 6200, Ricoh Corp.)

2) Synthetic paper (Peach Coat$^R$, Nisshinbo Industry Inc.)

Contacting Member B

Silicone rubber Roller (ϕ20 mm, hardness 20 degrees) provided with one component RTV (Shin-Etsu chemical Co., Ltd.) of 1 mm thickness on an outer surface. The RTV was cured by maintaining at a room temperature for one half day.

Results

In accordance with the above-mentioned conditions, ink fixing operations were performed by using the arrangement shown in FIG. 25. All of the inks and vehicles were cured within about 10 seconds. No setoff or blocking occurred when the printed recording papers were laid one on another. Thus, a good fixation of ink was performed.

It should be noted that the printing plate used in this test had a surface characteristic in which a receding contact angle is decreased when the printing plate is in contact with a contact member such as a liquid or a solid generating a liquid under a heated condition, and the receding contact angle is increased when there is no contact with a contact member such as a liquid or a solid generating a liquid under a heated condition.

Test No.21

Ink (1) Waterless Offset Ink 1-1) Aqualess Super$^R$ KB, black, blue, red, yellow M (Toyo Ink Mfg Co., Ltd.)

1-2) Aqualess V$^R$ K2, black, blue, red, yellow M (Toyo Ink Mfg Co., Ltd.)

1-3) Aqualess Super$^R$ FC, black, blue, red, yellow Y XU (Toyo Ink Mfg Co., Ltd.)

1-4) New ALPO$^R$ G, black, blue, red, yellow, M (T&K Toka Co., Ltd)

1-5) Waterless S PL, black S (The Inktec Inc.)

1-6) Waterless S GT, black N (The Inktec Inc.)

(2) Offset Ink 2-1) F Gloss 85, black (Dainippon Ink & Chemicals Inc.)

2-2) Mater black (Nikken Chemical Laboratories)

(3) Ink Vehicle 3-1) Polymer (Rosin modified phenol resin)+Solvent (Dialen 168$^R$:#0-Solvent(H)=4:1)

3-2) Polymer (Rosin modified phenol resin)+Solvent (#AF7-Solvent:Dialen 168$^R$=1:4)

Recording Paper

1) Plain paper (Type 6200, Ricoh Corp.)

2) Synthetic paper (Peach Coat$^R$, Nisshinbo Industry Inc.)

Contacting Member B

Silicone rubber Roller (ϕ20 mm, hardness 20 degrees) provided with one component RTV (Shin-Etsu chemical Co., Ltd.) of 1 mm thickness on an outer surface. The RTV was cured by maintaining at a room temperature for one half day.

Results

In accordance with the above-mentioned conditions, ink fixing operations were performed by using the arrangement of the printing unit and the fixing rollers in the offset printing apparatus as shown in FIG. 26. The above-listed inks and vehicles were directly applied to the recording paper. All of the inks and vehicles were cured within about 10 seconds. No setoff or blocking occurred when the printed recording papers were laid one on another. Thus, a good fixation of ink or vehicle was performed.

Test No.22

Ink

Typographic Ink 3-1) Typographic Ink Graf-G, black (Dainippon Ink & Chemicals Inc.)

Recording Paper

1) Plain paper (Type 6200, Ricoh Corp.)

2) Synthetic paper (Peach Coat$^R$, Nisshinbo Industry Inc.)

Contacting Member B

Silicone rubber Roller (ϕ20 mm, hardness 20 degrees) provided with one component RTV (Shin-Etsu chemical Co., Ltd.) of 1 mm thickness on an outer surface. The RTV was cured by maintaining at a room temperature for one half day.

Results

In accordance with the above-mentioned conditions, ink fixing operations were performed by using the arrangement of the printing unit and the fixing rollers in the typographic printing apparatus as shown in FIG. 27. The above-listed ink was directly applied to the recording paper. The ink was cured within about 10 seconds. No setoff or blocking occurred when the printed recording papers were laid one on another. Thus, a good fixation of ink was performed.

Test No.23

Ink Vehicle

1) Polymer (Rosin modified phenol resin)+Solvent (Dialen 168$^R$:#0-Solvent(H)=4:1)

2) Polymer (Rosin modified phenol resin)+Solvent (#AF7-Solvent:Dialen 168$^R$=1:4)

Recording Paper

1) Plain paper (Type 6200, Ricoh Corp.)

2) Synthetic paper (Peach Coat$^R$, Nisshinbo Industry Inc.)

Contacting Member B

Silicon rubber Roller (ϕ20 mm, hardness 20 degrees) provided with one component RTV (Shin-Etsu chemical Co., Ltd.) of 1 mm thickness on an outer surface. The RTV was cured by maintaining at a room temperature for one half day.

Results

In accordance with the above-mentioned conditions, ink fixing operations were performed by using the arrangement of the printing unit and the fixing rollers in the stencil printing apparatus as shown in FIG. 28. Ink containing the above-listed vehicles as a component was directly applied to the recording paper. The ink containing the above-listed vehicle was cured within about 10 seconds. No setoff or blocking occurred when recording papers were laid one on another. Thus, a good fixation of ink was performed.

Test No.24

Ink 4-1) Print Gocco$^R$ Ink (Riso Ink (cyan)) (Riso Kagaku Corp.)

4-2) Print Gocco$^R$ Ink (Riso HM Ink (black)) (Riso Kagaku Corp.)

Recording Paper

Postcard

Contacting Member B

Silicon rubber Roller (ϕ20 mm, hardness 20 degrees) provided with one component RTV (Shin-Etsu Chemical Co., Ltd.) of 1 mm thickness on an outer surface. The RTV was cured by maintaining at a room temperature for one half day.

Results

In accordance with above-mentioned conditions, ink fixing operations were performed by using the Print Gocco$^R$ and the roller as shown in FIG. 29. The above-listed inks were directly applied to the recording paper. The inks were cured within about 10 seconds. No setoff occurred when the printed postcards were laid one on another. Thus, a good fixation of ink was performed.

Test No.25

Ink fixing operations were performed by using the following silicone rubber roller as a contacting member having a glossy surface. The conditions of the tests and apparatus structures were similar to that of the above-mentioned tests Nos.20 to 24. The amount of ink transferred was minimized, and any ink was cured within about 5 seconds. No setoff occurred when the printed postcards were laid one on another. Thus, a good fixation of ink was performed.

Test No.26

Ink Composition

Ink 1

Resin: Rosin denaturated phenol resin (Arakawa Chemical Industries Ltd.) 31 weight %

Solvent: Aliphatic hydrocarbon (Dialene 168$^R$) 51 weight %

Pigment: Carbonblack 18 weight %

Ink 2

Resin: Petroleum resin (Nippon Zeon Co., Ltd.) 31 weight %

Solvent: Aliphatic hydrocarbon (Dialen 168$^R$) 51 weight %

Pigment: Carbonblack 18 weight %

Ink 3

Resin: DCPD resin (Nippon Zeon co., Ltd.) 31 weight %

Solvent: Aliphatic hydrocarbon (#7AF) 51 weight %

Pigment: Carbonblack 18 weight %

Ink 4

Resin: Rosin ester resin (Arakawa Chemical Industries Ltd.) 31 weight %

Solvent: Aliphatic hydrocarbon (Dialen 168$^R$) 51 weight %

Pigment: Carbonblack 18 weight %

Contacting Solid Member

Plate member made of butyl rubber, chloroprene rubber, natural rubber, semi-natural rubber and olefin elastomer as a material having a swelling property with respect to a solvent contained in the ink. (A thickness of each plate member is about 1 mm.)

Plate member made of Cellsolve$^R$, oil absorbent paper and a porous teflon filter as a material having no swelling property but having permeability.

Plate member made of urethane rubber, fluoro rubber, NBR and etylene propylene as a material having no swelling property and no permeability.

Evaluation Method

Each ink was tempered by a hand roller made of fluoro carbon (Viton$^R$), and the tempered ink was applied onto art paper by rolling the hand roller. Immediately after that, the above-mentioned contacting member was put in contact with the inked art paper for a predetermined time. After the predetermined time elapsed, the contacting member was separated. The fixation of the ink was evaluated by wiping the ink surface by a cloth.

Evaluation Results

The results of evaluation are shown in Table 12 which indicate that only the ink having a swelling property is fixed.

TABLE 12

Contact Cure Test Result

| Contacting member | P | S | Ink 1 | Ink 2 | Ink 3 | Ink 4 |
|---|---|---|---|---|---|---|
| Butyl Rubber | *** | yes | H | H | H | H |
| Chloroprene Rubb. | *** | yes | H | H | H | H |
| Natural Rubber | *** | yes | H | H | H | H |
| Semi-natu. Rubb. | *** | yes | H | H | H | H |
| Olefin Elastomer | *** | yes | H | H | H | H |
| Cellsolve ® | yes | no | L | L | L | L |
| Oil Abso. Paper | yes | no | L | L | L | L |
| Porous Tef. Filter | yes | no | L | L | L | L |
| Urethane Rubber | no | no | N | N | N | N |
| Fluoro Rubber | no | no | N | N | N | N |

TABLE 12-continued

| Contact Cure Test Result | | | | | | |
|---|---|---|---|---|---|---|
| Contacting member | P | S | Ink 1 | Ink 2 | Ink 3 | Ink 4 |
| NBR | no | no | N | N | N | N |
| Ethylene Propylene | no | no | N | N | N | N |

P . . . permeability
S . . . swelling property
H . . . cured
L . . . little cured
N . . . no cure Test No.27

Ink Composition

Ink 1

Resin: Rosin denaturated phenol resin (Arakawa Chemical Industries Ltd.)
31 weight %

Solvent: Aliphatic hydrocarbon (Dialene 168$^R$)
51 weight %

Pigment: Carbonblack
18 weight %

Contacting Solid Member

Plate members made of butyl rubber having a thickness of 1 mm are used. One of the plate members had an extremely rough surface, and the other one of plate members had a relatively glossy surface.

Evaluation Method

Each ink was tempered by a hand roller made of fluoro carbon (Viton$^R$), and the tempered ink was applied onto an art paper by rolling the hand roller. Immediately after that, the above-mentioned contacting member was put in contact with the art paper for a predetermined time. After the predetermined time elapsed, the contacting member was separated. The fixation of the ink was evaluated by wiping the ink surface by a cloth.

Evaluation Results

The results of evaluation are shown in Table 13. As indicated in Table 13, the butyl rubber (rough surface) having a permeability with respect to the ink was cured. However, when the cure was not complete, the ink adhered onto the contacting member which resulted in a decrease in concentration of the ink.

TABLE 13

| Contacting Member | Contacting Time 5 sec | Contacting Time 15 sec | Contacting Time 30 sec |
|---|---|---|---|
| Butyl Rubber | AC | C | C |
| (glossy surface) | NA | NA | NA |
| Butyl Rubber | AC | C | C |
| (rough surface) | A | SA | NA |

AC . . . Ink was almost cured.
C . . . Ink was cured.
NA . . . Ink did not adhere onto the contacting member.
SA . . . Small amount of ink adhered onto the contacting member.
A . . . Ink adhered onto the contacting member.

Test No.28

Ink Composition

Ink 1

Resin: Rosin denaturated phenol resin (Arakawa Chemical Industries Ltd.)
31 weight %

Solvent: Aliphatic hydrocarbon (#0-solvent)
51 weight %

Pigment: Carbonblack
18 weight %

Contacting Solid Member

Plate member made of butyl rubber, chloroprene rubber, natural rubber, semi-natural rubber and olefin elastomer as a material having a swelling property with respect to a solvent contained in the ink. (A thickness of each plate member is about 1 mm.)

Evaluation Method

Each ink was tempered by a hand roller made of fluoro carbon (Viton$^R$), and the tempered ink was applied onto art paper by rolling the hand roller. Thereafter, the art paper was placed on a hot plate, and was put in contact with a contacting solid member for a predetermined time while being heated. After the predetermined time elapsed, the contacting member was separated. The fixation of the ink was evaluated by wiping the ink surface by a cloth.

Evaluation Results

The results of evaluation are shown in Table 14. As indicated in Table 14, a curing time of the ink for any contacting member was reduced by heating.

TABLE 14

| Contacting Member | Heating Temp. 25° | Heating Temp. 45° C. | Heating Temp. 60° C. |
|---|---|---|---|
| Butyl Rubber | 8 sec. | 5 sec. | 1 sec. |
| Chloroplene Rubb. | 15 sec. | 8 sec. | 1 sec. |
| Natural Rubber | 5 sec. | 3 sec. | 1 sec. |
| Semi-natural Rubb. | 5 sec. | 3 sec. | 1 sec. |
| Olefin Elastomer | 8 sec. | 5 sec. | 1 sec. |

Test No.29

Ink Composition

Ink 1

Resin: Rosin denaturated phenol resin (Arakawa Chemical Industries Ltd.)
31 weight %

Solvent: Aliphatic hydrocarbon (#0-solvent)
51 weight %

Pigment: Carbonblack
18 weight %

Contacting Solid Member

Plate member made of butyl rubber, chloroprene rubber, natural rubber, semi-natural rubber and olefin elastomer as a material having a swelling property with respect to a solvent contained in the ink. (A thickness of each plate member is about 1 mm.)

Evaluation Method

Each ink was tempered by a hand roller made of fluoro carbon (Viton$^R$), and the tempered ink was applied onto art paper by rolling the hand roller. Thereafter, the art paper was placed in a refrigerator to be cooled. After cooling, the above-mentioned contacting member was put in contact with the art paper for a predetermined time. After the predetermined time elapsed, the contacting member was separated. The fixation of the ink was evaluated by wiping the ink surface with a cloth.

Evaluation Results

The results of evaluation are shown in Table 15. As indicated in Table 15, a curing time of the ink for any contacting member was reduced by cooling.

TABLE 15

| Contacting Member | Cooling Temp. 25° | Cooling Temp. 10° C. | Cooling Temp. 5° C. |
|---|---|---|---|
| Butyl Rubber | 8 sec. | 5 sec. | 1 sec. |
| Chloroplene Rubb. | 15 sec. | 8 sec. | 1 sec. |
| Natural Rubber | 5 sec. | 3 sec. | 1 sec. |
| Semi-natura1 Rubb. | 5 sec. | 3 sec. | 1 sec. |
| Olefin Elastomer | 8 sec. | 5 sec. | 1 sec. |

Test No.30

Ink Composition

Ink 1

Resin: Rosin denaturated phenol resin (Arakawa Chemical Industries Ltd.)
31 weight %

Solvent: Aliphatic hydrocarbon (#0-solvent)
51 weight %

Pigment: Carbonblack
18 weight %

Contacting Solid Member

A roller member made of silicone is used as a member having a swelling property with respect to ink.

Evaluation Method

Each ink was tempered by a hand roller made of fluoro carbon (Viton$^R$), and the tempered ink was applied onto art paper by rolling the hand roller. Thereafter, the silicone rubber roller was rolled on the art paper so that the silicone roller contacted the ink. After that, the contacting member was separated. The fixation of the ink was evaluated by wiping the ink surface by a cloth.

Evaluation Results

The ink did not adhere to the silicone roller when the silicone roller was rolled on the art paper even when the cure was not complete. The ink was cured rapidly.

Test No.31

Ink Composition

Ink 1

Resin: DCPD resin (Nippon Zeon co., Ltd.)
60 weight %

Solvent: Aliphatic hydrocarbon (#0-solvent)
22 weight %

Pigment: Carbonblack
18 weight %

Ink 2

Resin: DCPD resin (Nippon Zeon co., Ltd.)
41 weight %

Solvent: Aliphatic hydrocarbon (#0-solvent)
41 weight %

Pigment: Carbonblack
18 weight %

Contacting Solid Member

A roller member made of silicone was used as a member having a swelling property with respect to ink. A silicone rubber roller having a surface roughness of 0.5 $\mu$m was prepared as a glossy surface, and a silicone rubber roller having a surface roughness of 10 $\mu$m was prepared as a rough surface member.

Evaluation Method

Each ink was tempered by a hand roller made of fluoro carbon (Viton$^R$), and the tempered ink was applied onto art paper by rolling the hand roller. Thereafter, the silicone rubber roller was rolled on the art paper so that the silicone roller contacted the ink. After that, the contacting member was separated. The fixation of the ink was evaluated by wiping the ink surface by a cloth.

Evaluation Results

Table 16 shows the results of evaluation. As shown in table 16, the ink was cured without ink adhering onto the contacting member by providing a glossy surface to the silicone rubber roller even when a soft ink was used.

TABLE 16

| Contacting Member | Ink 1 (hard) | Ink 2 (soft) |
|---|---|---|
| Silicon Roller | NA | A |
| (rough surface) | C | C |
| Silicon Roller | NA | NA |
| (glossy surface) | C | C |

NA . . . Ink did not adhere on the contacting member.
A . . . Ink adhered on the contacting member.
C . . . Ink was cured.

Test No.32

Ink Composition

Aqualess Super$^R$ KB, black, blue, red, yellow M (Toyo Ink Mfg Co., Ltd.)

New ALPO$^R$ G, black, blue, red, yellow, M (T&K Toka Co., Ltd)

Printing Plate

Waterless offset plate

Contacting Solid Member

A roller member made of silicone was used as a member having a swelling property with respect to a solvent contained in ink. (The surface roughness was 0.5 $\mu$m. The diameter of the roller was 150 mm. Hardness of the silicone rubber was 20 degrees.)

Recording paper

Art paper

Evaluation Method

The silicone rubber roller was provided at an eject section in the recording apparatus shown in FIG. 32. A commercially available offset printer (Ricoh type 1310) was modified. The above-mentioned ink was printed in the form of 1 cm×1 cm solid pattern. The fixation of the ink was evaluated by wiping the print surface by a cloth.

Evaluation Results

The ink on the recording paper was sufficiently cured by operating the ink fixing unit at a printing speed of 40 ppm/A4.

Test No.33

Ink Composition

Print Gocco$^R$ Ink (Riso Kagaku Corp.)

Printing Plate

Print Gocco$^R$ Master

Contacting Solid Member

A roller member made of silicone is used as a member having a swelling property with respect to a solvent contained in ink. (The surface roughness was 0.5 $\mu$m. The diameter of the roller was 150 mm. Hardness of the silicone rubber was 20 degrees.)

Recording paper

Postcard

Evaluation Method

An exclusive ink fixing apparatus was prepared by arranging the fixing unit as shown in FIG. 30. The above-mentioned ink was printed in the form of a 1 cm×1 cm solid pattern. The printed postcard was passed through the ink fixing apparatus 5 minutes after printing. The fixation of the ink was evaluated by wiping the print surface by a cloth after the postcard had passed the exclusive ink fixing apparatus.

Evaluation Results

The ink on the recording paper was sufficiently cured by operating the ink fixing apparatus so that the postcard is passed through the exclusive ink fixing apparatus at a speed of 5 mm/sec.

Test No.34

Ink Composition

Commercially available offset ink Gloss 85, black (Dainippon Ink & Chemicals Inc.)

Printing Plate

Pink Master

Contacting Solid Member

A roller member made of silicone was used as a member having a swelling property with respect to a solvent contained in ink. (The surface roughness was 0.5 μm. The diameter of the roller was 40 mm. Hardness of the silicone rubber was 20 degrees.)

Recording paper

Wood free paper

Evaluation Method

Twenty silicone rubber rollers were provided at an eject section in the recording apparatus shown in FIG. 38. A commercially available offset printer (Ricoh type 1310) was modified. The above-mentioned ink was printed in the form of 1 cm×1 cm solid pattern. The fixation of the ink was evaluated by wiping the print surface by a cloth.

Evaluation Results

The ink on the recording paper was sufficiently cured by operating the ink fixing unit at a printing speed of 140 ppm/A4. The fixation of the ink was achieved at a higher speed than the test No.21

Test No.35

Ink Composition

Aqualess Super$^R$ KB, black, blue, red, yellow M (Toyo Ink Mfg Co., Ltd.)

New ALPO$^R$ G, black, blue, red, yellow, M (T&K Toka Co., Ltd)

Printing Plate

Waterless offset plate

Contacting Solid Member

A belt-like member made of silicone was used as a member having a swelling property with respect to a solvent contained in ink. (surface roughness: 0.5 μm, thickness of the belt: 3 mm, hardness of the silicone rubber: 20 degrees, diameter of roller for moving belt: 30 mm, distance between rollers; 200 mm)

Recording Paper

Fine coating paper

Evaluation Method

The silicone rubber belt was provided at an eject section in the recording apparatus which was modified using a commercially available offset printer (Ricoh type 1310). The above-mentioned ink was printed in the form of a 1 cm×1 cm solid pattern. The fixation of the ink was evaluated by wiping the print surface by a cloth.

Evaluation Results

The ink on the recording paper was sufficiently fixed by operating the ink fixing unit at a printing speed of 70 ppm/A4.

Test No.36

Ink Composition

Aqualess Super$^R$ KB, black, blue, red, yellow M (Toyo Ink Mfg Co., Ltd.)

New ALPO$^R$ G, black, blue, red, yellow, M (T&K Toka Co., Ltd)

Printing Plate

Waterless offset plate

Contacting Solid Member

A roller member made of silicone was used as a member having a swelling property with respect to a solvent contained in ink. (surface roughness: 0.5 μm, hardness of the silicone rubber: 20 degrees, diameter of the roller: 150 mm)

recording paper

Art paper

Heating Device for Contacting Member

A hollow silicone rubber roller provided with a heater therein. (corresponds to a fixing unit of a regular paper copy machine) Setting temperature for heating was 60° C.

Evaluation Method

The silicone rubber roller and the heater were provided, as shown in FIG. 40, at an eject section in the recording apparatus which was modified using a commercially available offset printer (Ricoh type 1310). The heater was placed in contact with the contacting member after the print was performed. The rollers were mutually rolled for 5 minutes. The above-mentioned ink was printed in the form of 1 cm×1 cm solid pattern. The fixation of the ink was evaluated by wiping the print surface with a cloth.

Evaluation Results

The ink on the recording paper was sufficiently fixed by operating the recording apparatus at a printing speed of 40 ppm/A4. When heat was not applied, the fixing ability was decreased after 50 repetitions of 1,000 pieces from the printing operations. However, there was no problem, when heat was applied, after 100 repetition of 1,000 pieces from the printing operations.

A description will now be given of a resin layer forming apparatus according to the present invention. The resin layer forming apparatus is used for applying a thin resin layer on a printed surface so as to protect the printed surface. The resin layer may be formed for providing a water-proof function or a desired surface finish to the print surface.

(Description of Twenty-fourth Embodiment)

Figure 43:
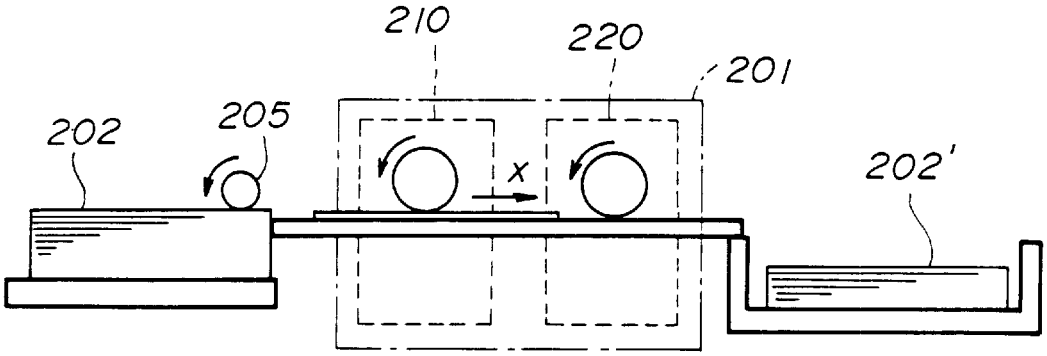
FIG. 43 is an illustration of a resin layer forming apparatus according to a twenty-fourth embodiment of the present invention.

FIG. 43 is an illustration of a resin layer forming apparatus according to the twenty-fourth embodiment of the present invention. In FIG. 43, a reference numeral 201 indicates a resin layer forming unit; 202 indicates a recording medium (recording paper); 202' indicates a laminated recording paper; 205 indicates a feed roller; 210 indicates means for supplying resin liquid; and 220 indicates means for curing resin liquid. The recording paper 202 is conveyed in a direction indicated by an arrow X.

Figure 44A:
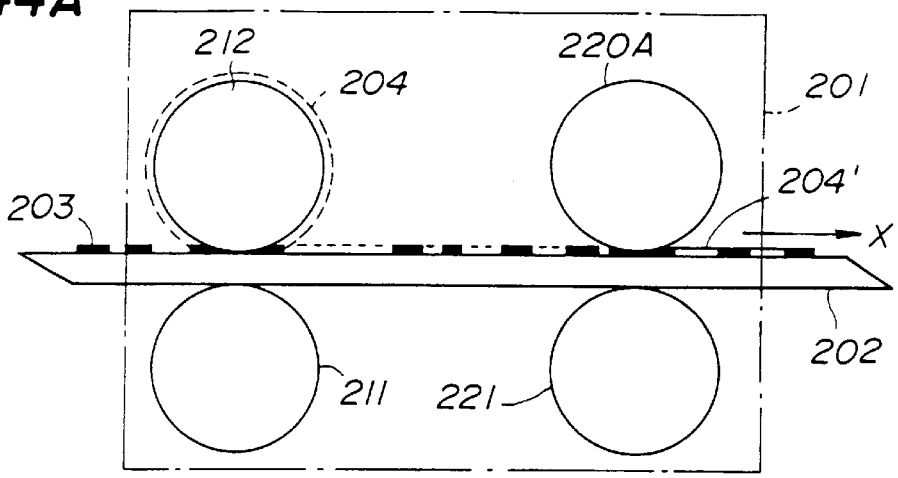
FIGS. 44A, 44B and 44C are illustrations for explaining various resin layer forming methods applicable to the resin layer forming apparatus shown in FIG. 43.
Figure 44B:
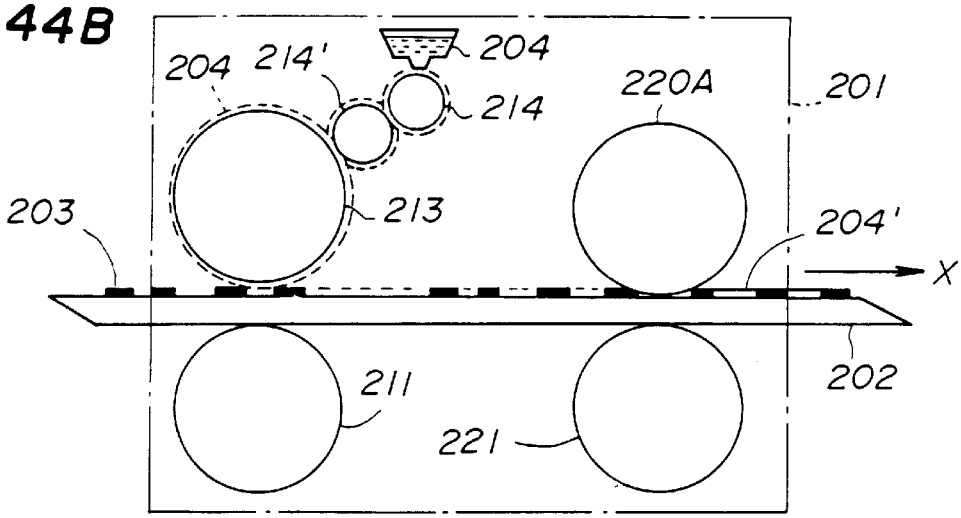
Figure 44C:
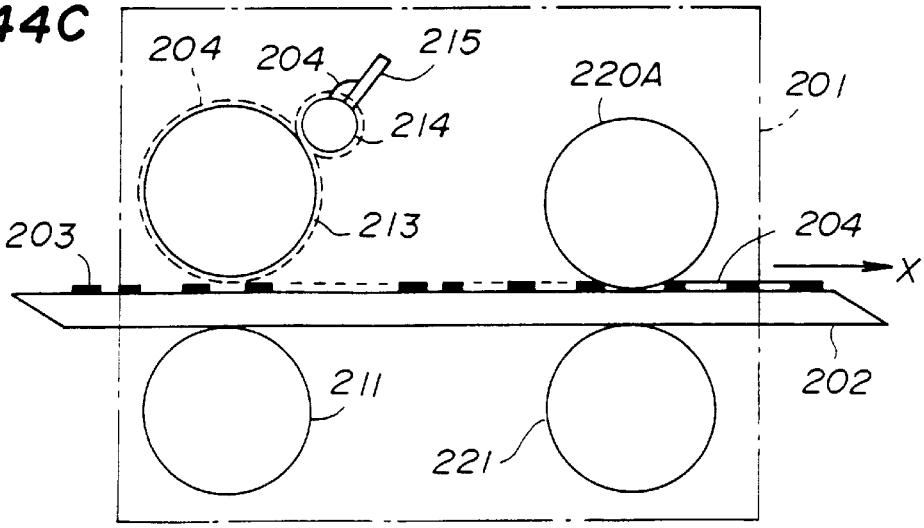

FIGS. 44A to 44C are illustrations for explaining various resin layer forming methods applicable to the resin layer forming apparatus shown in FIG. 43. FIG. 44A shows a method using a porous member impregnated with the resin liquid as a method for applying the resin liquid. FIG. 44B shows a method in which a thin layer of the resin liquid is applied by multiple-stage rollers. FIG. 44C shows a method in which a thin layer of the resin liquid is formed by a blade provided to a first roller so as to transfer the thin layer to a second roller.

In FIGS. 44A to 44C, a reference numeral 203 indicates ink; 204 indicates a resin liquid; 204' indicates a resin layer (after curing or being cured); 211 indicates a pressing roller; 212 indicates a porous member impregnated with resin liquid; 213, 214 and 214' indicate rubber rollers; 215 indicates a blade; 220A indicate a contacting member; and 221 indicates a pressing roller.

In the resin layer forming apparatus according to the present embodiment, a thin layer of the resin liquid is formed on the printed surface of the recording medium such as a recording paper. Thereafter, the contacting member 220A is placed in contact with the thin layer of the resin liquid so as to cure the resin liquid so that a thin resin layer is formed on the printed surface.

An outline of a process performed in the resin layer forming apparatus according to the present embodiment is shown in FIG. 43. In the process, the printed recording paper 2 is fed to the resin liquid applying means 210 by the feed roller 205. The resin liquid is coated on the printed surface of the recording paper 202. Then, the coated recording paper 202 is conveyed to the resin liquid curing means 220 where the coated resin liquid is cured by being placed in contact with the contacting member 220A. Lastly, the recording paper 202' which is coated with the resin is ejected from the apparatus.

As for the resin liquid used in the present embodiment, a conventional over print varnish such an oxidative polymerization drying type over print varnish, a solvent type over print varnish or an ultraviolet curing type over print varnish can be used. Additionally, a resin, a solvent or a oil contained in print ink may also be used. Examples of the resin are; a natural resin such as rosin, shellac or gilsonite and a natural resin derivative such as rosin ester, maleic resin or fumaric resin. Additionally, as a synthetic resin and others, there is a phenol resin such as a rosin denaturated phenol, an alkyd resin (fatty acid denaturated polyester resin), a petroleum resin such as an aromatic or aliphatic hydrocarbon resin, an acrylic resin, a polyester resin, a polyamide resin, a cyclized rubber, a chlorinated rubber, a urea resin and a melamine resin, a ketone resin, a polyvinyl chloride, a vinyl chloride-polyvinyl acetate copolymer resin, an epoxy resin, a polyurethane resin an a nitrocellulose.

As an example of the oil, vegetable oil such as linseed oil, china wood oil, soybean oil or castor oil can be used. Additionally, copolymer oil or waterless castor oil may be used. Further, processed oil or mineral oil such as malein oil, urethan oil or vinyl oil may be used.

As an example of the solvent, a fatty acid hydrocarbon such as petroleum solvent, alcohol, ester, ketone or glycol can be used. It should be noted that various kinds of additives such as plasticizer, wax, dryer, dispersant, thickener, gelatinizer, antistatic agent or lubricant may be added to the above-mentioned resin liquid.

A ratio of a weight of the resin to a weight of the resin liquid is preferably 5%–90%. Viscosity of the resin liquid can range from 5 cp to $10^6$ cp. However, considering a curing time of the resin liquid, one having a high-viscosity is preferred. Additionally, the thickness of the resin layer is preferably 0.5 to 100 $\mu$m. considering the curing time of the resin liquid, a thin layer is preferred. When the resin liquid having a low viscosity is used, the thickness of the resin layer can be in the range of 0.1 to 2 $\mu$m. In such a case, since a large amount of solvent is contained in the resin liquid, it is preferred to let a few seconds to a few tens of seconds pass before the contacting member is placed in contact with the resin liquid. Thus, in this case, the time required for forming a resin layer is increased. When a resin liquid having a high viscosity is used, the thickness of the resin layer can be in a large range from 1 $\mu$m to 100 $\mu$m. Thus, the curing time of the resin liquid can be reduced.

With respect to the dissolved state of the solvent and the resin, in order to reduce the curing time of the resin liquid, it is better that the resin is swollen by the solvent or the resin is dispersed in the solvent rather than a state where the resin is completely dissolved in the solvent. It should be noted that the soluble state of the resin and the solvent is varied by a combination of a resin and a solvent and a volumetric percentage of the resin and the solvent. Thus, it is better to determine the composition of the resin liquid based on a printing method and a recording paper, a necessary curing time and other various conditions. Additionally, as the solvent, a liquid which dissolves the resin in the resin liquid and becomes a component of the resin liquid is used. An oil or petroleum solvent is typically used for the solvent. However, the solvent to be used may be varied according to applications.

With respect to the means for applying the resin liquid to the printed surface, a porous member, such as a sponge, a cloth or a paper, which is impregnated with the resin liquid can directly contact the printed surface as shown in FIG. 44A. Additionally, a thin layer of the resin liquid may be applied to the printed surface by using multi-stage rollers as showed in FIG. 44B. Further, as shown in FIG. 44C, a thin layer of the resin liquid may be formed on a first roller, and then the thin layer may be transferred to a second roller so as to consequently transfer the thin layer of the resin liquid to the printed surface. Additionally, in a case where the printed material is large material, such as a wall paper or a poster, the resin liquid may be applied by a paint brush, a hand roller or a squeegee. The resin layer is preferably transparent and colorless. However, the resin layer may be slightly colored by adding a coloring agent such as dye or pigment if necessary.

As the contacting solid member, natural rubber, semi-natural rubber, olefin elastomer, butyl rubber or chloroprene rubber is preferable. With respect to the method for making the contacting material contact the printed surface, the contacting material may be formed in a roller-like shape, an arc-like shape or a plate-like shape.

The inventors found that the resin liquid is cured rapidly by being contacted with a contacting solid member made of one of the materials listed above. This is because separation of the solvent from the resin is remarkably promoted when the contacting solid member contacts the resin liquid. Additionally, it was found that the resin liquid did not adhere to the contacting solid member after the resin liquid was cured and the contacting solid member was separated from the resin layer. Further, it was found that when a contacting solid member having no swelling property but having permeability with respect to a solvent is placed in contact with the resin liquid layer, the ink resin was not or substantially not cured during a long contact time of about 3 minutes. Additionally, when the contacting solid member was separated from the ink after the resin liquid was cured to a certain degree, the resin liquid adhered on the surface of the contacting solid member. This decreases smoothness of the surface of the resin layer formed on the printed surface which results in deterioration of an image quality and a large decrease in the protection of the printed surface. Further, in the case of a contacting solid member having no swelling property and permeability with respect to the solvent, it was found that the resin liquid was not cured for a contacting time as long as about 10 minutes.

The present embodiment utilizes the above-mentioned phenomena which is the same as the phenomena described in the above-mentioned eleventh embodiment which is directed to rapidly curing ink on a recording paper. That is, the resin liquid related to the present embodiment is considered to correspond to the vehicle contained in the ink related to the eleventh embodiment.

Accordingly, various methods for reducing the curing time of ink described in the above-mentioned twelfth to twenty-third embodiments can be applied to the present embodiment so as to further shorten the curing time of the resin liquid.

One of the methods is to provide a plurality of contacting members so as to substantially increase the period for contacting the contacting solid member with the resin liquid.

Another method is to cool the resin liquid as is described in the above-mentioned seventeenth and eighteenth embodiments. The structure of a cooling device and the effect of the cooling can be appreciated by substituting the resin liquid for the ink or the vehicle in the seventeenth and eighteenth embodiments.

Figure 45:
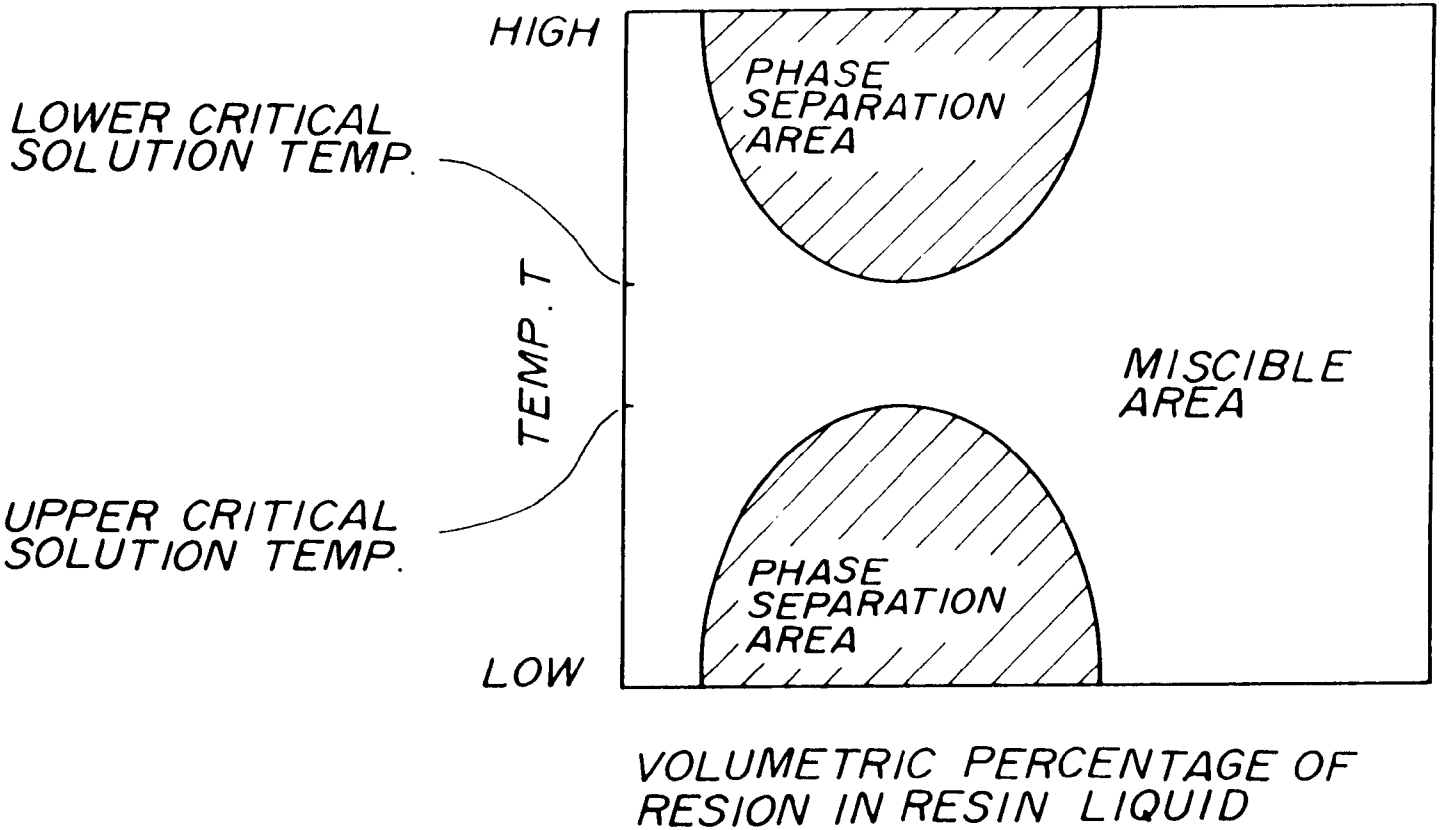
FIG. 45 is a graph showing a correlation of miscibility between a resin and a solvent dissolving the resin contained in the resin liquid.

Similar to the ink and the vehicle mentioned in the previous embodiments, the resin liquid related to the present embodiment has an upper critical solution temperature as shown in a graph of FIG. 45. The resin and the solvent contained in the resin liquid are separated from each other when the temperature of the resin liquid is decreased below the upper critical solution temperature.

Figure 46:
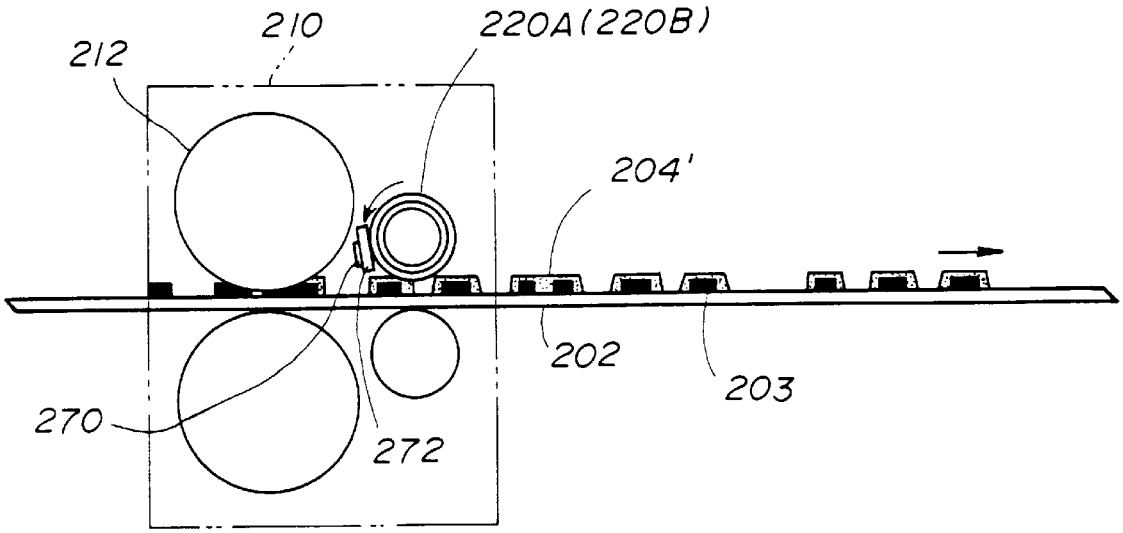
FIG. 46 is an illustration of an example of a structure for cooling a resin liquid.

FIG. 46 shows an example of a structure for cooling the resin liquid. In FIG. 46, a surface of the solid member 220A is cooled by a cooling device which comprises a Peltier element 270 and a heat conductive member 272. The cooling device is positioned very close to the contacting solid member 220A so as to cool the surface of the contacting solid member. The contacting member can be cooled by other conventional methods. For example, the surface of the contacting member may be cooled by blowing cooled air to the surface of the contacting member. Cooled air or coolant may be introduced into an interior of the contacting member, or a Peltier element may be placed inside the contacting member so as to cool the contacting member from inside.

A further method to reduce the curing time of the resin liquid is to heat the resin liquid as is described in the above-mentioned fifteenth and sixteenth embodiment. The structure of a heating device and the effect of the heating can be appreciated by substituting the resin liquid for the ink or the vehicle in the fifteenth and sixteenth embodiments.

Similar to the ink and the vehicle mentioned in the previous embodiments, the resin liquid related to the present embodiment has a lower critical solution temperature as shown in the graph of FIG. 45. The resin and the solvent contained in the resin liquid are separated from each other when the temperature of the resin liquid is increased above the upper critical solution temperature.

Figure 47:
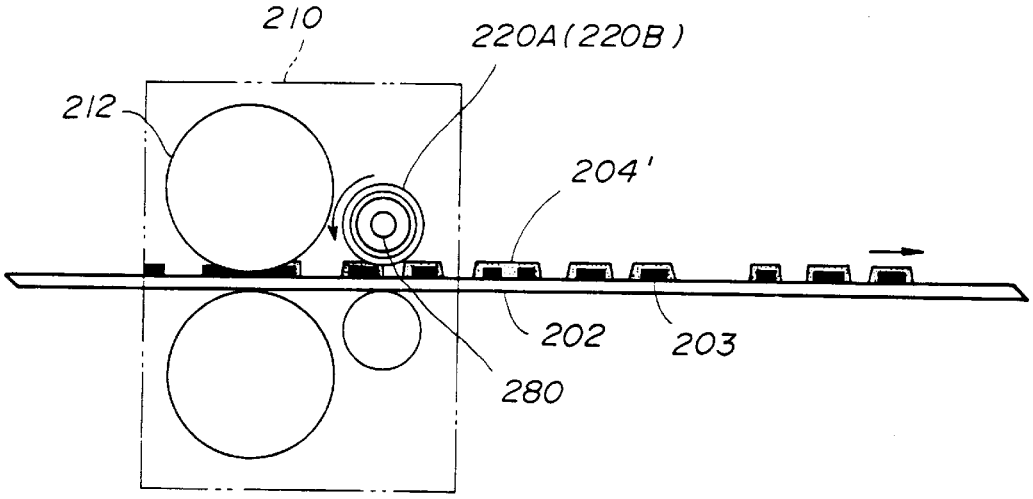
FIG. 47 is an illustration of an example of a structure for heating the resin liquid.
Figure 48:
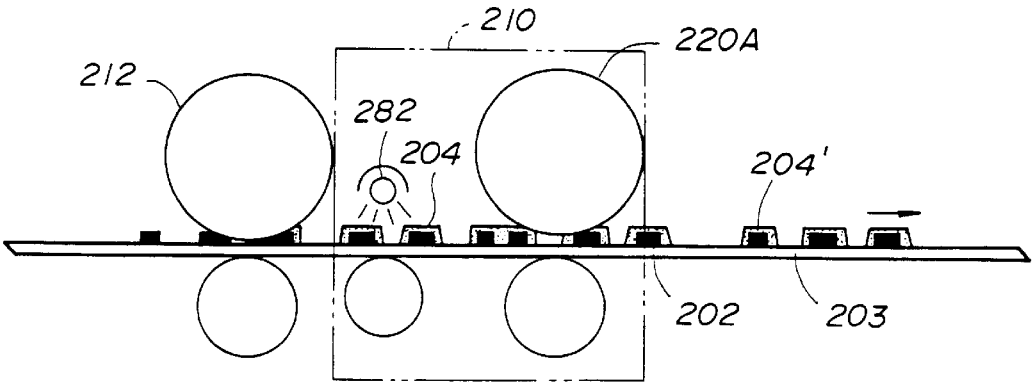
FIG. 48 is an illustration of another example of a structure for heating the resin liquid.

FIGS. 47 and 48 show examples of a structure for heating the resin liquid. In the example of FIG. 47, the contacting solid member 220A is heated by a heater 280 provided inside the contacting member formed as a roller. A surface of the contacting solid member may be heated by a lamp emitting an infrared ray. In the example of FIG. 48, a heat source 282 is provided between the resin liquid applying roller 212 and the contacting solid member 220A. The resin liquid 204 is heated in a noncontact manner by the heat source 382 before the contacting solid member 220A is contacted with the resin liquid 204. The heat source 282 may be a conventional heating device such as a heater, a lamp emitting an infrared ray or a hot air blower.

It should be noted that, in the present embodiment, a pulp paper, a coated paper or a synthetic paper can be used as well as other materials such as an OHP film, a plastic member or a metal member.

(Description of Twenty-fifth Embodiment)

This embodiment corresponds to the resin layer forming apparatus according to twenty-fourth embodiment in which the contacting solid member is made of a silicone resin. The inventor investigated various solid members having a swelling property, and found that a silicone resin has a particular superiority among them.

The silicone resin has a shorter curing time among contacting solid members. Additionally, the silicone resin does not allow adherence of the resin liquid on the surface thereof when the contacting solid member made of the silicone resin is separated in a state where the resin liquid has not completely cured yet, whereas other solid member materials allow adherence of a small amount of resin liquid on the surface thereof when they are separated from the resin layer when the resin liquid has not completely cured yet. That is, it can be said that the silicone resin provides the highest reliability when a method for fixing the resin liquid is performed. It is assumed that a low surface energy of the silicone resin and formation of an extremely thin silicone oil layer on the silicone resin as indicated by WBFL theory contribute to the lack of adherence of the ink onto the silicone resin, when the silicone resin is separated from the resin liquid in a state where the resin liquid has nct completely cured. There are some other materials having a low surface energy such as a fluororesin. However, the fluororesin does not provide a good effect since the fluororesin lacks a swelling property with respect to a solvent contained in the resin liquid. Accordingly, the silicone resin has a unique property in that no resin liquid adheres thereto and it has a swelling property with respect to a solvent contained in the resin liquid. Thus, reliability of fixation of the resin liquid is remarkably increased by using the silicone resin.

The silicone resin to be used may be any one of a crosslinking material and a vulcanized material such as a chain polymer having a siloxene structure as a unit, a branching polymer or heat vulcanized silicone rubber. Additionally, any one of dimethyl, methyl vinyl and methyl vinyl phenyl denaturated silicone resins may be used. The silicone resin may be in the form of a rigid member, an elastic member such as rubber or a semi-solid such as a gel. Additionally, an elastic member containing a silicone resin also provides superior results. Further, when a crosslinking type silicone resin is used, the one which has a low crosslinking density is more preferable since it is superior in swelling property with respect to a solvent.

(Description of Twenty-sixth Embodiment)

Figure 49A:
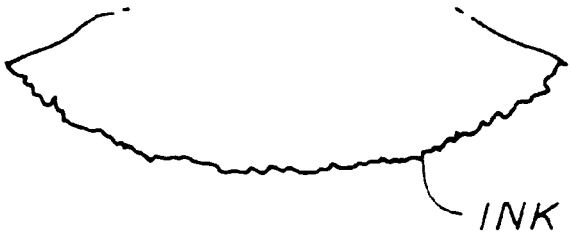
FIG. 49A is an illustration of a surface of a roller having a rough surface.
Figure 49B:
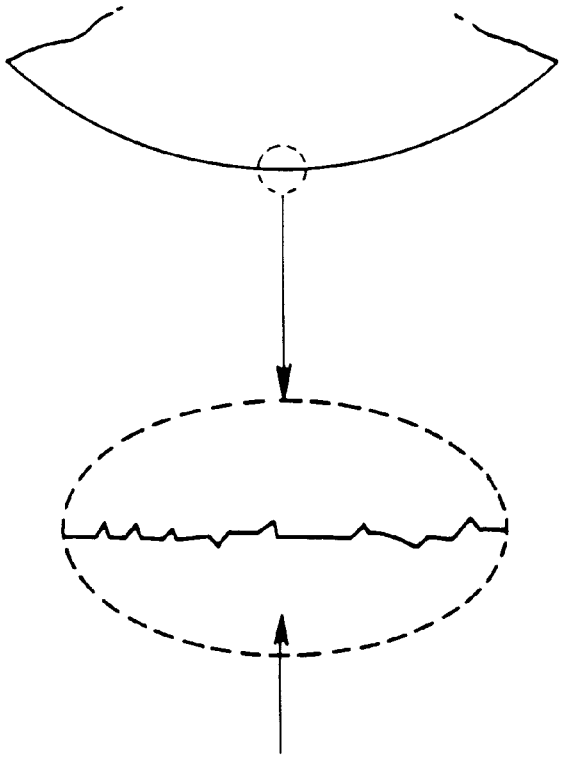
FIG. 49B is a surface of a roller having a glossy surface.

This embodiment corresponds to the resin layer forming apparatus according to one of the twenty-fourth and twenty-fifth embodiments in which the surface of the contacting solid member is formed as a glossy surface. If the surface of the contacting solid member is rough as shown in FIG. 49A, the ink penetrates into the a recess of the surface when the contacting solid member is contacted with the resin liquid. Thus, a surface roughness of the resin layer after curing may be increased since a part of the resin liquid on the recording paper is caught by the contacting solid member. In order to eliminated this problem, the surface of the solid member is preferably formed as a glossy surface as shown in FIG. 49. The glossy surface herein refers to a surface having a 10-point average roughness of 2 $\mu$m or less.

(Description of Twenty-seventh Embodiment)

This embodiment is related to a resin layer forming apparatus in which a thin resin layer is formed on a printed surface of a recording paper by applying a resin liquid onto the printed surface and thereafter a contacting liquid is contacted with the resin liquid so as to rapidly cure the resin liquid.

The inventors of the present invention found that separation of a resin in the resin liquid from a solvent is remarkably promoted when the contacting liquid is put in contact with the resin liquid, and a fixing time of the resin liquid is shortened from a period as short as a few tens of milliseconds to five minutes.

Additionally, when the contacting liquid is placed in contact with a colored or transparent resin liquid, the resin and the solvent in the vehicle are immediately separated from each other, and the resin is formed like a film. This phenomenon appears in a state where the resin is completely or almost completely dissolved in the solvent as well as in a state where the resin is swollen by the solvent or the resin and the solvent are dissolved with each other almost in a state where the resin is dispersed in the solvent. Thus, the present invention provides a completely different and novel resin liquid fixing me thod as compared to a conventional resin layer forming method.

It should be not ed that as the contacting liquid, a liquid is preferred which is miscible with the solvent and has a molecular weight sufficiently greater than a molecular weight of the solvent contained in the resin liquid. The molecular weight of the contacting liquid should preferably be ten times or more of the molecular weight of the solvent contained in the resin liquid. For example, an oil such as a mineral oil or an engine oil or a grease may be used as the contacting liquid. The miscibility of the contacting liquid with the resin is preferably zero or close to zero. However, if a time needed for separation of the resin from the solvent is sufficiently shorter than a time needed for dissolving the resin in the solvent, the contacting liquid may be slightly miscible with the resin.

Figure 50B:
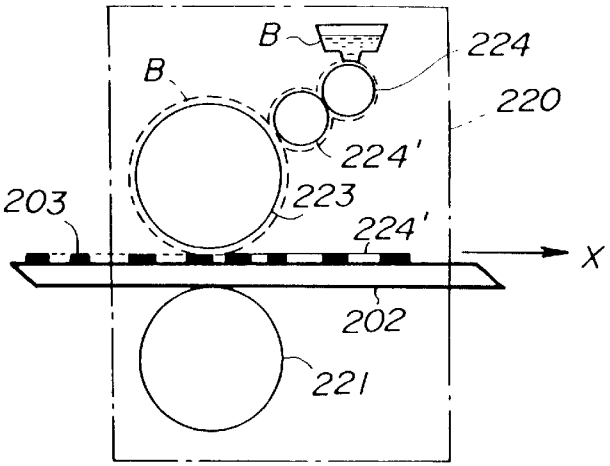
FIG. 50B is an illustration of an example of a structure for applying the resin liquid by a multi-stage rollers.
Figure 50D:
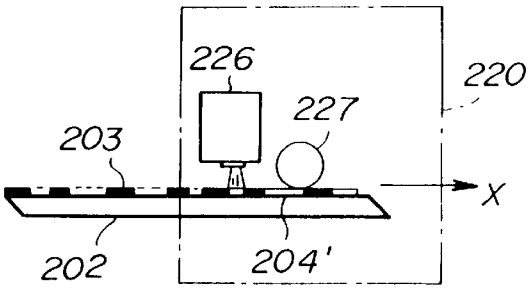
FIG. 50D is an illustration of an example of a structure for applying the resin liquid in a non-contact manner.
Figure 50A:
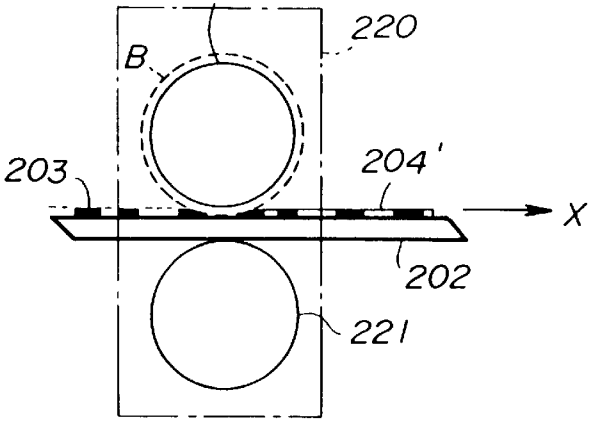
FIG. 50A is an illustration of an example of a structure for applying the resin liquid by a porous material formed as a roller.
Figure 50C:
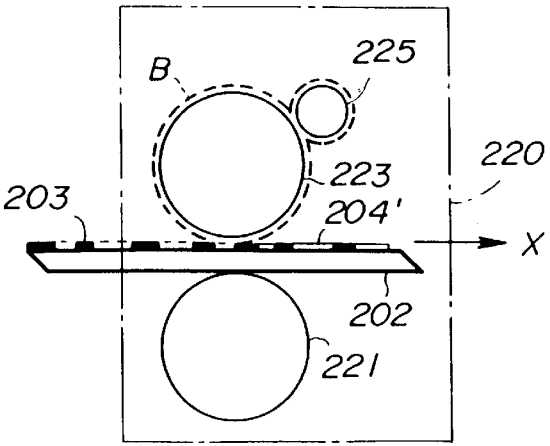
FIG. 50C is an illustration of an example of a structure for applying the resin liquid by a porous member contacting a roller.

As a method for supplying the contacting liquid, the contacting liquid may be directly contacted to a surface of the recording paper, or the contacting liquid may be directly contacted to the surface of the recording paper by using a roller 222 made of a sponge, a rubber, a cloth or a paper which is impregnated with the contacting liquid as shown in FIG. 50A. Additionally, the contacting liquid may be supplied by multiple stage rollers 224, 224' and 223 as shown in FIG. 50B. Further, the contacting liquid may be supplied by forming a layer of the contacting liquid on the roller 223 by contacting a porous member 225 impregnated with the contacting liquid to the roller 223 as shown in FIG. 50C. Additionally, the contacting liquid may be applied in a non-contact manner by using a spray or a jet nozzle as shown in FIG. 50D.

A thickness of the layer of the contacting liquid applied to the recording paper is preferably less than 500 $\mu$m, and more preferably less than 100 $\mu$m to facilitate removal of the ink curing liquid. In order to eliminate a mechanism for removing the contacting liquid, the thickness should be less than 10 $\mu$m. If a recording medium such as a recording paper which absorbs the contacting liquid is used, the recording paper absorbs the ink contacting liquid formed as a layer having about 10 $\mu$m. Thus, in this case, the removal of the contacting liquid is not needed after cure of the resin liquid.

However, in order to shorten the curing time of the resin liquid, it is better to increase the thickness of the layer of the contacting liquid. Thus, in practice, the thickness of the layer of contacting liquid should be determined by considering the thickness of the resin liquid on the recording paper, the number of types of ink used for printing, atmospheric conditions and a time required for curing the resin liquid. It should be noted that the recording paper includes a pulp paper, a synthetic paper as well as an OHP film and other materials used for printing.

The present embodiment utilizes the phenomena which is the same as the phenomena described in the above-mentioned first embodiment which is directed to rapidly cure ink on a recording paper. That is, the resin liquid related to the present embodiment is considered to correspond to the vehicle contained in the ink related to the first embodiment.

Accordingly, various methods for reducing the curing time of resin liquid described in the above-mentioned first to tenth embodiments can be applied to the present embodiment so as to further shorten the curing time of the resin liquid.

One of the methods is to provide a plurality of contacting liquid applying means or to contact the resin liquid with the contacting liquid a plurality of times so as to substantially increase the period for the contacting liquid to be in contact with the resin liquid.

Another method is to cool the resin liquid as is described in the above-mentioned fourth and fifth embodiments. The structure of a cooling device and the effect of the cooling can be appreciated by substituting the resin liquid for the ink or the vehicle in the fourth and fifth embodiments.

Similar to the ink and the vehicle mentioned in the previous embodiments, the resin liquid related to the present embodiment has an upper critical solution temperature as shown in a graph of FIG. 45. The resin and the solvent contained in the resin liquid are separated from each other when the temperature of the resin liquid is decreased below the upper critical solution temperature.

The resin liquid can be cooled by using the structure shown in FIG. 46. That is, in this case, the contacting liquid is supplied to the printed surface of the recording paper by the roller 220B, and a surface of the roller 220B is cooled by the cooling device which comprises the Peltier element 270 and the heat conductive member 272. The cooling device is positioned very close to the roller 220B so as to cool the surface of roller 220B and also the resin liquid on the roller 220B. The contacting member can be cooled by other conventional methods. For example, the surface of the contacting member may be cooled by blowing cooled air to the surface of the contacting member. Cooled air or coolant may be introduced into an interior of the roller 220B, or a Peltier element may be placed inside the roller so as to cool the roller 220B from inside.

A further method to reduce the curing time of the resin liquid is to heat the resin liquid as is described in the above-mentioned sixth and seventh embodiments. The structure of a heating device and the effect of the heating can be appreciated by substituting the resin liquid for the ink or the vehicle in the sixth and seventh embodiments.

Similar to the ink and the vehicle mentioned in the previous embodiments, the resin liquid related to the present embodiment has a lower critical solution temperature as shown in the graph of FIG. 45. The resin and the solvent contained in the resin liquid are separated from each other when the temperature of the resin liquid is increased above the lower critical solution temperature.

The resin liquid may be heated by the structures shown in FIGS. 47 and 48. In the example of FIG. 47, the resin liquid is heated by the roller 220B which is heated by the heater 280 provided inside the roller 220B. A surface of the roller 220B may be heated by a lamp emitting a heat ray. In the example of FIG. 48, the heat source 282 is provided after the resin liquid applying means 212. The resin liquid 204 is heated in a noncontact manner by the heat source 382. In this case, the contacting solid member 220A is not used. The heat source 282 may be a conventional heating device such as a heater, a lamp emitting a heat ray or a hot air blower.

It should be noted that, in the present embodiment, a pulp paper, a coated paper or a synthetic paper can be used as well as other materials such as an OHP film, a plastic member or a metal member.

(Description of Twenty-eighth Embodiment)

In this embodiment, cure of the resin liquid is performed by contacting or applying a silicone resin having flowability (a flowable silicon) as the contacting liquid used in the twenty-seventh embodiment. The flowable silicone is odorless and less harmful to the human body as compared to other contacting liquids used in the twenty seventh embodiment, it is also superior with respect to environmental sanitary. Additionally, there is little adverse effect to the printed surface as it is colorless. Further, since a sliding characteristic against the printed surface is improved, a flaw due to scratching is hardly generated on the printed surface. Thus, the flowable silicone has many advantages.

Examples of the flowable silicone are a silicone oil or a silicone gum. The silicone oil includes, other than a dimethyl silicone oil, methyl phenyl silicone oil and methyl hydrogen silicone oil, a denaturated silicone oil in which various organic bases are introduced into a part of a methyl base of a dimethyl silicon. For example, the denaturated silicone oil includes, for example, amino denaturated, alkyl denaturated, alcohol denaturated, epoxy denaturated, epoxy denaturated, epoxy-polyether denaturated, carboxyl denaturated or polyether denaturated species or other various denaturated species. The silicone gum is an extremely high-viscous silicone oil, and includes a silicone oil which has both a liquid-like viscosity and a solid-like elasticity.

Figure 51:
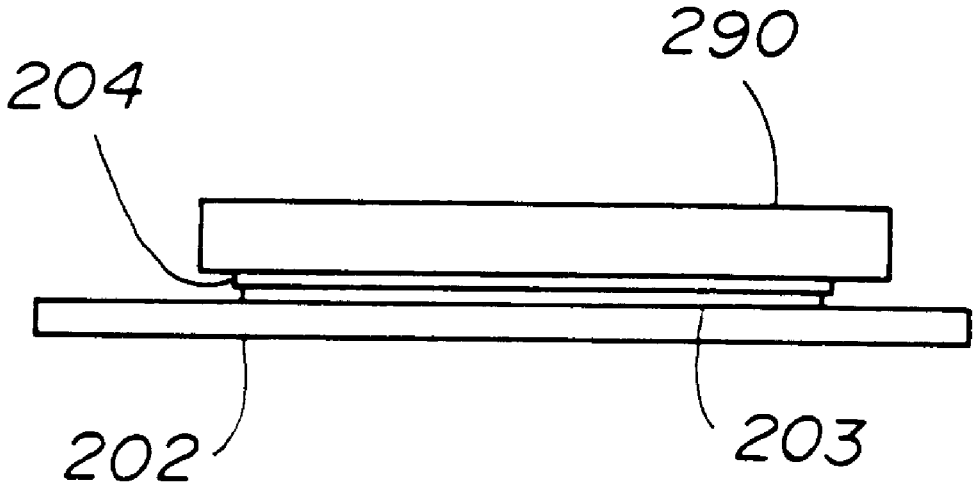
FIG. 51 is an example of a structure for applying a silicone gum.

A structure and a supply method is similar to that of the twenty-seventh embodiment. FIG. 51 is an example of a structure for applying a silicone gum 290. Since the silicone gum 290 hardly penetrate into a porous member, the silicone gum 290 is placed in contact with a surface of the recording paper in a flat manner and thereafter the silicone gum 290 is peeled off. Alternatively, the silicone gum can be rolled on the recording paper by forming the silicone gum in a spherical shape or a rod-like shape, or the silicone gum is placed in contact with the surface of the recording paper by providing the silicone gum on a periphery of a rollers A size and a thickness of the silicone gum is not limited, but, a fixing time of ink tends to be reduced if a diameter or a thickness is more than 100 $\mu$m.

(Description of Twenty-ninth Embodiment)

This embodiment is related to the resin layer forming apparatus according to one of the twenty-fourth to twenty-eighth embodiments in which means for providing a matted or embossed surface to the surface of the resin layer is provided.

FIGS. 52A, 52B, 52C and 52D show the means for providing matted or embossed surface. In these figures, reference numeral 230 indicates fine powder; 231 and 232 indicate hard rollers having a matted or embossed surface; and 233 indicates a porous roller member impregnated with the resin liquid.

Figure 52A:
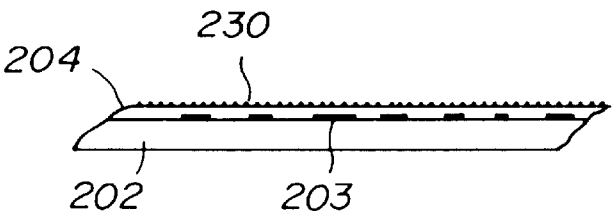
FIGS. 52A, 52B, 52C and 52D are illustrations for explaining means for providing matted or embossed surface.
Figure 52B:
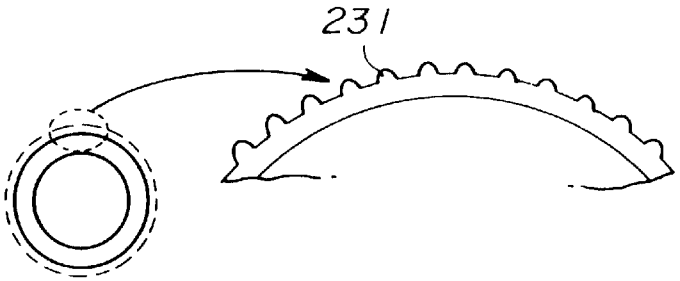
Figure 52C:
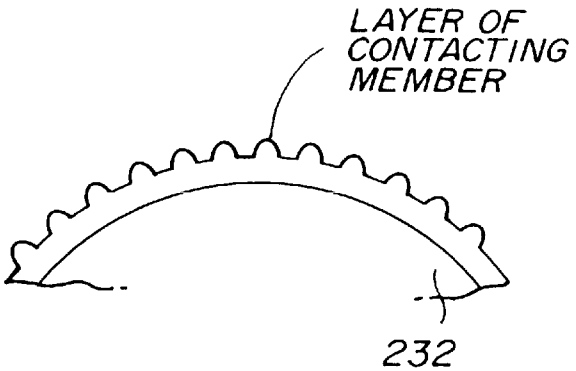
Figure 52D:
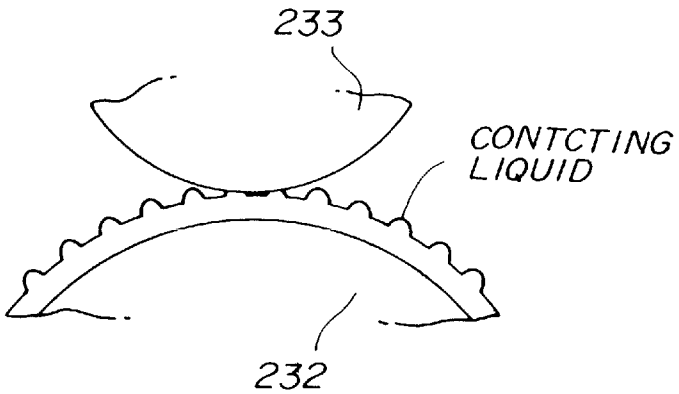

FIG. 52A shows a method for forming a matted surface by applying fine powder onto the surface of the resin layer. FIG. 52B shows a method for forming a matted or embossed surface on the resin layer by forming a matted or embossed surface on the roller 231 which is made of a material which cures the resin liquid. FIG. 52C shows a method for forming a matted or embossed surface on the resin layer by forming a matted or embossed surface on the roller 232 which forms a layer made of a material which cures the resin liquid. FIG. 52D shows a method for forming a matted or embossed surface on the resin layer by applying the contacting liquid from the porous roller 33 to the roller 232 which applies the contacting liquid to the printed surface. It should be noted that the matted or embossed surface can be easily formed on the surface of the rollers 231 and 232 by a conventional method such as an integral molding or a die press.

(Description of Thirtieth Embodiment)

Figure 53:
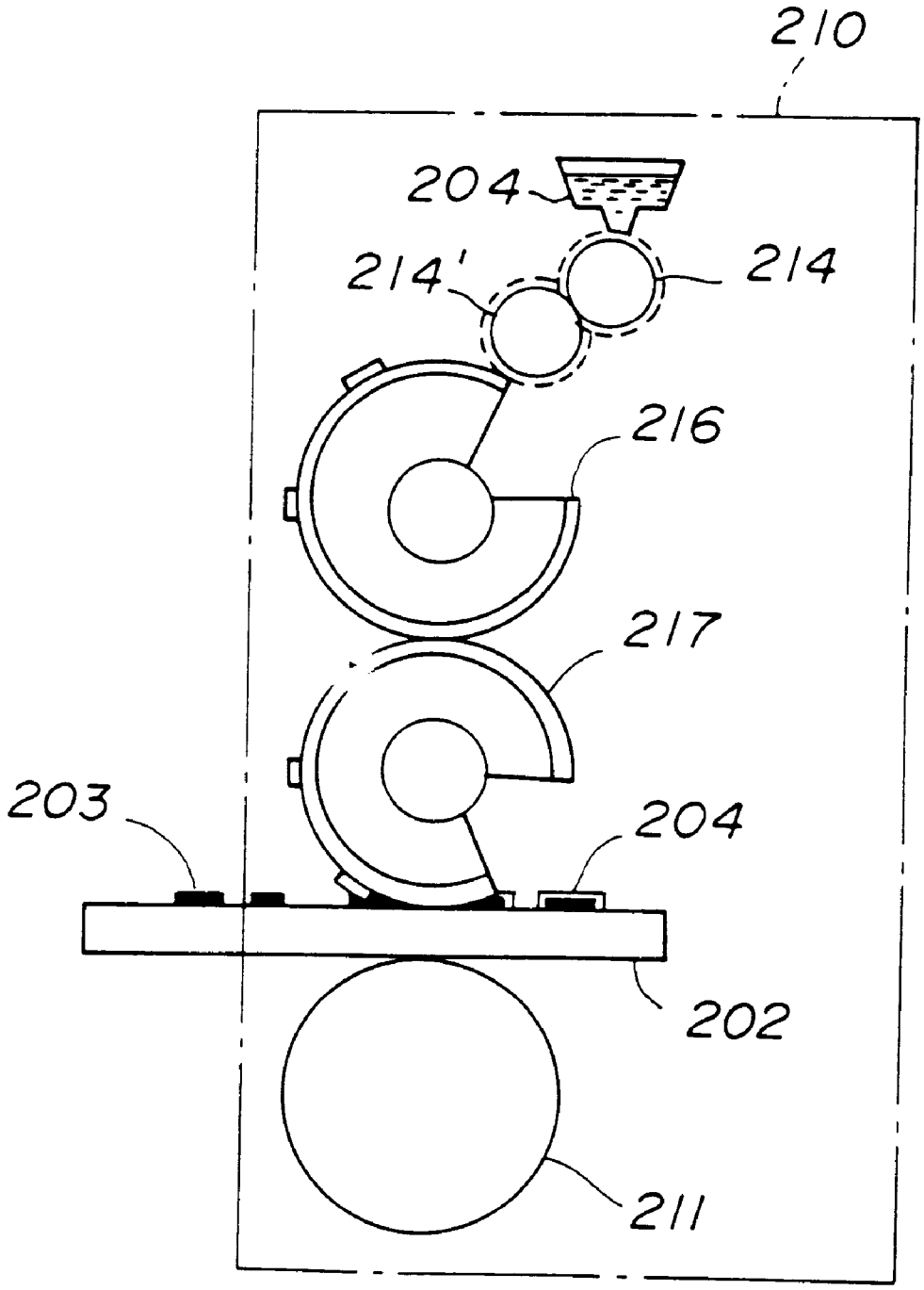
FIG. 53 is an illustration of a resin liquid applying mechanism.

FIG. 53 is an illustration of a resin liquid applying mechanism. In the figure, reference numeral 216 indicates a printing plate and 217 indicates an offset roller. In this embodiment, the printing plate 216 is formed in a predetermined shape so that a layer of the resin liquid is formed on a part of the printed surface corresponding to the shape of the printing plate 216 by utilizing an offset printing method.

It should be noted that the printing plate used in this embodiment can be formed by a stencil printing plate which is easily formed by a thermal head. A printing plate having a surface characteristic may also be used in which a receding contact angle is decreased when the printing plate is in contact with a contact member such as a liquid or a solid generating a liquid under a heated condition, and the receding contact angle is increased when there is no contact with a contact member such as a liquid or a solid generating a liquid under a heated condition.

(Description of Thirty-first Embodiment)

Figure 54A:
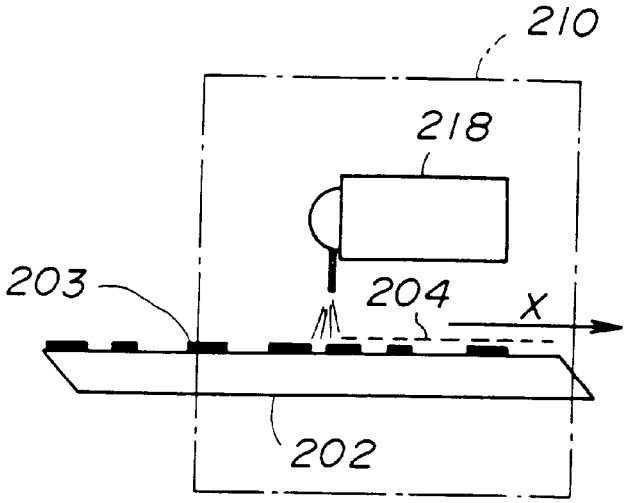
FIGS. 54A and 54B are illustrations for explaining methods for applying the resin liquid to the printed surface of a recording paper.
Figure 54B:
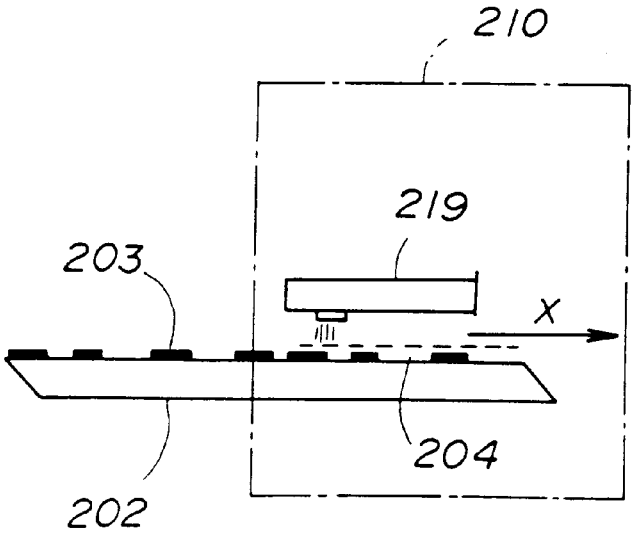

FIGS. 54A and 54B show methods for applying the resin liquid onto the printed surface of the recording paper. In the figures, reference numeral 218 indicates a spray and 219 indicates a jet nozzle.

When the ink on the printed surface has a low viscosity and has not yet dried, it is possible that the ink is transferred to a roller applying the resin liquid. It such a transfer occurred, the printed surface may be polluted by the transferred ink. However, in this embodiment, since the resin liquid is applied in a noncontact manner, the ink on the printed surface cannot be transferred to a member such as roller for applying the resin liquid.

In the example shown in FIG. 54A in which the spray 218 is used, the resin liquid to be used preferably has a viscosity ranging from 0.5 cp to $10^3$ cp. In the example shown in FIG. 54B in which the jet nozzle 219 is used, the resin liquid to be use preferably has a viscosity ranging from 0.5 cp to $10^2$ cp. It should be noted that the spray of the resin liquid may be applied to a desired area on the printed surface by controlling the spray in accordance with information indicating conditions of the printed surface.

(Description of Thirty-second Embodiment)

This embodiment relates to the resin layer forming apparatus according to one of the twenty-fourth to thirty-first embodiments in which a pressing force of the contacting member against the printed surface is controlled so as to maintain a good application of the resin liquid.

Figure 55A:
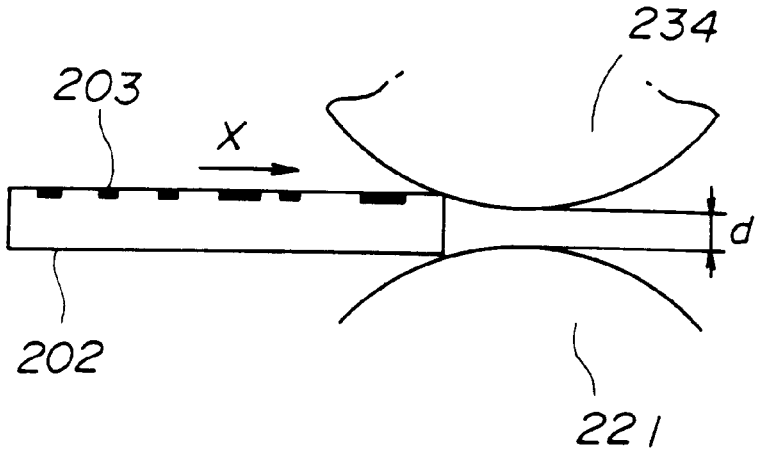
FIGS. 55A and 55B are illustrations of a part of a structure for curing the resin layer.
Figure 55B:
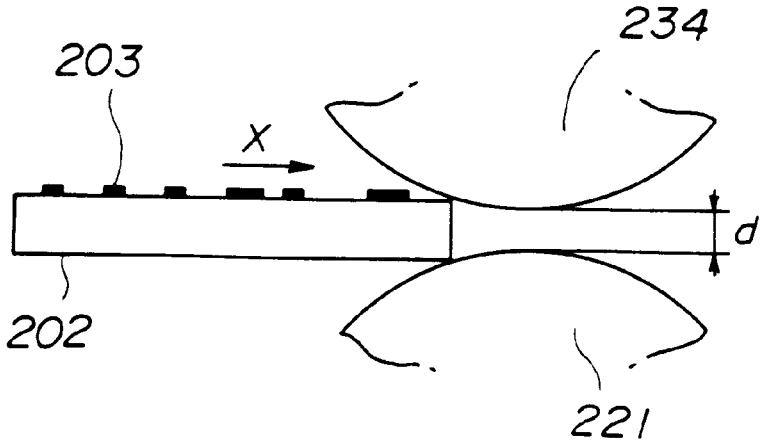

FIGS. 55A and 55B show a part of a structure for curing the resin layer. FIG. 54A shows a case in which the ink 203 penetrates into the recording paper 202. FIG. 54B shows a case in which the ink 203 adheres on the recording paper 202.

In this embodiment, the contacting or pressing force of the resin liquid curing means against the printed surface of the recording paper 202 is controlled to be greater than a predetermined level irrespective of a thickness and hardness of the recording paper 202. Additionally, the contacting or pressing force is varied in response to a surface roughness of the recording paper 202, a level of drying of the ink 203 and a level of penetration of the ink 203 into the recording paper 203.

In order to maintain a constant contacting or pressing force irrespective of the thickness of the recording paper 203, a distance d between the contacting member 234 and the roller 210 supporting the recording member is increased as the thickness and hardness of the recording paper 202 is increased. On the other hand, the distance d is decreased as the thickness and hardness of the recording paper 202 is decreased. In order to achieve this, the thickness and hardness should may be detected by sensors, or information related to the thickness and hardness of the recording paper 202 may be input to the apparatus by an operator. A pressure sensor may be provided to the table of the recording paper 202 so as to detect all factors at the same time.

The factors which vary the contacting pressure of the contacting member 234 against the printed surface are a surface roughness of the printed surface and a condition of the ink. In a case where the ink 203 is dried, the contacting force is decreased since a good contact is provided between the contacting member 234 and the printed surface. Additionally, when the viscosity of the ink is low and the ink penetrates into the recording paper 202, and when the printed surface is smooth as is in a ink jet printing or gravure printing, 10 the contacting force is also decreased. On the other hand, when the printed surface is rough, the contacting force is increased since the ability to contact the rough surface is low. Additionally, the contacting force is decreased less than that in a case where the ink is dried when viscous and undried ink adheres on the printed surface as shown in FIG. 55B. This is because if the contacting force is large, the ink tends to spread which results in deterioration of the image quality. It should be noted that when the printed surface is rough, it is preferred to use a contacting liquid which can provide good contact with the printed surface and can cure the resin liquid at a low pressure.

(Description of Thirty-third Embodiment)

A description will now be given of a thirty-third embodiment according to the present invention. This embodiment is directed to an image forming apparatus provided with a resin layer forming apparatus according to one of the embodiments mentioned above.

Figure 56:
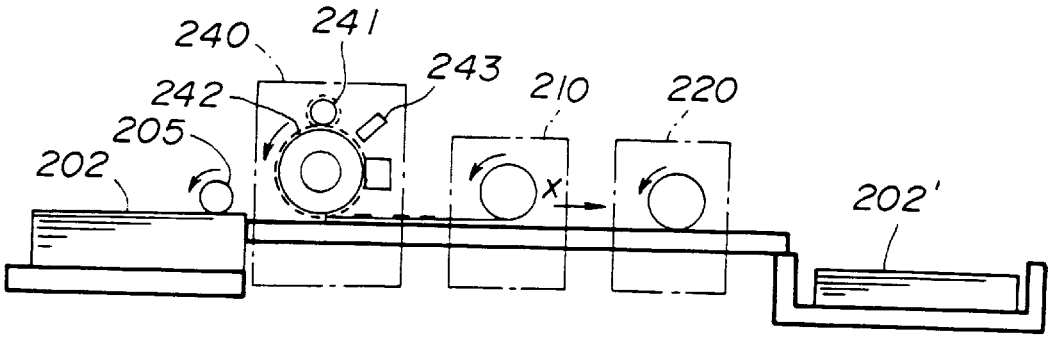
FIG. 56 is an illustration of an image forming apparatus according to the present invention.

FIG. 56 is an illustration of an image forming apparatus according to the present embodiment. In the figure, reference numeral 240 indicates means for printing; 241 indicates means for supplying coloring powder; 242 indicates a photosensitive member; and 243 indicates a light source.

The sequence of processes performed by this apparatus is that printing is performed on the recording paper; the resin liquid is applied to the printed surface; the resin liquid is cured. The formation of the resin layer is performed immediately after the printing so as to prevent adherence of dust to the printed surface and pollution of the printed surface.

Figure 57:
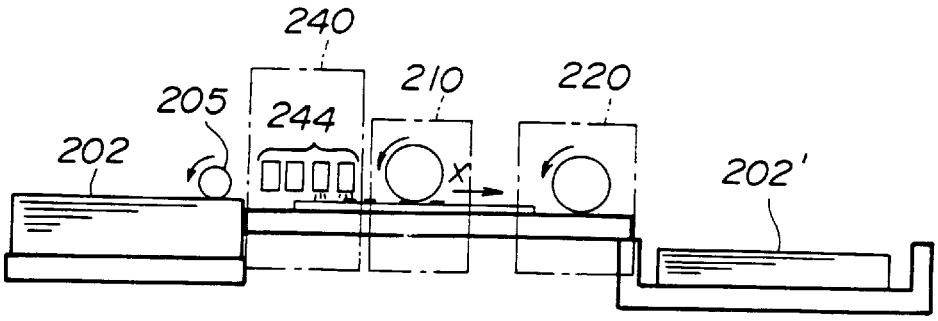
FIG. 57 is an illustration of another image forming apparatus according to the present invention.

FIG. 57 is an illustration of another image forming apparatus according to the present invention. In the figure, reference numeral 244 indicates means for recording by ink jet method. The printing means can be any type as long as it uses water base ink. For example, other than the ink jet method as shown in FIG. 57, a gravure printing method, a flexo printing method, a screen printing method (including digital stencil printing), or a plotter may be used. As for the means for applying the resin liquid, the method described in the twenty-fourth embodiment can be used if the recording paper having good ability to absorb a liquid is used. This is because there is no liquid layer formed on the printed surface and a coloring agent such as dye or pigment is adhered on the printed surface, and thus the resin liquid is easily adhered on the printed surface. On the other hand, if a material having low permeability with respect to a liquid is used for the recording paper such as an OHP film, it is preferred to apply the resin liquid after a time has passed to allow water contained in the ink to evaporate. Additionally, when the printed surface is wet due to ink, and if the resin liquid has a very high viscosity, the resin liquid is not substantially transferred from the applying roller in the resin liquid applying means 210 to the printed surface. On the other hand, if the viscosity is low, the resin liquid may be partially repelled. Thus, the viscosity of the resin liquid is preferably in the range of $10^3$ to $10^5$ cp. Additionally, in order to prevent unevenness of the resin liquid on the printed surface, it is preferred to cure the resin liquid immediately after the resin liquid is applied. As for the means 220 for curing the resin liquid, any apparatus according to the twenty-fourth to thirty-first embodiments may be used.

Figure 58:
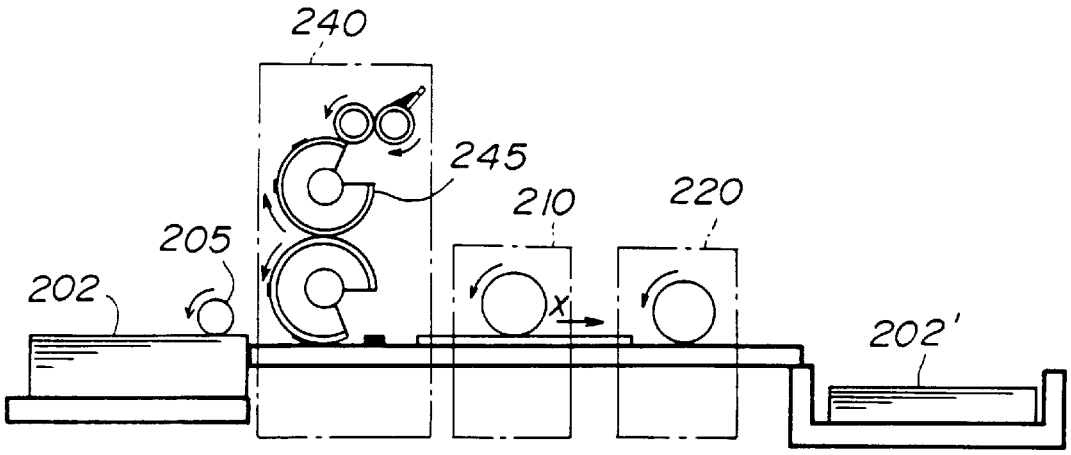
FIG. 58 is an illustration of another image forming apparatus according to the present invention.
Figure 59:
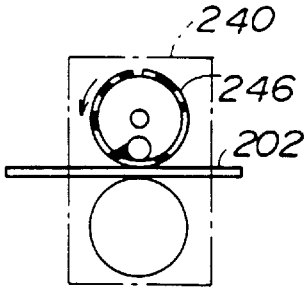
FIG. 59 is an illustration of the printing means which may be substituted for the printing means shown in FIG. 58.

FIG. 58 is an illustration of another image forming apparatus according to the present invention. FIG. 59 is an illustration of the printing means which may be substituted for the printing means shown in FIG. 58. In the figures, reference numeral 245 indicates a printing plate and 246 indicates a stencil printing plate.

In this apparatus, the printing means uses oil base ink and the resin liquid is applied to the printed surface printed by the oil base ink.

The printing means 240 may be any type using oil base ink such as, for example, an offset printer, a screen printer (including a digital stencil printer) as shown in FIG. 59, a letterpress printer or a plotter. As for the means for applying the resin liquid, a device described in the twenty-fourth embodiment can be used when the ink on the printed surface has been cured. However, in a state where the ink has not been cured yet, the ink tends to adhere on the resin liquid supplying side if the resin liquid has high viscosity. On the other hand, if the viscosity is low, the ink on the printed surface may dissolves in the solvent or the oil contained in the resin liquid which causes a blur. Thus, the viscosity of the resin liquid is preferably in the range of $10^3$ to $10_5$ cp. Additionally, in order to prevent a blur due to melting of ink on the printed surface, it is preferred to cure the resin liquid immediately after the resin liquid is applied. As for the means 220 for curing the resin liquid, any apparatus according to the twenty-fourth to thirty-first embodiments may be used.

Figure 60:
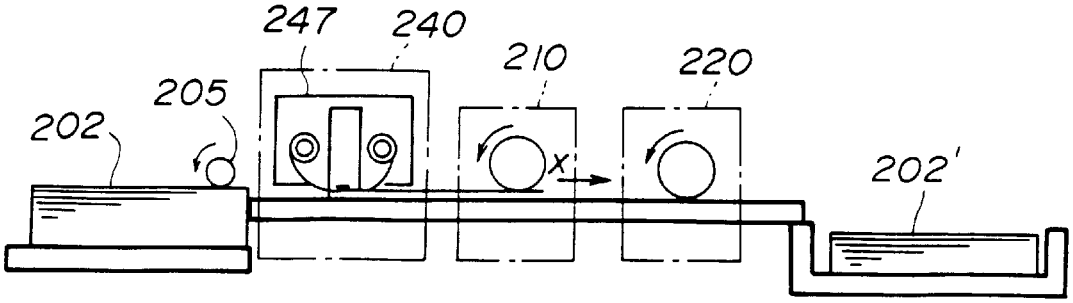
FIG. 60 is an illustration of another image forming apparatus according to the present invention.

FIG. 60 is an illustration of another image forming apparatus according to the present invention. In the figure, a reference numeral 247 indicates means for transfer recording of a sublimation type.

In this apparatus, the printing means uses sublimation type heat transfer ink, and the resin layer is formed on the printed surface on which the heat transfer ink of a sublimation type is printed.

The printing means 240 may be any type using heat transfer ink of a sublimation type such as, for example, a sublimation heat transfer printer using a thermal head or a laser, a gravure printer or a sublimation transfer printer in which matter printed by offset printing is heated together with a cloth adhered thereon. In the printing method using the sublimation type heat transfer ink, viscosity of the resin liquid is preferably as high as $10^4$ to $10^6$ cp in order to prevent the curing time from being extended due to lack of adsorbability of the recording paper. As for the means 220 for curing the resin liquid, any apparatus described in the twenty-fourth to thirty-first embodiments may be used. However, in the printing method using sublimation type heat transfer ink, a finger print or flow may tend to be put on the printed surface since the surface of the recording paper is a glossy surface. Accordingly, the method for forming the resin layer as described in the twenty-ninth embodiment is particularly preferable.

Figure 61:
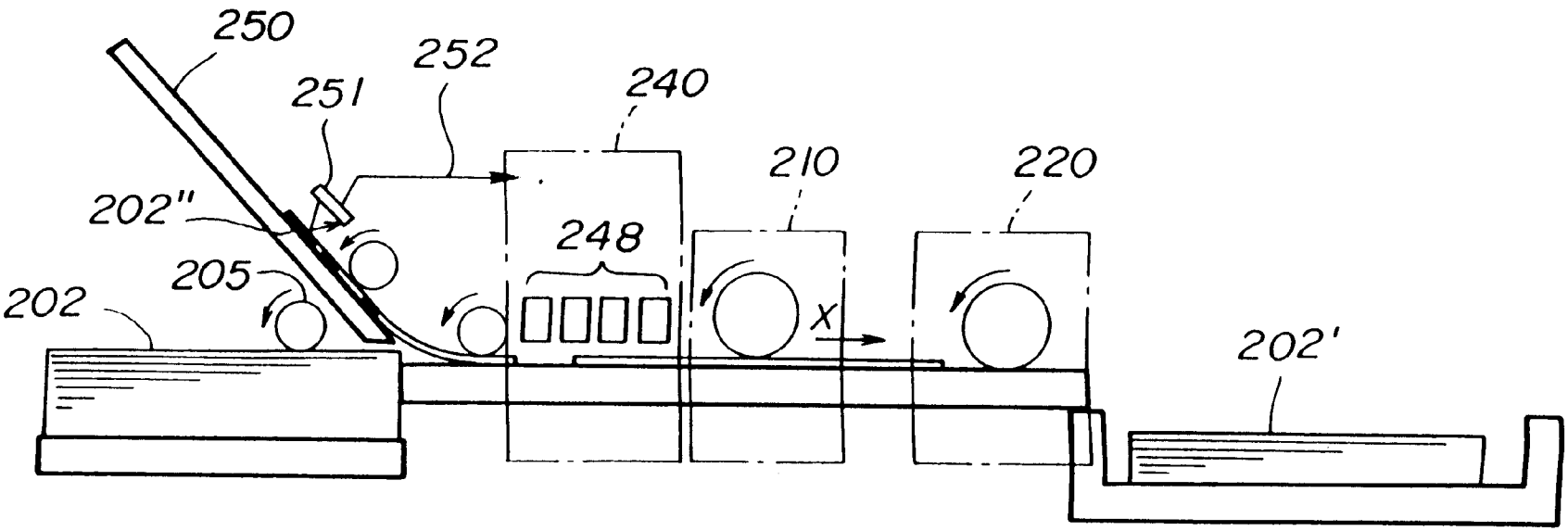
FIG. 61 is an illustration of an example of an image forming apparatus provided with the resin layer forming apparatus according to the present invention.
Figure 62:
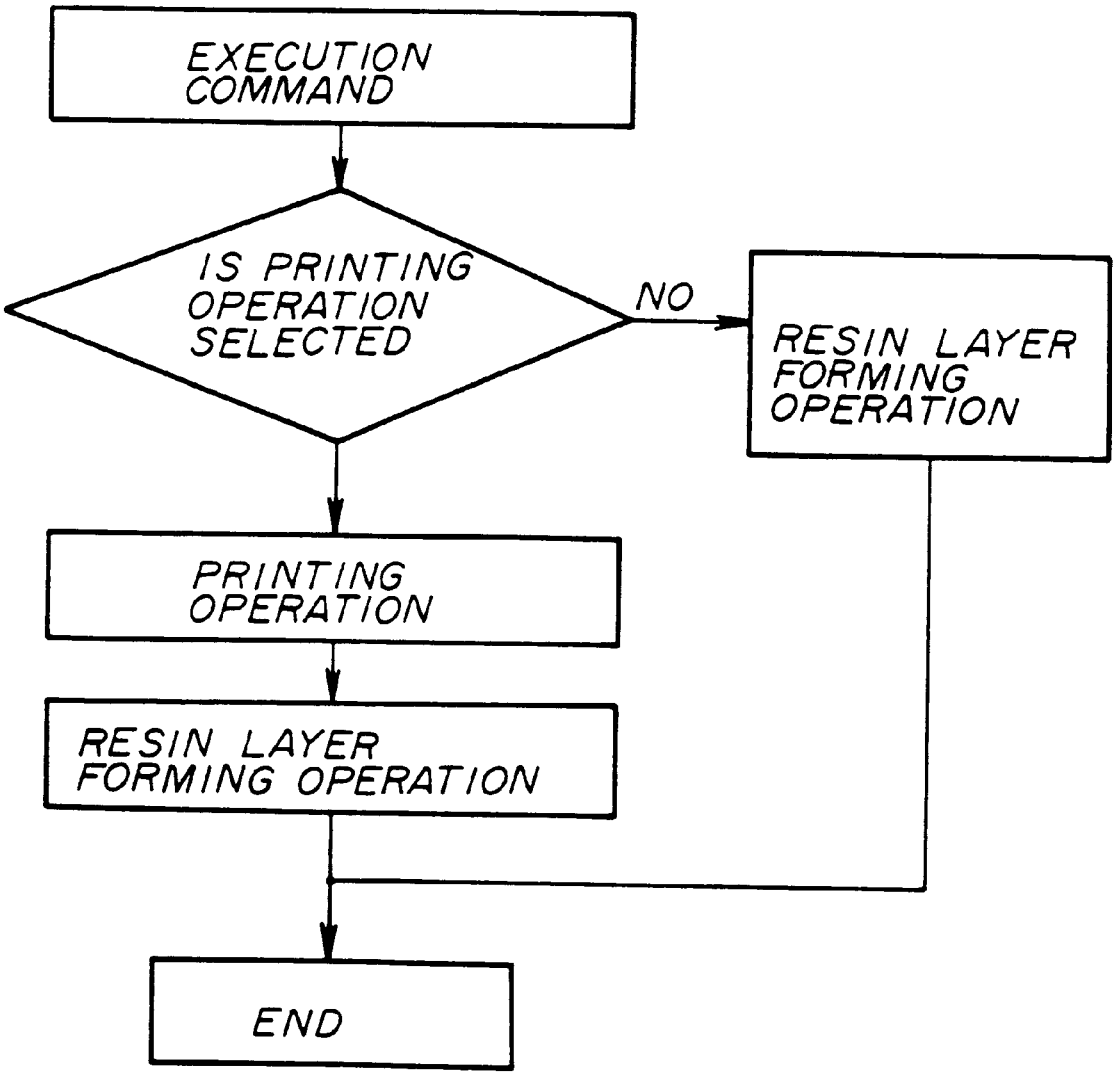
FIGS. 62, 63 and 64 are flowcharts of operations performed in the image forming apparatus shown in FIG. 61.
Figure 63:
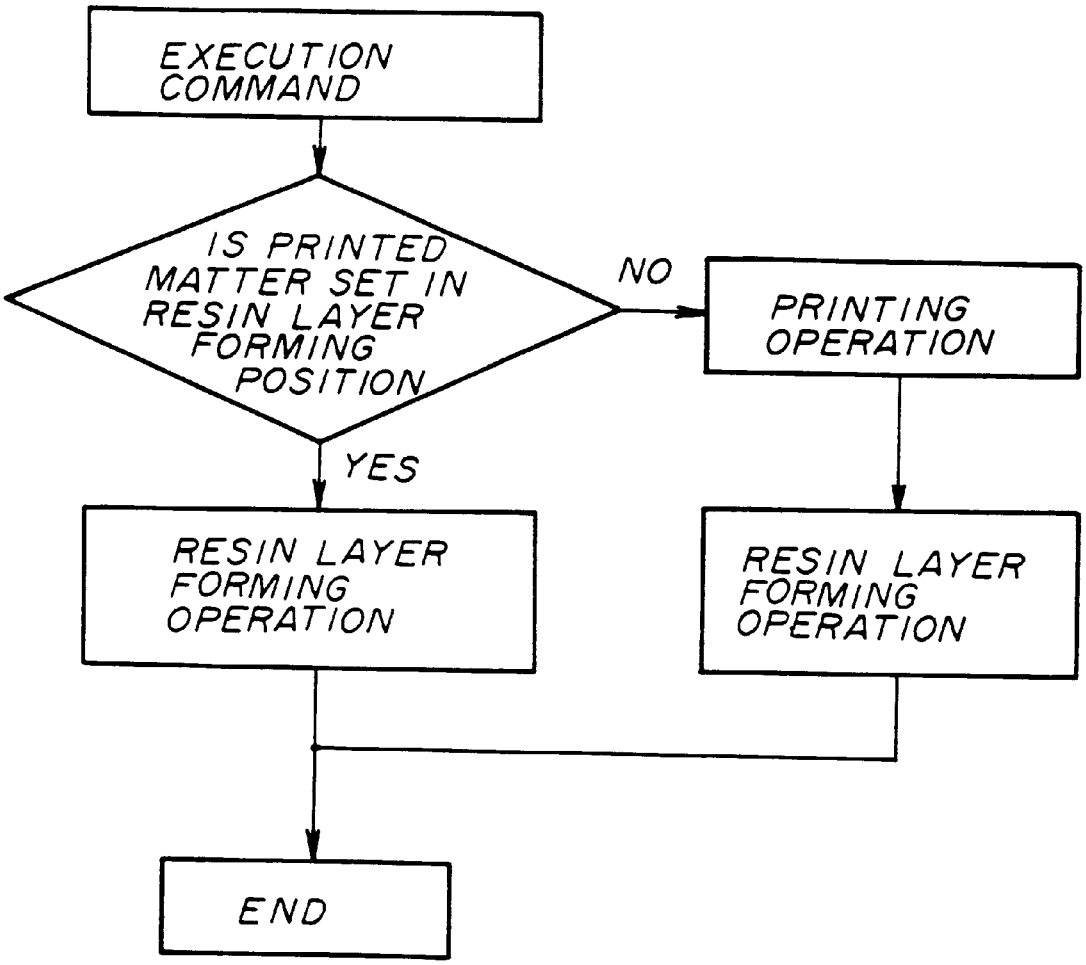
Figure 64:
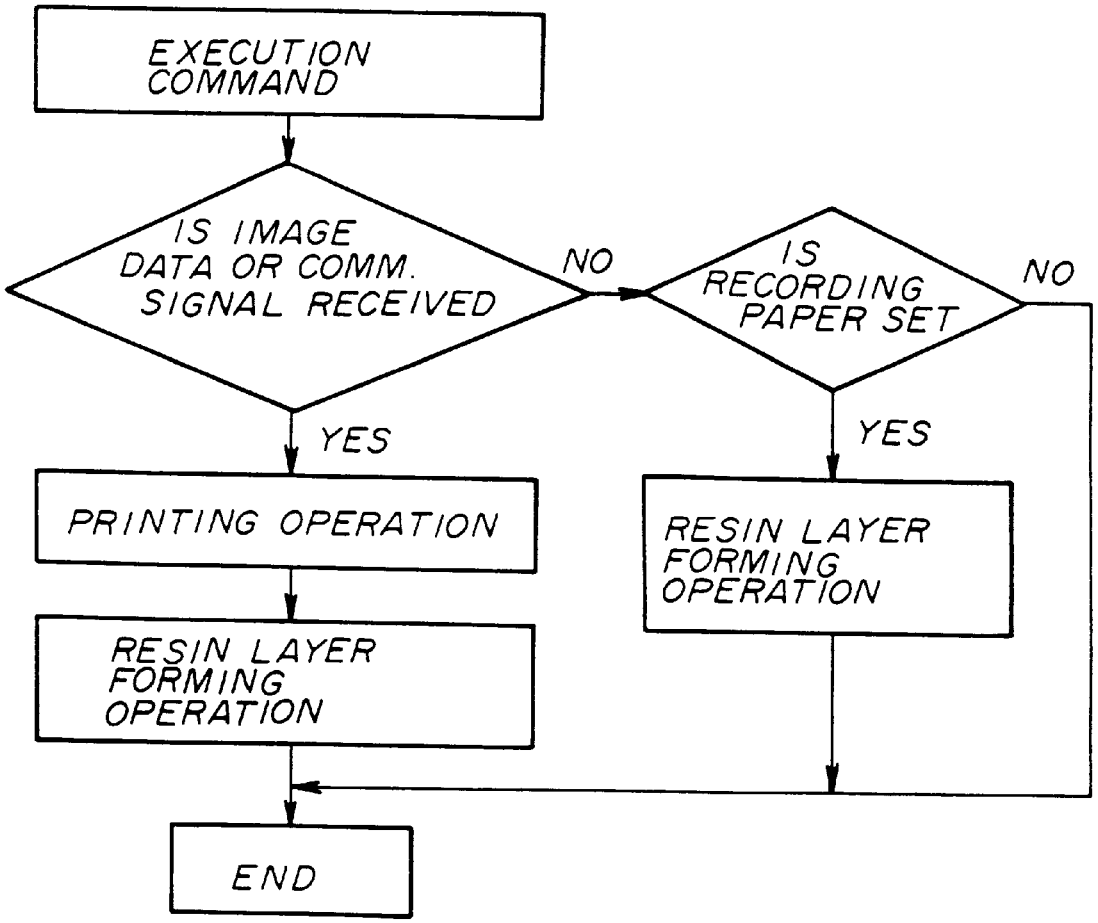

FIG. 61 is another example of an image forming apparatus provided with the resin layer forming apparatus according to the present invention. In this image forming apparatus, a mode is selectable in which formation of the resin layer is performed on a printed material supplied externally. FIGS. 62 to 64 are flowcharts of operations performed in the image forming apparatus shown in FIG. 61. In FIG. 61, reference numeral 248 indicates a printer control unit; 250 indicates a position for setting printed matter; 251 indicates a recording paper detecting sensor; and 252 indicates a signal output from the sensor 251.

The printed material refers to a material output from a conventional printer or a manually written recording material. In this apparatus, formation of a resin layer on the printed matter supplied from outside can be preformed although the printing means 240 is provided in the apparatus. Thus, either one of a printing/resin layer forming mode and an exclusive resin layer forming mode can be selected. As shown in the flowchart of FIG. 62, an operator can set one of the modes by inserting instructs through an operational panel (not shown). Additionally, as shown in the flowchart of FIG. 63, the apparatus can be operated in the exclusive resin layer forming mode when the printed matter is set in a position different from a position where the recording paper to be printed is set. The position of the printed matter can be detected by a sensor such as a photodetector. Further, as shown in the flowchart of FIG. 64, execution of a printing operation can be determined by the presence of image data or a protocol signal.when an instruction for performing the resin layer forming operation is issued. That is, when a printing operation is performed before the resin layer forming operation is performed, image data generated by a scanner is input through a bus line. On the other hand, when only the resin layer forming operation is required, only the printed matter is set to the apparatus. Thus, a request for performing only the resin layer forming operation can be determined by presence of the image data or a communication protocol signal transmitted from the scanner.

Test No.37 (Twenty-fourth Embodiment)

Printed Maternal

Printing means: Ink Jet Printer (Model MJ-5000C, Seiko-Epson)

Ink: Four-color water base ink (C, M, Y, K)

Recording paper:

1) super fine paper
2) fine paper
3) wood free paper
4) exclusive glossy film
5) exclusive OHP sheet Resin Liquid 1) Resin (vinyl chloride-vinyl acetate copolymer+acrylic resin)+solvent (#0-solvent. (H))
2) Solvent type over print varnish Resin liquid applying means: Sponge Contacting Member 1) Natural rubber roller (ϕ40 mm, hardness: 20 degrees)
2) Semi-natural rubber roller (ϕ40 mm, hardness: 30 degrees)
3) Olefin elastomer roller (ϕ40 mm, hardness: 50 degrees)
4) Butyl rubber roller (ϕ30 mm, hardness: 40 degrees)
5) Chloroprene rubber roller (ϕ40 mm, hardness: 40 degrees)

Evaluation Results

A resin layer was formed on the printed surface of the recording papers with the structure shown in FIG. 43 by using the method shown in FIG. 44A. The resin liquid and over print varnish were cured within 2 minutes for any recording paper. A colorless and transparent resin layer was formed without blur of the ink when a water drop was applied to the surface of the resin layer.

Test No.38 (Twenty-fourth Embodiment)

Printed Maternal

Printing means: Offset printer Ink: Four-color water base ink (C, M, Y, K)

Recording paper:

1) coated paper
2) wood free paper
3) PET film

Resin Liquid

1) Resin (rosin denaturated phenol resin)+solvent (Dialene$^R$ 168)
2) Solvent type over print varnish Resin liquid applying means Urethane rubber roller (ϕ30 mm, hardness: 60 degrees)

blade (stainless steel)

Contacting Member

1) Natural rubber roller (ϕ40 mm, hardness: 20 degrees)
2) Semi-natural rubber roller (ϕ40 mm, hardness: 30 degrees)
3) Olefin elastomer roller (ϕ40 mm, hardness: 50 degrees)
4) Butyl rubber roller (ϕ30 mm, hardness: 40 degrees)
5) Chloroprene rubber roller (ϕ40 mm, hardness: 40 degrees)

Evaluation Results

A resin layer was formed on the printed surface of the recording papers with the structure shown in FIG. 43 by using the method shown in FIG. 44C. The resin liquid and over print varnish were cured within 2 minutes for any recording paper except for the PET film. With respect to the PET film, the resin liquid was cured for about 3 minutes. A colorless and transparent resin layer was formed without blur of ink when a water drop was applied to the surface of the resin layer.

Test No.39 (Twenty-fifth Embodiment)

Printed Maternal

Printing means: Offset printer

Ink: Four-color water base ink (C, M, Y, K)

Recording paper:

1) coated paper
2) wood free paper
3) PET film

Resin Liquid

1) Resin (rosin denaturated phenol resin)+solvent (Dialene$^R$ 168)
2) Resin (ester resin)+solvent (Dialene$^R$ 168)

Resin liquid applying means

Nitrile rubber roller (ϕ30 mm, hardness: 30 degrees)

Contacting Member

1) Silicon gel roller (SE1821(two-liquid type), Dow Coring.Toray Silicone Co., Ltd.)
2) Silicon gel roller (SE1880(one-liquid type), Dow Coring Toray Silicone Co., Ltd.)
3) Silicon rubber roller (ϕ40 mm, hardness: 20 degrees)
4) One component RTV rubber roller (Shin-Etsu Chemical Co., Ltd.) Applied around a silicone rubber roller (ϕ20 mm, hardness: 20 degrees) with a thickness of 1 mm; cured for a half day at a room temperature.

Evaluation Results

A resin layer was formed on the printed surface of the recording papers with the structure shown in FIG. 43 by using the method shown in FIG. 44B. The resin liquid and over print varnish were cured within 10 seconds for any recording paper except for the PET film. With respect to the PET film, the resin liquid was cured for about 20 seconds. A colorless and transparent resin layer was formed without blur of ink when a water drop was applied to the surface of the resin layer.

Test No.40 (Twenty-sixth Embodiment)

Conditions and apparatus were the same as that used in the Test No.39. A silicone rubber roller having a glossy surface was used as a contacting member. An amount of the resin liquid transferred to the contacting member was minimized. The resin liquids were cured for about 5 seconds. Glossy resin layers were formed on the printed surface.

Contacting Member

Silicon rubber roller (ϕ20 mm, hardness: 20 degrees) 10-point average roughness=about 1 μm Test No.41 (Twenty-seventh Embodiment)

Printed Material

Printing Means: Stencil printing machine

Ink: Emulsion Ink

Recording paper:

1) exclusive paper
2) wood free paper
3) woody paper

Resin Liquid

1) Resin (rosin denaturated phenol resin)+solvent (Dialene$^R$168:#0-solvent(H)=4:1)
2) Resin (rosin denaturated phenol resin)+oil (linseed oil)+solvent (AF7-solvent:Dialene$^R$168=1:4)
3) Varnish (alkyd resin varnish)+oil (linseed oil)+solvent (AF7-solvent:Dialene$^R$168=1:4)
4) Oxidative copolymerization dry type over print varnish Resin liquid applying means Urethane rubber roller (ϕ30 mm, hardness 60 degrees)

Contacting Member

1) Machine oil+sponge roller (Rubycell$^R$, Toyo polymer Co., Ltd.)+rubber roller (60 degrees)
2) Grease+sponge roller (Rubycell$^R$, Toyo polymer Co., Ltd.)+rubber roller (60 degrees)
3) Engine oil+sponge roller (Rubycell$^R$, Toyo polymer Co., Ltd.)+rubber roller (60 degrees)

Evaluation Results

A resin layer was formed on the printed surface of the recording papers with the structure shown in FIG. 43 by using the method for applying the resin liquid shown in FIG. 44A and the method for curing the resin liquid shown in FIG. 50C. The resin liquid and over print varnish were cured for about 1 minute for any contacting members. The resin layer did not peel off when the surface of the resin layer wad rubbed. A colorless and transparent resin layer was formed.

Test No.42 (Twenty-eighth Embodiment)

Printed Material

Printing Means: Stencil printing machine

Ink: Emulsion Ink

Recording paper:

1) exclusive paper
2) wood free paper
3) woody paper

Resin Liquid

1) Resin (rosin denaturated phenol resin)+solvent (Dialene$^R$168:#0-solvent(H)=4:1)
2) Resin (rosin denaturated phenol resin)+oil (linseed oil)+solvent (AF7-solvent:Dialene$^R$168=1:4)
3) Varnish (alkyd resin varnish)+oil (linseed oil)+solvent (AF7-solvent:Dialene$^R$168=1:4)
4) Oxidative copolymerization dry type over print varnish Resin liquid applying means Metal (stainless steel) blade+rubber rollers (2 stages)

Contacting Member

1) Silicon oil (KE-1031-A+B, Shin-Etsu Chemical CO., Ltd.)+sponge roller (Rubycel$^R$, Toyo polymer Co., Ltd.)+rubber roller (60 degrees)
2) Silicon oil (KF96-50, Shin-Etsu Chemical Co., Ltd.)+sponge roller (Rubycell$^R$, Toyo polymer Co., Ltd.)+rubber roller (60 degrees)
3) Methyl hydrogen silicone oil (SH1107, Dow Corning Toray Silicone Co., Ltd)+sponge roller (Rubycell$^R$, Toyo polymer Co., Ltd.)+rubber roller (60 degrees)
4) Silicon gum (Dow Corning Toray Silicone Co., Ltd.)

Evaluation Results

A resin layer was formed on the printed surface of the recording papers with the structure shown in FIG. 43 by using the method for applying the resin liquid shown in FIG. 44C and the method for curing the resin liquid shown in FIG. 50C. The resin liquid and over print varnish were cured for about 5 seconds for any contacting members. The resin layer did not peel off when the surface of the resin layer was rubbed. A colorless and transparent resin layer was formed.

Test No.43 (Twenty-eighth Embodiment)

Printed Material

Printing Means: Electrophotographic printer

Ink: Dry toner

Recording paper:

1) regular paper (type6200, Ricoh)
2) recycled paper (shigen, Ricoh)

Resin Liquid

1) Resin (rosin denaturated phenol resin)+solvent (Dialene$^R$168)
2) Oxidative copolymerization dry type over print varnish Resin liquid applying means Metal (stainless steel) blade+rubber rollers (2 stages)

Contacting Member

Silicon gum (Dow Corning Toray Silicone Co., Ltd.)+rubber roller

Heating Means

Xenon Lamp

Evaluation Results

A resin layer was formed on the printed surface of the recording papers with the structure shown in FIG. 43 by using the method for applying the resin liquid shown in FIG. 44C and the method for curing the resin liquid shown in FIG. 48. The resin liquid and over print varnish were cured for about 3 seconds for any contacting members. The resin layer did not peel off when the surface of the resin layer wad rubbed. A colorless and transparent resin layer was formed.

Test No.44 (Twenty-ninth Embodiment)

Operating conditions and the apparatus were the same as that used in the Test No.39. Printed matter printed by a sublimation type heat transfer method was used. As for the contacting member, a silicone rubber roller having an embossed surface as shown in FIG. 52B was used. A resin layer having an embossed surface was formed. A finger print or flaw was substantially not formed on the surface of the resin layer.

Contacting Member

RTV rubber roller provided with an embossed surface formed by molding

Test No.45 (Thirtieth Embodiment)

Operating conditions and the apparatus were the same as that used in the Test No.40. The method for applying the resin liquid shown in FIG. 53 was used. A resin layer was formed in a desired area of the printed surface. Partially glossy and enhanced printed surface was obtained.

The printing plate used in this test was made of the materials listed below. The printing plate had a surface characteristic in which a receding contact angle was decreased when the printing plate was contacted with a contact member such as a liquid or a solid generating a liquid under a heated condition, and the receding contact angle is increased when there is no contact with a contact member such as a liquid or a solid generating a liquid under a heated condition.

Printing Plate Structure

Recording layer material

Perfluoro-alkylaclyrate polymer LS317 (emulsion polymerization type)

Recording material substrate

Non-grazed PET film size: 350×220 mm, thickness 25 μm

Test No.46 (Thirty-first Embodiment)

Conditions and apparatus were the same as that used in the Test No.38. The resin liquid was sprayed by a spray gun. The resin liquid had a viscosity described below. The tests were performed by the method shown in FIG. 54A. The resin liquid was easily applied on the printed surface even when the ink had not been cured or dried since the ink was not transferred to the resin liquid applying means. A resin layer was formed on a desired area of the printed surface.

Viscosity of Resin Liquid: $10^2$ cp

Resin Liquid Supplying Means: Spray Gun

Test No.47 (Thirty-second Embodiment)

contacting pressure of the resin liquid curing means against the printed surface

| | ink jet print | offset print |
|---|---|---|
| (non-dried ink) | | |
| 1) coated paper | 0.5 MPa/cm$^2$ | 0.3 MPa/cm$^2$ |
| 2) OHP film | 0.3 MPa/cm$^2$ | 0.1 MPa/cm$^2$ |
| (dried-ink) | | |
| 1) coated paper | 0.5 MPa/cm$^2$ | 0.7 MPa/cm$^2$ |
| 2) OHP film | 0.5 MPa/cm$^2$ | 0.7 MPa/cm$^2$ |

Conditions and apparatus were the same as that used in the Test No.38. The resin liquid was cured by the method used in the test No.40. The resin liquid was cured with the contacting pressure mentioned in the above table. A good resin layer was formed without spread of ink and bad contact.

Test No.48 (Thirty-third Embodiment)

Printing was performed by the apparatus shown in FIG. 56. The resin liquid and the method for forming the resin layer are the same as that used in the Test No.37. A resin layer having an even and glossy surface was formed on the printed surface.

The present invention is not limited to the specifically disclosed embodiments, and variations and modifications may be made without departing from the present invention.

What is claimed is:

1. An image forming method for fixing an ink image on a recording medium, comprising the steps of:

transferring ink to said recording medium so as to form said ink image on said recording medium, the ink containing a resin and a solvent miscible with said resin; and applying an ink curing liquid to contact the ink transferred to said recording medium, said ink curing liquid being miscible with said solvent, said ink curing liquid having a molecular weight greater than a molecular weight of said solvent.

2. An image forming apparatus for fixing an ink image on a recording medium, comprising:

an ink transfer mechanism which transfers ink to said recording medium so as to form said ink image on said recording medium, the ink containing a resin and a solvent miscible with said resin; and an ink fixing mechanism which applies an ink curing liquid to contact the ink transferred to said recording medium, said ink curing liquid being miscible with said solvent, said ink curing liquid having a molecular weight greater than a molecular weight of said solvent.

3. The image forming apparatus as claimed in claim 2, wherein said ink curing liquid is a flowable silicone resin.

4. The image forming apparatus as claimed in claim 2, further comprising a cooling unit for cooling a contact area where said ink curing liquid contacts the ink transferred on said recording medium.

5. The image forming apparatus as claimed in claim 4, wherein said cooling unit cools said contact area to a temperature below an upper critical solution temperature when a temperature of said contact area exceeds said upper critical solution temperature, said upper critical solution temperature determined by said resin and said solvent contained in the ink.

6. The image forming apparatus as claimed in claim 2, further comprising a heating unit for heating a contact area where said ink curing liquid contacts the ink transferred on said recording medium.

7. The image forming apparatus as claimed in claim 6, wherein said heating unit (50) heats said contact area to a temperature above a lower critical solution temperature when a temperature of said contact area is below said lower critical solution temperature, said lower critical solution temperature determined by said resin and said solvent contained in the ink.

8. The image forming apparatus as claimed in any one of claims 2, further comprising:

a conveying mechanism conveying said recording medium (1) having an unfixed ink image thereon to said ink fixing mechanism (20); and an ejecting mechanism ejecting said recording medium (1) externally of said image forming apparatus when said unfixed ink image is fixed.

9. The image forming apparatus as claimed in claim 2, wherein a plurality of said ink fixing mechanisms (20) is provided.

10. The image forming apparatus as claimed in claim 2, further comprising a removing unit for removing said ink curing liquid adhering on said recording medium after said ink curing liquid is applied to contact said ink image on said recording medium.

11. A resin layer forming apparatus for forming a resin layer on a printed surface of a recording medium, comprising:

an applying unit for applying a resin liquid to said printed surface of said recording medium, said resin liquid containing a solvent and a resin dissolved in said solvent; and a curing unit for curing said resin liquid, said curing unit including a curing solid which contracts said resin liquid applied on said printed surface, said curing solid having a swelling property with respect to said solvent contained in said resin liquid.

12. The resin layer forming apparatus as claimed in claim 11, wherein said curing solid is a silicone resin.

13. The resin layer forming apparatus as claimed in claim 11, wherein said curing solid has a glossy surface.

14. The resin layer forming apparatus as claimed in claim 11, further comprising a forming unit for forming at least one of a matted and embossed surface on said resin layer.

15. The resin layer forming apparatus as claimed in claim 11, wherein said applying unit applies said resin liquid to a selected part of said printed surface.

16. The resin layer forming apparatus as claimed in claim 11, wherein said applying unit applies said resin liquid to said printed surface in a non-contact manner by using one of a spray and a jet nozzle.

17. The resin layer forming apparatus as claimed in claim 11, wherein said curing unit varies, a contact pressure between said curing solid and said print surface based on at least one of a degree of roughness of said printed surface, a degree of infiltration of the ink into said recording medium and a degree of dryness of the ink on said printed surface.

18. An image forming apparatus for forming a resin layer on a printed surface of a recording medium, comprising:

a print unit for printing an ink image on said recording medium so as to form said printed surface;

an applying unit for applying a resin liquid to said printed surface of said recording medium, said resin liquid containing a solvent and a resin dissolved in said solvent; and a curing unit for curing said resin liquid, said curing unit including a curing solid which contacts said resin liquid applied on said print surface, said curing solid having a swelling property with respect to said solvent contained in said resin liquid.

19. A resin layer forming apparatus for forming a resin layer on a printed surface of a recording medium, comprising:

an applying unit for applying a resin liquid to said printed surface of said recording medium, said resin liquid containing a solvent and a resin dissolved in said solvent; and a curing unit for curing said resin liquid, said curing unit applying a curing liquid to contact said resin liquid applied on said printed surface, said curing liquid being miscible with said solvent in which said resin is dissolved, said curing liquid having a molecular weight greater than a molecular weight of said solvent.

20. The resin layer forming apparatus as claimed in claim 19, wherein said curing liquid is a flowable silicone resin.

21. The resin layer forming apparatus as claimed in claim 19, further comprising a forming unit for forming at least one of a matted and embossed surface on said resin layer.

22. The resin layer forming apparatus as claimed in claim 19, wherein said applying unit applies said resin liquid to a selected part of said printed surface.

23. The resin layer forming apparatus as claimed in claim 19, wherein said applying unit applies said resin liquid to said printed surface in a non-contact manner by using one of a spray and a jet nozzle.

24. An image forming apparatus for forming a resin layer on a printed surface of a recording medium, comprising:

a print unit for printing an ink image on said recording medium so as to form said printed surface;

an applying unit for applying a resin liquid to said printed surface of said recording medium, said resin liquid containing a solvent and a resin dissolved in said solvent; and a curing unit for curing said resin liquid, said curing unit applying a curing liquid to contact said resin liquid applied on said printed surface, said curing liquid being miscible with said solvent, said curing liquid having a molecular weight greater than a molecular weight of said solvent.

* * * * *